US009205969B2

(12) United States Patent
Deane et al.

(10) Patent No.: US 9,205,969 B2
(45) Date of Patent: Dec. 8, 2015

(54) TEMPERATURE-STABILIZED STORAGE SYSTEMS

(75) Inventors: Geoffrey F. Deane, Bellevue, WA (US); Lawrence Morgan Fowler, Pound Ridge, NY (US); William Gates, Redmond, WA (US); Zihong Guo, Bellevue, WA (US); Roderick A. Hyde, Redmond, WA (US); Edward K. Y. Jung, Bellevue, WA (US); Jordin T. Kare, Seattle, WA (US); Nathan P. Myhrvold, Bellevue, WA (US); Nathan Pegram, Bellevue, WA (US); Nels R. Peterson, Seattle, WA (US); Clarence T. Tegreene, Bellevue, WA (US); Charles Whitmer, North Bend, WA (US); Lowell L. Wood, Jr., Bellevue, WA (US)

(73) Assignee: TOKITAE LLC, Bellevue, WA (US)

( * ) Notice: Subject to any disclaimer, the term of this patent is extended or adjusted under 35 U.S.C. 154(b) by 1190 days.

(21) Appl. No.: 12/658,579

(22) Filed: Feb. 8, 2010

(65) Prior Publication Data

US 2010/0213200 A1 Aug. 26, 2010

Related U.S. Application Data

(63) Continuation-in-part of application No. 12/001,757, filed on Dec. 11, 2007, and a continuation-in-part of application No. 12/006,088, filed on Dec. 27, 2007, now Pat. No. 8,215,518, and a continuation-in-part of (Continued)

(51) Int. Cl.

| | |
|---|---|
| ***B65D 81/38*** | (2006.01) |
| ***B65G 1/127*** | (2006.01) |
| ***B01L 9/06*** | (2006.01) |

(52) U.S. Cl.

CPC ..... *B65D 81/3802* (2013.01); *B65D 81/3811* (2013.01); *B65D 81/3813* (2013.01);

(Continued)

(58) Field of Classification Search

CPC ..... A61J 1/16; B01L 9/06; C12M 23/48; B65D 81/3811; B65D 81/3846; B65D 2583/049; B65G 1/127

USPC ..... 220/560.1, 560.12, 592.09, 592.26, 220/DIG. 9, 23.83; 221/253, 275, DIG. 1; 211/59.2

See application file for complete search history.

(56) References Cited

U.S. PATENT DOCUMENTS

| | | | |
|---|---|---|---|
| 520,584 | A | 5/1894 | Turner |
| 1,903,171 | A | 3/1933 | Cordrey |

(Continued)

FOREIGN PATENT DOCUMENTS

| | | | |
|---|---|---|---|
| CN | 2414742 | Y | 1/2001 |
| CN | 2460457 | Y | 11/2001 |

(Continued)

OTHER PUBLICATIONS

Chinese State Intellectual Property Office; First Office Action; App No. 200880119918.0; Jul. 13, 2011.

(Continued)

*Primary Examiner* — Jeffrey Allen
*Assistant Examiner* — Andrew T Kirsch
(74) *Attorney, Agent, or Firm* — Dorsey & Whitney LLP

(57) ABSTRACT

A substantially thermally sealed storage container includes an outer assembly, including one or more sections of ultra efficient insulation material substantially defining at least one thermally sealed storage region, and an inner assembly, including at least one heat sink unit within the at least one thermally sealed storage region, and at least one stored material dispenser unit, wherein the at least one stored material dispenser unit includes one or more interlocks.

34 Claims, 22 Drawing Sheets

Related U.S. Application Data application No. 12/006,089, filed on Dec. 27, 2007, and a continuation-in-part of application No. 12/008,695, filed on Jan. 10, 2008, now Pat. No. 8,377,030, and a continuation-in-part of application No. 12/012,490, filed on Jan. 31, 2008, now Pat. No. 8,069,680, and a continuation-in-part of application No. 12/077,322, filed on Mar. 17, 2008, now Pat. No. 8,215,835, and a continuation-in-part of application No. 12/152,465, filed on May 13, 2008, now Pat. No. 8,485,387, and a continuation-in-part of application No. 12/152,467, filed on May 13, 2008, now Pat. No. 8,211,516, and a continuation-in-part of application No. 12/220,439, filed on Jul. 23, 2008, now Pat. No. 8,603,598.

(52) U.S. Cl.
CPC ..... *B65D81/3823* (2013.01); *B65D 81/3825* (2013.01); *B65D 81/3834* (2013.01); *B65D 81/3888* (2013.01); *B65D 81/3897* (2013.01); *B65D 2203/10* (2013.01); *Y10T 29/49826* (2015.01)

(56) References Cited

U.S. PATENT DOCUMENTS 2,161,295 A 6/1939 Hirschberg
2,496,296 A 2/1950 Lobl
2,717,937 A 9/1955 Lehr et al.
2,967,152 A * 1/1961 Matsch et al. ..... 252/62
3,029,967 A 4/1962 Morrison
3,034,845 A 5/1962 Haumann
3,069,045 A 12/1962 Haumann et al.
3,108,840 A 10/1963 Conrad et al.
3,238,002 A 3/1966 O'Connell et al.
3,921,844 A 11/1975 Walles
3,948,411 A 4/1976 Conte
4,003,426 A 1/1977 Best et al.
4,034,129 A 7/1977 Kittle
4,057,029 A 11/1977 Seiter
4,057,101 A 11/1977 Ruka et al.
4,094,127 A 6/1978 Romagnoli
4,154,363 A 5/1979 Barthel
4,184,601 A 1/1980 Stewart et al.
4,312,669 A 1/1982 Boffito et al.
4,318,058 A 3/1982 Mito et al.
4,358,490 A 11/1982 Nagai
4,388,051 A 6/1983 Dresler et al.
4,402,927 A 9/1983 Von Dardel et al.
4,428,854 A 1/1984 Enjo et al.
4,481,779 A 11/1984 Barthel
4,481,792 A 11/1984 Groeger et al.
4,482,465 A 11/1984 Gray
4,521,800 A 6/1985 Howe
4,526,015 A 7/1985 Laskaris
4,640,574 A 2/1987 Unger
4,726,974 A 2/1988 Nowobilski et al.
4,766,471 A 8/1988 Ovshinsky et al.
4,796,432 A 1/1989 Fixsen et al.
4,810,403 A 3/1989 Bivens et al.
4,855,950 A 8/1989 Takada
4,862,674 A 9/1989 Lejondahl et al.
4,920,387 A 4/1990 Takasu et al.
4,951,014 A 8/1990 Wohlert et al.
4,955,204 A 9/1990 Pehl et al.
4,956,976 A 9/1990 Kral et al.
4,969,336 A * 11/1990 Knippscheer et al. ..... 62/266
4,974,423 A 12/1990 Pring
4,976,308 A 12/1990 Faghri
5,012,102 A 4/1991 Gowlett
5,103,337 A 4/1992 Schrenk et al.
5,116,105 A 5/1992 Hong
5,138,559 A 8/1992 Kuehl et al.
5,187,116 A 2/1993 Kitagawa et al.
5,215,214 A 6/1993 Lev et al.
5,245,869 A 9/1993 Clarke et al.
5,261,241 A 11/1993 Kitahara et al.
5,277,031 A 1/1994 Miller et al.
5,277,959 A 1/1994 Kourtides et al.
5,302,840 A 4/1994 Takikawa
5,330,816 A 7/1994 Rusek, Jr.
5,355,684 A 10/1994 Guice
5,376,184 A 12/1994 Aspden
5,390,734 A 2/1995 Voorhes et al.
5,390,791 A 2/1995 Yeager
5,444,223 A 8/1995 Blama
5,452,565 A 9/1995 Blom et al.
5,505,046 A * 4/1996 Nelson et al. ..... 62/3.6
5,548,116 A 8/1996 Pandelisev
5,563,182 A 10/1996 Epstein et al.
5,573,133 A 11/1996 Park
5,580,522 A 12/1996 Leonard et al.
5,590,054 A 12/1996 McIntosh
5,600,071 A 2/1997 Sooriakumar et al.
5,607,076 A 3/1997 Anthony
5,633,077 A 5/1997 Olinger
5,671,856 A 9/1997 Lisch
5,679,412 A 10/1997 Kuehnle et al.
5,709,472 A 1/1998 Prusik et al.
5,782,344 A 7/1998 Edwards et al.
5,800,905 A 9/1998 Sheridan et al.
5,821,762 A 10/1998 Hamaguchi et al.
5,829,594 A 11/1998 Warder
5,846,224 A 12/1998 Sword et al.
5,846,883 A 12/1998 Moslehi
5,857,778 A 1/1999 Ells
5,900,554 A 5/1999 Baba et al.
5,915,283 A 6/1999 Reed et al.
5,954,101 A 9/1999 Drube et al.
6,030,580 A 2/2000 Raasch et al.
6,042,264 A 3/2000 Prusik et al.
6,050,598 A 4/2000 Upton
6,209,343 B1 4/2001 Owen
6,212,904 B1 4/2001 Arkharov et al.
6,213,339 B1 4/2001 Lee
6,234,341 B1 5/2001 Tattam
6,272,679 B1 8/2001 Norin
6,287,652 B2 9/2001 Speckhals et al.
6,321,977 B1 11/2001 Lee
6,337,052 B1 1/2002 Rosenwasser
6,438,992 B1 8/2002 Smith et al.
6,439,406 B1 * 8/2002 Duhon ..... 211/131.1
6,453,749 B1 9/2002 Petrovic et al.
6,465,366 B1 10/2002 Nemani et al.
6,467,642 B2 10/2002 Mullens et al.
6,485,805 B1 11/2002 Smith et al.
6,521,077 B1 2/2003 McGivern et al.
6,571,971 B1 6/2003 Weiler
6,584,797 B1 7/2003 Smith et al.
6,624,349 B1 9/2003 Bass
6,673,594 B1 1/2004 Owen et al.
6,688,132 B2 2/2004 Smith et al.
6,692,695 B1 2/2004 Bronshtein et al.
6,701,724 B2 3/2004 Smith et al.
6,742,650 B2 6/2004 Yang et al.
6,742,673 B2 6/2004 Credle, Jr. et al.
6,751,963 B2 6/2004 Navedo et al.
6,771,183 B2 8/2004 Hunter
6,806,808 B1 10/2004 Watters et al.
6,813,330 B1 11/2004 Barker et al.
6,841,917 B2 1/2005 Potter
6,877,504 B2 4/2005 Schreff et al.
6,967,051 B1 11/2005 Augustynowicz et al.
6,997,241 B2 2/2006 Chou et al.
7,001,656 B2 2/2006 Maignan et al.
7,038,585 B2 5/2006 Hall et al.
7,128,807 B2 10/2006 Mörschner et al.
7,240,513 B1 7/2007 Conforti
7,253,788 B2 8/2007 Choi et al.
7,258,247 B2 8/2007 Marquez
7,267,795 B2 9/2007 Ammann et al.
7,278,278 B2 10/2007 Wowk et al.
7,596,957 B2 10/2009 Fuhr et al.
7,789,258 B1 * 9/2010 Anderson ..... 220/6

(56) References Cited

U.S. PATENT DOCUMENTS

| | | | |
|---|---|---|---|
| 7,807,242 | B2 | 10/2010 | Soerensen et al. |
| 7,982,673 | B2 | 7/2011 | Orton et al. |
| 8,074,271 | B2 | 12/2011 | Davis et al. |
| 8,138,913 | B2 | 3/2012 | Nagel et al. |
| 8,174,369 | B2 | 5/2012 | Jones et al. |
| 8,211,516 | B2 | 7/2012 | Bowers et al. |
| 2002/0050514 | A1 | 5/2002 | Schein |
| 2002/0083717 | A1 | 7/2002 | Mullens et al. |
| 2002/0084235 | A1 | 7/2002 | Lake |
| 2002/0130131 | A1 | 9/2002 | Zucker et al. |
| 2002/0155699 | A1 | 10/2002 | Ueda |
| 2002/0187618 | A1 | 12/2002 | Potter |
| 2003/0039446 | A1 | 2/2003 | Hutchinson et al. |
| 2003/0072687 | A1 | 4/2003 | Nehring et al. |
| 2003/0148773 | A1 | 8/2003 | Spriestersbach et al. |
| 2003/0160059 | A1 | 8/2003 | Credle, Jr. et al. |
| 2004/0035120 | A1 | 2/2004 | Brunnhofer |
| 2004/0055313 | A1 | 3/2004 | Navedo et al. |
| 2004/0055600 | A1 | 3/2004 | Izuchukwu |
| 2004/0103302 | A1 | 5/2004 | Yoshimura et al. |
| 2004/0145533 | A1 | 7/2004 | Taubman |
| 2005/0009192 | A1 | 1/2005 | Page |
| 2005/0029149 | A1 | 2/2005 | Leung et al. |
| 2005/0053345 | A1 | 3/2005 | Bayindir et al. |
| 2005/0067441 | A1 | 3/2005 | Alley |
| 2005/0143787 | A1 | 6/2005 | Boveja et al. |
| 2005/0188715 | A1 | 9/2005 | Aragon |
| 2005/0247312 | A1 | 11/2005 | Davies |
| 2005/0255261 | A1 | 11/2005 | Nomula |
| 2005/0274378 | A1 | 12/2005 | Bonney et al. |
| 2006/0021355 | A1 | 2/2006 | Boesel et al. |
| 2006/0027467 | A1 | 2/2006 | Ferguson |
| 2006/0054305 | A1 | 3/2006 | Ye |
| 2006/0071585 | A1 | 4/2006 | Wang |
| 2006/0150662 | A1 | 7/2006 | Lee et al. |
| 2006/0187026 | A1 | 8/2006 | Kochis |
| 2006/0191282 | A1 | 8/2006 | Sekiya et al. |
| 2006/0196876 | A1 | 9/2006 | Rohwer |
| 2006/0259188 | A1 | 11/2006 | Berg |
| 2006/0280007 | A1 | 12/2006 | Ito et al. |
| 2007/0041814 | A1 | 2/2007 | Lowe |
| 2007/0210090 | A1 | 9/2007 | Sixt et al. |
| 2008/0012577 | A1 | 1/2008 | Potyrailo et al. |
| 2008/0022698 | A1 | 1/2008 | Hobbs et al. |
| 2008/0060215 | A1 | 3/2008 | Reilly et al. |
| 2008/0129511 | A1 | 6/2008 | Yuen et al. |
| 2008/0164265 | A1 | 7/2008 | Conforti |
| 2008/0184719 | A1 | 8/2008 | Lowenstein |
| 2008/0186139 | A1 | 8/2008 | Butler et al. |
| 2008/0233391 | A1 | 9/2008 | Sterzel et al. |
| 2008/0269676 | A1 | 10/2008 | Bieberich et al. |
| 2008/0272131 | A1 | 11/2008 | Roberts et al. |
| 2008/0297346 | A1 | 12/2008 | Brackmann et al. |
| 2009/0049845 | A1 | 2/2009 | McStravick et al. |
| 2009/0275478 | A1 | 11/2009 | Atkins et al. |
| 2009/0301125 | A1 | 12/2009 | Myles et al. |
| 2009/0309733 | A1 | 12/2009 | Moran et al. |
| 2010/0016168 | A1 | 1/2010 | Atkins et al. |
| 2010/0028214 | A1 | 2/2010 | Howard et al. |
| 2010/0265068 | A1 | 10/2010 | Brackmann et al. |
| 2010/0287963 | A1 | 11/2010 | Billen et al. |
| 2011/0100605 | A1 | 5/2011 | Zheng et al. |
| 2011/0117538 | A1 | 5/2011 | Niazi |
| 2011/0297306 | A1 | 12/2011 | Yang |
| 2012/0168645 | A1 | 7/2012 | Atzmony et al. |
| 2013/0306656 | A1 | 11/2013 | Eckhoff et al. |

FOREIGN PATENT DOCUMENTS

| | | | |
|---|---|---|---|
| CN | 1496537 | A | 5/2004 |
| CN | 1756912 | A | 4/2006 |
| CN | 1827486 | A | 9/2006 |
| CN | 101073524 | A | 11/2007 |
| FR | 2 621 685 | | 10/1987 |
| GB | 2 441 636 | A | 3/2008 |
| WO | WO 94/15034 | | 7/1994 |
| WO | WO 99/36725 | A1 | 7/1999 |
| WO | WO 2005/084353 | A2 | 9/2005 |
| WO | WO 2007/039553 | A2 | 4/2007 |

OTHER PUBLICATIONS

PCT International Search Report; Application No. PCT/US2011/001939; Mar. 27, 2012; pp. 1-2.

Chinese State Intellectual Property Office; App. No. 200880119777.2; Mar. 30, 2012; pp. 1-10 (no translation available).

U.S. Appl. No. 13/385,088, Hyde et al.

U.S. Appl. No. 13/374,218, Hyde et al.

U.S. Appl. No. 13/489,058, Bowers et al.

Chinese State Intellectual Property Office; Office Action; Chinese Application No. 200980109399.4; dated Aug. 29, 2012; pp. 1-12 (No translation provided).

Winn, Joshua N. et al.; "Omnidirectional reflection from a one-dimensional photonic crystal"; Optics Letters; Oct. 15, 1998; pp. 1573-1575; vol. 23, No. 20; Optical Society of America.

Chinese State Intellectual Property Office; Office Action; App. No. 200880119918.0; May 27, 2013 (received by our agent on May 29, 2013); 9 pages (No English Translation Available).

Chinese State Intellectual Property Office, Office Action; App. No. 200880119918.0; Sep. 18, 2013 (rec'd by our agent Sep. 20, 2013); pp. 1-10 (no English translation available).

U.S. Appl. No. 13/720,328, Hyde et al.

U.S. Appl. No. 13/720,256, Hyde et al.

Chinese State Intellectual Property Office; Office Action; App. No. 200880120366.5; Jun. 27, 2013; 3 pages (no English translation available).

Abdul-Wahab et al.; "Design and experimental investigation of portable solar thermoelectric refrigerator"; Renewable Energy; 2009; pp. 30-34; vol. 34; Elsevier Ltd.

Astrain et al.; "Computational model for refrigerators based on Peltier effect application"; Applied Thermal Engineering; 2005; pp. 3149-3162; vol. 25; Elsevier Ltd.

Azzouz et al.; "Improving the energy efficiency of a vapor compression system using a phase change material"; Second Conference on Phase Change Material & Slurry: Scientific Conference & Business Forum; Jun. 15-17, 2005; pp. 1-11; Yverdon-les-Bains, Switzerland.

Chatterjee et al.; "Thermoelectric cold-chain chests for storing/transporting vaccines in remote regions"; Applied Energy; 2003; pp. 415-433; vol. 76; Elsevier Ltd.

Chiu et al.; "Submerged finned heat exchanger latent heat storage design and its experimental verification"; Applied Energy; 2012; pp. 507-516; vol. 93; Elsevier Ltd.

Conway et al.; "Improving Cold Chain Technologies through the Use of Phase Change Material"; Thesis, University of Maryland; 2012; pp. ii-xv and 16-228.

Dai et al.; "Experimental investigation and analysis on a thermoelectric refrigerator driven by solar cells"; Solar Energy Materials & Solar Cells; 2003; pp. 377-391; vol. 77; Elsevier Science B.V.

U.S. Appl. No. 13/907,470, Bowers et al.

U.S. Appl. No. 13/906,909, Bloedow et al.

Ghoshal et al.; "Efficient Switched Thermoelectric Refrigerators for Cold Storage Applications"; Journal of Electronic Materials; 2009; pp. 1-6; doi: 10.1007/s11664-009-0725-3.

Groulx et al.; "Solid-Liquid Phase Change Simulation Applied to a Cylindrical Latent Heat Energy Storage System"; Excerpt from the Proceedings of the COMSOL Conference, Boston; 2009; pp. 1-7.

Jiajitsawat, Somchai; "A Portable Direct-PV Thermoelectric Vaccine Refrigerator with Ice Storage Through Heat Pipes"; Dissertation, University of Massachusetts, Lowell; 2008; three cover pages, pp. ii-x, 1-137.

Kempers et al.; "Characterization of evaporator and condenser thermal resistances of a screen mesh wicked heat pipe"; International Journal of Heat and Mass Transfer; 2008; pp. 6039-6046; vol. 51; Elsevier Ltd.

Mohamad et al.; "An Analysis of Sensitivity Distribution Using Two Differential Excitation Potentials in ECT"; IEEE Fifth International Conference on Sensing Technology; 2011; pp. 575-580; IEEE.

(56) References Cited

OTHER PUBLICATIONS

Mohamad et al.; "A introduction of two differential excitation potentials technique in electrical capacitance tomography"; Sensors and Actuators A; 2012; pp. 1-10; vol. 180; Elsevier B.V.
Mughal et al.; "Review of Capacitive Atmospheric Icing Sensors"; The Sixth International Conference on Sensor Technologies and Applications (SENSORCOMM); 2012; pp. 42-47; IARIA.
Omer et al.; "Design optimization of thermoelectric devices for solar power generation"; Solar Energy Materials and Solar Cells; 1998; pp. 67-82; vol. 53; Elsevier Science B.V.
Omer et al.; "Experimental investigation of a thermoelectric refrigeration system employing a phase change material integrated with thermal diode (thermosyphons)"; Applied Thermal Engineering; 2001; pp. 1265-1271; vol. 21; Elsevier Science Ltd.
Oró et al.; "Review on phase change materials (PCMs) for cold thermal energy storage applications"; Applied Energy; 2012; pp. 1-21; doi: 10.1016/j.apenergy.2012.03.058; Elsevier Ltd.
Owusu, Kwadwo Poku; "Capacitive Probe for Ice Detection and Accretion Rate Measurement: Proof of Concept"; Master of Science Thesis, Department of Mechanical Engineering, University of Manitoba; 2010; pp. i-xi, 1-95.
Peng et al.; "Determination of the optimal axial length of the electrode in an electrical capacitance tomography sensor"; Flow Measurement and Instrumentation; 2005; pp. 169-175; vol. 16; Elsevier Ltd.
Peng et al.; "Evaluation of Effect of Number of Electrodes in ECT Sensors on Image Quality"; IEEE Sensors Journal; May 2012; pp. 1554-1565; vol. 12, No. 5; IEEE.
Riffat et al.; "A novel thermoelectric refrigeration system employing heat pipes and a phase change material: an experimental investigation"; Renewable Energy; 2001; pp. 313-323; vol. 23; Elsevier Science Ltd.
Robak et al.; "Enhancement of latent heat energy storage using embedded heat pipes"; International Journal of Heat and Mass Transfer; 2011; pp. 3476-3483; vol. 54; Elsevier Ltd.
Rodríguez et al.; "Development and experimental validation of a computational model in order to simulate ice cube production in a thermoelectric ice maker"; Applied Thermal Engineering; 2009; one cover page and pp. 1-28; doi: 10.1016/j.applthermaleng.2009.03.005.
Russel et al.; "Characterization of a thermoelectric cooler based thermal management system under different operating conditions"; Applied Thermal Engineering; 2012; two cover pages and pp. 1-29; doi: 10.1016/j.applthermaleng.2012.05.002.
Sharifi et al.; "Heat pipe-assisted melting of a phase change material"; International Journal of Heat and Mass Transfer; 2012; pp. 3458-3469; vol. 55; Elsevier Ltd.
Stampa et al.; "Numerical Study of Ice Layer Growth Around a Vertical Tube"; Engenharia Térmica (Thermal Engineering); Oct. 2005; pp. 138-144; vol. 4, No. 2.
Vián et al.; "Development of a thermoelectric refrigerator with two-phase thermosyphons and capillary lift"; Applied Thermal Engineering; 2008; one cover page and pp. 1-16 doi: 10.1016/j.applthermaleng.2008.09.018.
Ye et al.; "Evaluation of Electrical Capacitance Tomography Sensors for Concentric Annulus"; IEEE Sensors Journal; Feb. 2013; pp. 446-456; vol. 13, No. 2; IEEE.
Yu et al.; "Comparison Study of Three Common Technologies for Freezing-Thawing Measurement"; Advances in Civil Engineering; 2010; pp. 1-10; doi: 10.1155/2010/239651.
Chen, Dexiang, et al.; "Opportunities and challenges of developing thermostable vaccines"; Expert Reviews Vaccines; 2009; pp. 547-557; vol. 8, No. 5; Expert Reviews Ltd.
Greenbox Systems; "Thermal Management System"; 2010; Printed on: Feb. 3, 2011; p. 1 of 1; located at http://www.greenboxsystems.com.
Matthias, Dipika M., et al.; "Freezing temperatures in the vaccine cold chain: A systematic literature review"; Vaccine; 2007; pp. 3980-3986; vol. 25; Elsevier Ltd.
Pure Temp; "Technology"; Printed on: Feb. 9, 2011; p. 1-3; located at http://puretemp.com/technology.html.
Spur Industries Inc.; "The Only Way to Get Them Apart is to Melt Them Apart"; 2006; pp. 1-3; located at http://www.spurind.com/applications.php.
Williams, Preston; "Greenbox Thermal Management System Refrigerate—able 2 to 8 C Shipping Containers"; Printed on: Feb. 9, 2011; p. 1; located at http://www.puretemp.com/documents/Refrigerate-able%202%20to%208%20C%20Shipping%20Containers.pdf.
Wirkas, Theo, et al.; "A vaccine cold chain freezing study in PNG highlights technology needs for hot climate countries"; Vaccine; 2007; pp. 691-697; vol. 25; Elsevier Ltd.
World Health Organization; "Preventing Freeze Damage to Vaccines: Aide-memoire for prevention of freeze damage to vaccines"; 2007; pp. 1-4; WHO/IVB/07.09; World Health Organization.
U.S. Appl. No. 12/927,982, Deane et al.
U.S. Appl. No. 12/927,981, Chou et al.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
Saes Getters; "St707 Getter Alloy for Vacuum Systems"; printed on Sep. 22, 2011; pp. 1-2; located at http://www.saegetters.com/default.aspx?idPage=212.
U.S. Appl. No. 13/200,555, Chou et al.
U.S. Appl. No. 13/199,439, Hyde et al.
Chinese Office Action; Application No. 200880120367.X; Oct. 25, 2012 (received by our agent on Oct. 29, 2012); pp. 1-5; No English Translation Provided.
Intellectual Property Office of the People's Republic of China; Office Action; Chinese Application No. 200880119918.0; Dec. 12, 2012; pp. 1-11.
Chinese State Intellectual Property Office; Chinese Office Action; App. No. 200880119777.2; Jan. 7, 2013 (received by our agent on Jan. 9, 2013); pp. 1-12; No English Translation Available.
Chinese State Intellectual Property Office; Office Action; App. No. 200880120366.5; Feb. 17, 2013 (received by our agent Feb. 19, 2013); pp. 1-3 (No English Translation Available).
Chinese State Intellectual Property Office; Office Action; App. No. 200880120366.5; Jun. 1, 2012; pp. 1-19 (no English translation available).
BINE Informationsdienst; "Zeolite/water refrigerators, Projekt*info* 16/10"; BINE Information Service; printed on Feb. 12, 2013; pp. 1-4; FIZ Karlsruhe, Germany; located at: htpp://www.bine.info/fileadmin/content/Publikationen/Englische_Infos/projekt_1610_engl_internetx.pdf.
Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.
Cool-System KEG GMBH; "Cool-System presents: CoolKeg® The world's first self-chilling Keg!"; printed on Feb. 6, 2013; pp. 1-5; located at: http://www.coolsystem.de/.
U.S. Appl. No. 13/853,245, Eckhoff et al.
Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.
Dometic S.A.R.L.; "Introduction of Zeolite Technology into refrigeration systems, LIFE04 ENV/LU/000829, Layman's Report"; printed on Feb. 6, 2013; pp. 1-10; located at: http//ec.europa.eu/environment/life/project/Projects/index.cfm?fuseaction=home.showFile&rep=file&fil=LIFE04_ENV_LU_000829_LAYMAN.pdf.
Dow Chemical Company; "Calcium Chloride Handbook: A Guide to Properties, Forms, Storage and Handling"; Aug. 2003; pp. 1-28.
GAST Manufacturing, Inc.; "Vacuum and Pressure Systems Handbook"; printed on Jan. 3, 2013; pp. 1-20; located at: http://www.gastmfg.com/vphb/vphb_s1.pdf.

(56) References Cited

OTHER PUBLICATIONS

Gea Wiegand; "Pressure loss in vacuum lines with water vapour"; printed on Mar. 13, 2013; pp. 1-2; located at: http://produkte.gea-wiegand.de/GEA/GEACategory/139/index_en.html.
Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.
Kozubal, et al.; "Desiccant Enhanced Evaporative Air-Conditioning (DEVap): Evaluation of a New Concept in Ultra Efficient Air Conditioning, Technical Report NREL/TP-5500-49722"; National Renewable Energy Laboratory; Jan. 2011; pp. i-vii, 1-60, plus three cover pages and Report Documentation Page.
Machine-History.com; "Refrigeration Machines"; printed on Mar. 27, 2013; pp. 1-10; located at: http://www.machine-history.com/Refrigeration%20Machines.
Marquardt, Niels; "Introduction to the Principles of Vacuum Physics"; 1999; pp. 1-24; located at: http://www.cientificosaficionados.com/libros/CERN/vacio1-CERN.pdf.
Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modernmechanix.com/icyball-is-practical-refrigerator-for-farm-or-camp-use/.
NSM Archive; "Band structure and carrier concentration"; date of Jan. 22, 2004 provided by examiner, printed on Feb. 16, 2013; pp. 1-10, 1 additional page of archive information; located at: http://web.archive.org/20040122200811/http://www.ioffe.rssi.ru/SVA/NSM/Semicond/SiC/bandstr.html.
OXYCHEM; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical-properties.pdf.
Restuccia, et al.; "Selective water sorbent for solid sorption chiller: experimental results and modeling"; International Journal of Refrigeration; 2004; pp. 284-293; vol. 27; Elsevier Ltd and IIR.
Rezk, et al.; "Physical and operating conditions effects on silica gel/water adsorption chiller performance"; Applied Energy; 2012; pp. 142-149; vol. 89; Elsevier Ltd.
Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.
Saha, et al.; "A new generation of cooling device employing $CaC1_2$-in-silica gel-water system"; International Journal of Heat and Mass Transfer; 2009; pp. 516-524; vol. 52; Elsevier Ltd.
UOP; "An Introduction to Zeolite Molecular Sieves"; printed on Jan. 10, 2013; pp. 1-20; located at: http://www.eltrex.p1.pdf/karty/adsorbenty/ENG-Introduction%20to%20Zeolite%20Molecular%20Sieves.pdf.
Wang, et al.; "Study of a novel silica gel-water adsorption chiller. Part I. Design and performance prediction"; International Journal of Refrigeration; 2005; pp. 1073-1083; vol. 28; Elsevier Ltd and IIR.
Wikipedia; "Icyball"; Mar. 14, 2013; printed on Mar. 27, 2013; pp. 1-4; located at: http://en.wikipedia.org/wiki/Icyball.
U.S. Appl. No. 13/135,126, Deane et al.
Cabeza, L. F. et al.; "Heat transfer enhancement in water when used as PCM in thermal energy storage"; Applied Thermal Engineering; 2002; pp. 1141-1151; vol. 22; Elsevier Science Ltd.
Chen, Dexiang et al.; "Characterization of the freeze sensitivity of a hepatitis B vaccine"; Human Vaccines; Jan. 2009; pp. 26-32; vol. 5, Issue 1; Landes Bioscience.
Edstam, James S. et al.; "Exposure of hepatitis B vaccine to freezing temperatures during transport to rural health centers in Mongolia"; Preventive Medicine; 2004; pp. 384-388; vol. 39; The Institute for Cancer Prevention and Elsevier Inc.
Efe, Emine et al.; "What do midwives in one region in Turkey know about cold chain?"; Midwifery; 2008; pp. 328-334; vol. 24; Elsevier Ltd.
Günter, M. M. et al.; "Microstructure and bulk reactivity of the nonevaporable getter $Zr_{57}V_{36}Fe_7$"; J. Vac. Sci. Technol. A; Nov./Dec. 1998; pp. 3526-3535; vol. 16, No. 6; American Vacuum Society.
Hipgrave, David B. et al ; "Immunogenicity of a Locally Produced Hepatitis B Vaccine With the Birth Dose Stored Outside the Cold Chain in Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Li, Yang et al.; "Study on effect of liquid level on the heat leak into vertical cryogenic vessels"; Cryogenics; 2010; pp. 367-372; vol. 50; Elsevier Ltd.
Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.
Matolin, V. et al.; "Static SIMS study of TiZrV NEG activation"; Vacuum; 2002; pp. 177-184; vol. 67; Elsevier Science Ltd.
Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.
Ren, Qian et al.; "Evaluation of an Outside-The-Cold-Chain Vaccine Delivery Strategy in Remote Regions of Western China"; Public Health Reports; Sep.-Oct. 2009; pp. 745-750; vol. 124.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage of Vaccines in the Community: Weak Link in the Cold Chain?"; British Medical Journal; Mar. 21, 1992; pp. 756-758; vol. 304, No. 6829; BMJ Publishing Group.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
World Health Organization; "Guidelines on the international packaging and shipping of vaccines"; Department of Immunization, Vaccines and Biologicals; Dec. 2005; 40 pages; WHO/IVB/05.23.
PCT International Search Report; International App. No. PCT/US 11/00234; Jun. 9, 2011; pp. 1-4.
U.S. Appl. No. 12/220,439, Hyde et al.
U.S. Appl. No. 12/152,467, Bowers et al.
U.S. Appl. No. 12/152,465, Bowers et al.
U.S. Appl. No. 12/077,322, Hyde et al.
U.S. Appl. No. 12/012,490, Hyde et al.
3M Monitor Mark™; "Time Temperature Indicators—Providing a visual history of time temperature exposure"; 3M Microbiology; bearing a date of 2006; pp. 1-4; located at 3M.com/microbiology.
Adams, R. O.; "A review of the stainless steel surface"; The Journal of Vacuum Science and Technology A; Bearing a date of Jan.-Mar. 1983; pp. 12-18; vol. 1, No. 1; American Vacuum Society.

(56) References Cited

OTHER PUBLICATIONS

Arora, Anubhav; Hakim, Itzhak; Baxter, Joy; Rathnasingham, Ruben; Srinivasan, Ravi; Fletcher, Daniel A.; "Needle-Free Delivery of Macromolecules Across the Skin by Nanoliter-Volume Pulsed Microjets"; PNAS Applied Biological Sciences; Mar. 13, 2007; pp. 4255-4260; vol. 104; No. 11; The National Academy of Sciences USA.
U.S. Appl. No. 12/088,695, Hyde et al.
U.S. Appl. No. 12/006,089, Hyde et al.
U.S. Appl. No. 12/006,088, Hyde et al.
U.S. Appl. No. 12/001,757, Hyde et al.
Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).
Bartl, J., et al.; "Emissivity of aluminium and its importance for radiometric measurement"; Measurement Science Review; Bearing a date of 2004; pp. 31-36; vol. 4, Section 3.
Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.
Benvenuti, C., et al.; "Pumping characteristics of the St707 nonevaporable getter (Zr 70 V 24.6-Fe 5.4 wt %)"; The Journal of Vacuum Science and Technology A; Bearing a date of Nov.-Dec. 1996; pp. 3278-3282; vol. 14, No. 6; American Vacuum Society.
Brenzel, Logan; Wolfson, Lara J.; Fox-Rushby, Julia; Miller, Mark; Halsey, Neal A.; "Vaccine-Preventable Diseases—Chapter 20"; Disease Control Priorities in Developing Countries; printed on Oct. 15, 2007; pp. 389-411.
CDC; "Vaccine Management: Recommendations for Storage and Handling of Selected Biologicals"; Jan. 2007; 16 pages total; Department of Health & Human Services U.S.A.
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315; The American Association for the Advancement of Science.
Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.
Cole-Palmer; "Temperature Labels and Crayons"; www.coleparmer.com; bearing a date of 1971 and printed on Sep. 27, 2007; p. 1.
Cornell University Coop; "The Food Keeper"; printed on Oct. 15, 2007; 7 pages total (un-numbered).
Daryabeigi, Kamran; "Thermal Analysis and Design Optimization of Multilayer Insulation for Reentry Aerodynamic Heating"; Journal of Spacecraft and Rockets; Jul.-Aug. 2002; pp. 509-514; vol. 39; No. 4; American Institute of Aeronautics and Astronautics Inc.
Demko, J. A., et al.; "Design Tool for Cryogenic Thermal Insulation Systems"; Advances in Cryogenic Engineering: Transactions of the Cryogenic Engineering Conference-CEC; Bearing a date of 2008; pp. 145-151; vol. 53; American institute of Physics.
Department of Health and Social Services, Division of Public Health, Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.
Ette, Ene I.; "Conscience, the Law, and Donation of Expired Drugs"; The Annals of Pharmacotherapy; Jul./Aug. 2004; pp. 1310-1313; vol. 38.
Ferrotec; "Ferrofluid: Magnetic Liquid Technology"; bearing dates of 2001-2008; printed on Mar. 10, 2008; found at http://www.ferrotec.com/technology/ferrofluid.php.
Fricke, Jochen; Emmerling, Andreas; "Aerogels—Preparation, Properties, Applications"; Structure and Bonding; 1992; pp. 37-87; vol. 77; Springer-Verlag Berlin Heidelberg.
Hedayat, A., et al.; "Variable Density Multilayer Insulation for Cryogenic Storage"; Bearing a date of 2000; pp. 1-10.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.
JAMC; "Preventing Cold Chain Failure: Vaccine Storage and Handling"; JAMC; Oct. 26, 2004; p. 1050; vol. 171; No. 9; Canadian Medical Association.
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical Medicine and Hygiene; 2006; pp. 750-754; vol. 74; No. 5; The American Society of Tropical Medicine and Hygiene.
Keller, C. W., et al.; "Thermal Performance of Multilayer Insulations, Final Report, Contract NAS 3-14377"; Bearing a date of Apr. 5, 1974; pp. 1-446.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Little, Arthur D.; "Liquid Propellant Losses During Space Flight, Final Report on Contract No. NASw-615"; Bearing a date of Oct. 1964; pp. 1-315.
Llanos-Cuentas, A.; Campus, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute Plasmodium Falciparum Malaria in Peru"; The Brazilian Journal of Infectious Diseases; 2001; pp. 67-72; vol. 5; No. 2; The Brazilian Journal of Infectious Diseases and Contexto Publishing.
Lockheed Missiles & Space Company; "High-Performance Thermal Protection Systems, Contract NAS 8-20758, vol. II"; Bearing a date of Dec. 31, 1969; pp. 1-117.
Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4° C. to 55° C."; 12th Conference on Retroviruses and Opportunistic Infections, Boston, Massachusetts; Feb. 22-25, 2005; p. 1; Foundation for Retrovirology and Human Health.
Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.
Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.
Moshfegh, B.; "A New Thermal Insulation System for Vaccine Distribution; Journal of Thermal Insulation"; Jan. 1992; pp. 226-247; vol. 15; Technomic Publishing,Co., Inc.
Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.
Nemanič, Vincenc, et al.; "Outgassing of a thin wall vacuum insulating panel"; Vacuum; Bearing a date of 1998; pp. 233-237; vol. 49, No. 3; Elsevier Science Ltd.
Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.

(56) References Cited

OTHER PUBLICATIONS

Nolan, Timothy D. C.; Hattler, Brack G.; Federspiel, William J.; "Development of a Balloon Volume Sensor for Pulsating Balloon Catheters"; ASAIO Journal; 2004; pp. 225-233; vol. 50; No. 3; American Society of Artificial Internal Organs.
PATH—A Catalyst for Global Health; "Uniject™ Device—The Radically Simple Uniject™ Device—Rethinking the Needle to Improve Immunization"; bearing dates of 1995-2006; printed on Oct. 11, 2007; pp. 1-2; located at http://www.path.org/projects/uniject.php; PATH Organization.
Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins.
PCT International Search Report; International App. No. PCT/US09/01715; Jan. 8, 2010; pp. 1-2.
PCT International Search Report; International App. No. PCT/US08/13646; Apr. 9, 2009; pp. 1-2.
PCT International Search Report; International App. No. PCT/US08/13648; Mar. 13, 2009; pp. 1-2.
PCT International Search Report; International App. No. PCT/US08/13642; Feb. 26, 2009; pp. 1-2.
PCT International Search Report; International App. No. PCT/US08/13643; Feb. 20, 2009; pp. 1-2.
Pekala, R. W.; "Organic Aerogels From the Polycondensation of Resorcinol With Formaldehyde"; Journal of Materials Science; Sep. 1989; pp. 3221-3227; vol. 24; No. 9; Springer Netherlands.
Pickering, Larry K.; Wallace, Gregory; Rodewald, Lance; "Too Hot, Too Cold: Issues with Vaccine Storage"; Pediatrics®—Official Journal of the American Academy of Pediatrics; 2006; pp. 1738-1739 (4 pages total, incl. cover sheet and end page); vol. 118; American Academy of Pediatrics.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located at www.ChildrensVaccine.org/html/safe_injection.htm.
Risha, Peter G.; Shewiyo, Danstan; Msami, Amani; Masuki, Gerald; Vergote, Geert; Vervaet, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Seto, Joyce; Marra, Fawziah; "Cold Chain Management of Vaccines"; Continuing Pharmacy Professional Development HomeStudy Program; Feb. 2005; pp. 1-19; University of British Columbia.
Shockwatch; "Environmental Indicators"; printed on Sep. 27, 2007; pp. 1-2; located at www.shockwatch.com.
Suttmeier, Chris; "Warm Mix Asphalt: A Cooler Alternative"; Material Matters—Around the Hot Mix Industry; Spring 2006; pp. 21-22; Peckham Materials Corporation.
Thompson, Marc T.; "Eddy current magnetic levitation—Models and experiments"; IEEE Potentials; Feb./Mar. 2000; pp. 40-46; IEEE.
"Two Wire Gage / Absolute Pressure Transmitters—Model 415 and 440"; Honeywell Sensotec; pp. 1-2; Located at www.sensotec.com and www.honeywell.com/sensing.
UNICEF Regional Office for Latin America & The Carribean (UNICEF-TACRO); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zhu, Z. Q.; Howe, D.; "Halbach Permanent Magnet Machines and Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.
Bapat, S. L. et al.; "Experimental investigations of multilayer insulation"; *Cryogenics*; Bearing a date of Aug. 1990; pp. 711-719; vol. 30.
Bapat, S. L. et al.; "Performance prediction of multilayer insulation"; *Cryogenics*; Bearing a date of Aug. 1990; pp. 700-710; vol. 30.
Barth, W. et al.; "Experimental investigations of superinsulation models equipped with carbon paper"; *Cryogenics*; Bearing a date of May 1988; pp. 317-320; vol. 28.
Barth, W. et al.; "Test results for a high quality industrial superinsulation"; *Cryogenics*; Bearing a date of Sep. 1988; pp. 607-609; vol. 28.
Benvenuti, C. et al.; "Obtention of pressures in the $10^{-14}$ torr range by means of a Zr V Fe non evaporable getter"; *Vacuum*; Bearing a date of 1993; pp. 511-513; vol. 44; No. 5-7; Pergamon Press Ltd.
Benvenuti, C.; "Decreasing surface outgassing by thin film getter coatings"; *Vacuum*; Bearing a date of 1998; pp. 57-63; vol. 50; No. 1-2; Elsevier Science Ltd.
Benvenuti, C.; "Nonevaporable getter films for ultrahigh vacuum applications"; *Journal of Vacuum Science Technology A Vacuum Surfaces, and Films*; Bearing a date of Jan./Feb. 1998; pp. 148-154; vol. 16; No. 1; American Chemical Society.
Berman, A.; "Water vapor in vacuum systems"; *Vacuum*; Bearing a date of 1996; pp. 327-332; vol. 47; No. 4; Elsevier Science Ltd.
Bernardini, M. et al.; "Air bake-out to reduce hydrogen outgassing from stainless steel"; *Journal of Vacuum Science Technology*; Bearing a date of Jan./Feb. 1998; pp. 188-193; vol. 16; No. 1; American Chemical Society.
Bo, H. et al.; "Tetradecane and hexadecane binary mixtures as phase change materials (PCMs) for cool storage in district cooling systems"; *Energy*; Bearing a date of 1999; vol. 24; pp. 1015-1028; Elsevier Science Ltd.
Boffito, C. et al.; "A nonevaporable low temperature activatable getter material"; *Journal of Vacuum Science Technology*; Bearing a date of Apr. 1981; pp. 1117-1120; vol. 18; No. 3; American Vacuum Society.

(56) References Cited

OTHER PUBLICATIONS

Brown, R.D.; "Outgassing of epoxy resins in vacumm."; *Vacuum*; Bearing a date of 1967; pp. 25-28; vol. 17; No. 9; Pergamon Press Ltd.
Burns, H. D.; "Outgassing Test for Non-metallic Materials Associated with Sensitive Optical Surfaces in a Space Environment"; MSFC-SPEC-1443; Bearing a date of Oct. 1987; pp. 1-10.
Chen, G. et al.; "Performance of multilayer insulation with slotted shield"; *Cryogenics ICEC Supplement*; Bearing a date of 1994; pp. 381-384; vol. 34.
Chen, J. R. et al.; "An aluminum vacuum chamber for the bending magnet of the SRRC synchrotron light source"; *Vacuum*; Bearing a date of 1990; pp. 2079-2081; vol. 41; No. 7-9; Pergamon Press PLC.
Chen, J. R. et al.; "Outgassing behavior of A6063-EX aluminum alloy and SUS 304 stainless steel"; *Journal of Vacuum Science Technology*; Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; *Journal of Vacuum Science Technology*; Bearing a date of Jul./Aug. 1994; pp. 1750-1754; vol. 12; No. 4; American Vacuum Society.
Chen, J. R. et al.; "Thermal outgassing from aluminum alloy vacuum chambers"; *Journal of Vacuum Science Technology*; Bearing a date of Nov./Dec. 1985; pp. 2188-2191; vol. 3; No. 6; American Vacuum Society.
Chen, J. R.; "A comparison of outgassing rate of 304 stainless steel and A6063-EX aluminum alloy vacuum chamber after filling with water"; *Journal of Vacuum Science Technology A Vacuum Surfaces and Film*; Bearing a date of Mar. 1987; pp. 262-264; vol. 5; No. 2; American Chemical Society.
Chiggiato, P.; "Production of extreme high vacuum with non evaporable getters" *Physica Scripta*; Bearing a date of 1997; pp. 9-13; vol. T71.
Cho, B.; "Creation of extreme high vacuum with a turbomolecular pumping system: A baking approach"; *Journal of Vacuum Science Technology*; Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; *Composites Part B: Engineering*; Bearing a date of 2008; pp. 782-791; vol. 39; Elsevier Science Ltd.
Chun, I. et al.; "Effect of the Cr-rich oxide surface on fast pumpdown to ultrahigh vacuum"; *Journal of Vacuum Science Technology A Vacuum, Surfaces, and Films*; Bearing a date of Sep./Oct. 1997; pp. 2518-2520; vol. 15; No. 5; American Vacuum Society.
Chun, I. et al.; "Outgassing rate characteristic of a stainless-steel extreme high vacuum system"; *Journal of Vacuum Science Technology*; Bearing a date of Jul./Aug. 1996; pp. 2636-2640; vol. 14; No. 4; American Vacuum Society.
Crawley, D J. et al.; "Degassing Characteristics of Some 'O' Ring Materials"; *Vacuum*; Bearing a date of 1963; pp. 7-9; vol. 14; Pergamon Press Ltd.
Csernatony, L.; "The Properties of Viton 'A' Elastomers II. The influence of permeation, diffusion and solubility of gases on the gas emission rate from an O-ring used as an atmospheric seal or high vacuum immersed"; *Vacuum*; Bearing a date of 1965; pp. 129-134; vol. 16; No. 3; Pergamon Press Ltd.
Day, C.; "The use of active carbons as cryosorbent"; *Colloids and Surfaces A Physicochemical and Engineering Aspects*; Bearing a date of 2001; pp. 187-206; vol. 187-188; Elsevier Science.
Della Porta, P.; "Gas problem and gettering in sealed-off vacuum devices"; *Vacuum*; Bearing a date of 1996; pp. 771-777; vol. 47; No. 6-8 Elsevier Science Ltd.
Dylla, H. F. et al.; "Correlation of outgassing of stainless steel and aluminum with various surface treatments"; *Journal of Vacuum Science Technology*; Bearing a date of Sep./Oct. 1993; pp. 2623-2636; vol. 11; No. 5; American Vacuum Society.
Elsey, R. J. "Outgassing of vacuum material I"; *Vacuum*; Bearing a date of 1975; pp. 299-306; vol. 25; No. 7; Pergamon Press Ltd.
Elsey, R. J. "Outgassing of vacuum materials II" *Vacuum*; Bearing a date of 1975; pp. 347-361; vol. 25; No. 8; Pergamon Press Ltd.
Engelmann, G. et al.; "Vacuum chambers in composite material"; *Journal of Vacuum Science Technology*; Bearing a date of Jul./Aug. 1987; pp. 2337-2341; vol. 5; No. 4; American Vacuum Society.
Eyssa, Y. M. et al.; "Thermodynamic optimization of thermal radiation shields for a cryogenic apparatus"; *Cryogenics*; Bearing a date of May 1978; pp. 305-307; vol. 18; IPC Business Press.
Glassford, A. P. M. et al.; "Outgassing rate of multilayer insulation"; *1978*; Bearing a date of 1978; pp. 83-106.
Gupta, A. K. et al.; "Outgassing from epoxy resins and methods for its reduction"; *Vacuum*; Bearing a date of 1977; pp. 61-63; vol. 27; No. 12; Pergamon Press Ltd.
HaŁaczek, T. et al.; "Flat-plate cryostat for measurements of multilayer insulation thermal conductivity"; *Cryogenics*; Bearing a date of Oct. 1985; pp. 593-595; vol. 25; Butterworth & Co. Ltd.
HaŁaczek, T. et al.; "Unguarded cryostat for thermal conductivity measurements of multilayer insulations"; *Cryogenics*; Bearing a date of Sep. 1985; pp. 529-530; vol. 25; Butterworth & Co. Ltd.
HaŁaczek, T. L. et al.; "Heat transport in self-pumping multilayer insulation"; *Cryogenics*; Bearing a date of Jun. 1986; pp. 373-376; vol. 26; Butterworth & Co. Ltd.
HaŁaczek, T. L. et al.; "Temperature variation of thermal conductivity of self-pumping multilayer insulation"; *Cryogenics*; Bearing a date of Oct. 1986; pp. 544-546.; vol. 26; Butterworth & Co. Ltd.
Halldórsson, Árni, et al.; "The sustainable agenda and energy efficiency: Logistics solutions and supply chains in times of climate change"; *International Journal of Physical Distribution & Logistics Management*; Bearing a date of 2010; pp. 5-13; vol. 40; No. ½; Emerald Group Publishing Ltd.
Halliday, B. S.; "An introduction to materials for use in vacuum"; *Vacuum*; Bearing a date of 1987; pp. 583-585; vol. 37; No. 8-9; Pergamon Journals Ltd.
Hirohata, Y.; "Hydrogen desorption behavior of aluminium materials used for extremely high vacuum chamber"; *Journal of Vacuum Science Technology*; Bearing a date of Sep./Oct. 1993; pp. 2637-2641; vol. 11; No. 5; American Vacuum Society.
Holtrop, K. L. et al.; "High temperature outgassing tests on materials used in the DIII-D tokamak"; *Journal of Vacuum Science Technology*; Bearing a date of Jul./Aug. 2006; pp. 1572—; vol. 24; No. 4; American Vacuum Society.
Hong, S. et al.; "Investigation of gas species in a stainless steel ultrahigh vacuum chamber with hot cathode ionization gauges"; *Measurement Science and Technology*; Bearing a date of 2004; pp. 359-364; vol. 15; IOP Science.
Ishikawa, Y. et al.; "Reduction of outgassing from stainless surfaces by surface oxidation"; *Vacuum*; Bearing a date of 1990; pp. 1995-1997; vol. 4; No. 7-9; Pergamon Press PLC.
Ishikawa, Y.; "An overview of methods to suppress hydrogen outgassing rate from austenitic stainless steel with reference to UHV and EXV"; *Vacuum*; Bearing a date of 2003; pp. 501-512; vol. 69; No. 4; Elsevier Science Ltd.
Ishimaru, H. et al.; "All Aluminum Alloy Vacuum System for the TRISTAN $e^+e$-Storage"; *IEEE Transactions on Nuclear Science*; Bearing a date of Jun. 1981; pp. 3320-3322; vol. NS-28; No. 3.
Ishimaru, H. et al.; "Fast pump-down aluminum ultrahigh vacuum system"; *Journal of Vacuum Science Technology*; Bearing a date of May/Jun. 1992; pp. 547-552 ; vol. 10; No. 3; American Vacuum Society.
Ishimaru, H. et al.; "Turbomolecular pump with an ultimate pressure of $10^{-12}$ Torr"; *Journal of Vacuum Science Technology*; Bearing a date of Jul./Aug. 1994; pp. 1695-1698; vol. 12; No. 4; American Vacuum Society.
Ishimaru, H.; "All-aluminum-alloy ultrahigh vacuum system for a large-scale electron-positron collider"; *Journal of Vacuum Science Technology*; Bearing a date of Jun. 1984; pp. 1170-1175; vol. 2; No. 2; American Vacuum Society.
Ishimaru, H.; "Aluminium alloy-sapphire sealed window for ultrahigh vacuum"; *Vacuum*; Bearing a date of 1983; pp. 339-340.; vol. 33; No. 6; Pergamon Press Ltd.

(56) References Cited

OTHER PUBLICATIONS

Ishimaru, H.; "Bakeable aluminium vacuum chamber and bellows with an aluminium flange and metal seal for ultra-high vacuum"; *Journal of Vacuum Science Technology*; Bearing a date of Nov./Dec. 1978; pp. 1853-1854; vol. 15; No. 6; American Vacuum Society.

Ishimaru, H.; "Ultimate pressure of the order of $10^{-13}$ Torr in an aluminum alloy vacuum chamber"; *Journal of Vacuum Science and Technology*; Bearing a date of May/Jun. 1989; pp. 2439-2442; vol. 7; No. 3; American Vacuum Society.

Jacob, S. et al.; "Investigations into the thermal performance of multilayer insulation (300-77 K) Part 2: Thermal analysis"; *Cryogenics*; Bearing a date of 1992; pp. 1147-1153; vol. 32; No. 12; Butterworth-Heinemann Ltd.

Jacob, S. et al.; "Investigations into the thermal performance of multilayer insulation (300-77 K) Part 1: Calorimetric studies"; *Cryogenics*; Bearing a date of 1992; pp. 1137-1146; vol. 32; No. 12; Butterworth-Heinemann Ltd.

Jenkins, C. H. M.; "Gossamer spacecraft: membrane and inflatable structures technology for space applications"; AIAA; Bearing a date of 2000; pp. 503-527; vol. 191.

Jhung, K. H. C. et al.; "Achievement of extremely high vacuum using a cryopump and conflat aluminium"; *Vacuum*; Bearing a date of 1992; pp. 309-311; vol. 43; No. 4; Pergamon Press PLC.

Kato, S. et al.; "Achievement of extreme high vacuum in the order of $10^{-10}$ Pa without baking of test chamber"; *Journal of Vacuum Science Technology*; Bearing a date of May/Jun. 1990; pp. 2860-2864; vol. 8 ; No. 3; American Vacuum Society.

Keller, K. et al.; "Application of high temperature multilayer insulations"; *Acta Astronautica* ; Bearing a date of 1992; pp. 451-458; vol. 26; No. 6; Pergamon Press Ltd.

Koyatsu, Y. et al. "Measurements of outgassing rate from copper and copper alloy chambers"; *Vacuum*; Bearing a date of 1996; pp. 709-711; vol. 4; No. 6-8; Elsevier Science Ltd.

Kristensen, D. et al.; "Stabilization of vaccines: Lessons learned"; *Human Vaccines*; Bearing a date of Mar. 2010; pp. 227-231; vol. 6; No. 3; Landes Bioscience.

Kropschot, R. H.; "Multiple layer insulation for cryogenic applications"; *Cryogenics*; Bearing a date of Mar. 1961; pp. 135-135; vol. 1.

Li, Y.; "Design and pumping characteristics of a compact titanium—vanadium non-evaporable getter pump"; *Journal of Vacuum Science Technology*; Bearing a date of May/Jun. 1998; pp. 1139-1144; vol. 16; No. 3; American Vacuum Society.

Liu, Y. C. et al.; "Thermal outgassing study on aluminum surfaces"; *Vacuum*; Bearing a date of 1993; pp. 435-437; vol. 44; No. 5-7; Pergamon Press Ltd.

Londer, H. et al.; "New high capacity getter for vacuum insulated mobile $LH_2$ storage tank systems"; *Vacuum*; Bearing a date of 2008; pp. 431-434; vol. 82; No. 4; Elsevier Ltd.

Matsuda, A. et al.; "Simple structure insulating material properties for multilayer insulation"; *Cryogenics*; Bearing a date of Mar. 1980; pp. 135-138; vol. 20; IPC Business Press.

Mikhalchenko, R. S. et al.; "Study of heat transfer in multilayer insulations based on composite spacer materials."; *Cryogenics*; Bearing a date of Jun. 1983; pp. 309-311; vol. 23; Butterworth & Co. Ltd.

Mikhalchenko, R. S. et al.; "Theoretical and experimental investigation of radiative-conductive heat transfer in multilayer insulation"; *Cryogenics*; Bearing a date of May 1985; pp. 275-278; vol. 25; Butterworth & Co. Ltd.

Miki, M. et al.; "Characteristics of extremely fast pump-down process in an aluminum ultrahigh vacuum system"; *Journal of Vacuum Science Technology*; Bearing a date of Jul./Aug. 1994; pp. 1760-1766; vol. 12; No. 4; American Vacuum Society.

Mohri, M. et al.; "Surface study of Type 6063 aluminium alloys for vacuum chamber materials"; *Vacuum*; Bearing a date of 1984; pp. 643-647; vol. 34; No. 6; Pergamon Press Ltd.

Mukugi, K. et al.; "Characteristics of cold cathode gauges for outgassing measurements in uhv range"; *Vacuum*; Bearing a date of 1993; pp. 591-593; vol. 44; No. 5-7; Pergamon Press Ltd.

Nemanič, V. et al.; "Anomalies in kinetics of hydrogen evolution from austenitic stainless steel from 300 to 1000° C."; *Journal of Vacuum Science Technology*; Bearing a date of Jan./Feb. 2001; pp. 215-222; vol. 19; No. 1; American Vacuum Society.

Nemanič, V. et al.; "Outgassing in thin wall stainless steel cells"; *Journal of Vacuum Science Technology*; Bearing a date of May/Jun. 1999; pp. 1040-1046; vol. 17; No. 3; American Vacuum Society.

Nemanič, V.; "Outgassing of thin wall stainless steel chamber"; *Vacuum*; Bearing a date of 1998; pp. 431-437; vol. 50; No. 3-4; Elsevier Science Ltd.

Nemanič, V.; "Vacuum insulating panel"; *Vacuum*; bearing a date of 1995; pp. 839-842; vol. 46; No. 8-10; Elsevier Science Ltd.

Odaka, K. et al.;"Effect of baking temperature and air exposure on the outgassing rate of type 316L stainless steel"; *Journal of Vacuum Science Technology*; Bearing a date of Sep./Oct. 1987; pp. 2902-2906; vol. 5; No. 5; American Vacuum Society.

Odaka, K.; "Dependence of outgassing rate on surface oxide layer thickness in type 304 stainless steel before and after surface oxidation in air"; *Vacuum*; Bearing a date of 1996; pp. 689-692; vol. 47; No. 6-8; Elsevier Science Ltd.

Okamura, S. et al.; "Outgassing measurement of finely polished stainless steel"; *Journal of Vacuum Science Technology*; Bearing a date of Jul./Aug. 1991; pp. 2405-2407; vol. 9; No. 4; American Vacuum Society.

Patrick, T. J.; "Outgassing and the choice of materials for space instrumentation"; *Vacuum*; Bearing a date of 1973; pp. 411-413; vol. 23; No. 11; Pergamon Press Ltd.

Patrick, T. J.; "Space environment and vacuum properties of spacecraft materials"; *Vacuum*; Bearing a date of 1981; pp. 351-357; vol. 31; No. 8-9; Pergamon Press Ltd.

Poole, K. F. et al.; "Hialvac and Teflon outgassing under ultra-high vacuum conditions"; *Vacuum*; Bearing a date of Jun. 30, 1980; pp. 415-417; vol. 30; No. 10; Pergamon Press Ltd.

Redhead, P. A.; "Recommended practices for measuring and reporting outgassing data"; *Journal of Vacuum Science Technology*; Bearing a date of Sep./Oct. 2002; pp. 1667-1675; vol. 20; No. 5; American Vacuum Society.

Rutherford, S; "The Benefits of Viton Outgassing"; Bearing a date of 1997; pp. 1-5; Duniway Stockroom Corp.

Saito, K. et al.; "Measurement system for low outgassing materials by switching between two pumping paths"; *Vacuum*; Bearing a date of 1996; pp. 749-752; vol. 47; No. 6-8; Elsevier Science Ltd.

Saitoh, M. et al.; "Influence of vacuum gauges on outgassing rate measurements"; *Journal of Vacuum Science Technology*; Bearing a date of Sep./Oct. 1993; pp. 2816-2821; vol. 11; No. 5; American Vacuum Society.

Santhanam, S. M. T. J. et al. ;"Outgassing rate of reinforced epoxy and its control by different pretreatment methods"; *Vacuum*; Bearing a date of 1978; pp. 365-366; vol. 28; No. 8-9; Pergamon Press Ltd.

Sasaki, Y. T.; "Reducing SS 304/316 hydrogen outgassing to $2\times10^{-15}$torr *V*cm $^{2}$s"; *Journal of Vacuum Science Technology*; Bearing a date of Jul./Aug. 2007; pp. 1309-1311; vol. 25; No. 4; American Vacuum Society.

Scurlock, R. G. et al.; "Development of multilayer insulations with thermal conductivities below 0.1 μW $cm^{-1}$ $K^{-1}$"; *Cryogenics*; Bearing a date of May 1976; pp. 303-311; vol. 16.

Setia, S. et al.; "Frequency and causes of vaccine wastage"; *Vaccine* ; Bearing a date of 2002; pp. 1148-1156; vol. 20; Elsevier Science Ltd.

Shu, Q. S. et al.; "Heat flux from 277 to 77 K through a few layers of multilayer insulation"; *Cryogenics*; Bearing a date of Dec. 1986; pp. 671-677; vol. 26; Butterworth & Co. Ltd.

Shu, Q. S. et al.; "Systematic study to reduce the effects of cracks in multilayer insulation Part 1: Theoretical model"; *Cryogenics*; Bearing a date of May 1987; pp. 249-256; vol. 27; Butterworth & Co. Ltd.

Shu, Q. S. et al.; "Systematic study to reduce the effects of cracks in multilayer insulation Part 2: experimental results"; *Cryogenics*; Bearing a date of Jun. 1987; pp. 298-311; vol. 27; No. 6; Butterworth & Co. Ltd.

Suemitsu, M. et al.; "Development of extremely high vacuums with mirror-polished A1-alloy chambers"; *Vacuum*; Bearing a date of 1993; pp. 425-428; vol. 44; No. 5-7; Pergamon Press Ltd.

(56) References Cited

OTHER PUBLICATIONS

Suemitsu, M. et al.; "Ultrahigh-vacuum compatible mirror-polished aluminum-alloy surface: Observation of surface-roughness-correlated outgassing rates"; *Journal of Vacuum Science Technology*; Bearing a date of May/Jun. 1992; pp. 570-572; vol. 10; No. 3; American Vacuum Society.

Tatenuma, K. et al.; "Acquisition of clean ultrahigh vacuum using chemical treatment"; *Journal of Vacuum Science Technology*; Bearing a date of Jul./Aug. 1998; pp. 2693-2697; vol. 16; No. 4; American Vacuum Society.

Tatenuma, K.; "Quick acquisition of clean ultrahigh vacuum by chemical process technology"; *Journal of Vacuum Science Technology*; Bearing a date of Jul./Aug. 1993; pp. 2693-2697; vol. 11; No. 4; American Vacuum Society.

Tripathi, A. et al.; "Hydrogen intake capacity of ZrVFe alloy bulk getters"; *Vacuum*; Bearing a date of Aug. 6, 1997; pp. 1023-1025; vol. 48; No. 12; Elsevier Science Ltd.

Watanabe, S. et al.; "Reduction of outgassing rate from residual gas analyzers for extreme high vacuum measurements"; *Journal of Vacuum Science Technology*; Bearing a date of Nov./Dec. 1996; pp. 3261-3266; vol. 14; No. 6; American Vacuum Society.

Wiedemann, C. et al.; "Multi-layer Insulation Literatures Review"; *Advances*; Printed on May 2, 2011; pp. 1-10; German Aerospace Center.

Yamazaki, K. et al.; "High-speed pumping to UHV"; *Vacuum* ; Bearing a date of 2010; pp. 756-759; vol. 84; Elsevier Science Ltd.

Zalba, B. et al.; "Review on thermal energy storage with phase change: materials, heat transfer analysis and applications"; *Applied Thermal Engineering*; Bearing a date of 2003; pp. 251-283; vol. 23; Elsevier Science Ltd.

Zhitomirskij, I.S. et al.; "A theoretical model of the heat transfer processes in multilayer insulation"; *Cryogenics*; Bearing a date of May 1979; pp. 265-268; IPC Business Press.

Chinese State Intellectual Property Office, Office Action; App. No. 201180016103.1 (based on PCT Patent Application No. PCT/US2011/000234); Jun. 23, 2014 (received by our Agent on Jun. 25, 2014); pp. 1-23.

U.S. Appl. No. 14/098,886, Bloedow et al.

U.S. Appl. No. 14/070,892, Hyde et al.

U.S. Appl. No. 14/070,234, Hyde et al.

"About Heat Leak—Comparison"; Technifab Products, Inc.; printed on Jun. 25, 2014; 2 pages; located at www.technifab.com/cryogenic-resource-library/about-heat-leak.html.

PCT International Search Report; International App. No. PCT/US2014/067863; Mar. 27, 2015; pp. 1-3.

* cited by examiner

TEMPERATURE-STABILIZED STORAGE SYSTEMS

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications is incorporated herein by reference to the extent such subject matter is not inconsistent herewith.

RELATED APPLICATIONS

For purposes of the USPTO extra-statutory requirements, the present application constitutes a continuation-in-part of U.S. patent application Ser. No. 12/001,757, entitled TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 11, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/006,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007, now U.S. Pat. No. 8,215,518, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/006,089, entitled TEMPERATURE-STABILIZED STORAGE SYSTEMS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/008,695, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 10, 2008, now U.S. Pat. No. 8,377,030, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/012,490, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 31, 2008, now U.S. Pat. No. 8,069,680, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/077,322, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed Mar. 17, 2008, now U.S. Pat. No. 8,215,835, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/152,465, entitled STORAGE CONTAINER INCLUDING MULTI-LAYER INSULATION COMPOSITE MATERIAL HAVING BANDGAP MATERIAL AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed May 13, 2008, now U.S. Pat. No. 8,485,387, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/152,467, entitled MULTI-LAYER INSULATION COMPOSITE MATERIAL INCLUDING BANDGAP MATERIAL, STORAGE CONTAINER USING SAME, AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed May 13, 2008, now U.S. Pat. No. 8,211,516, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/220,439, entitled MULTI-LAYER INSULATION COMPOSITE MATERIAL HAVING AT LEAST ONE THERMALLY-REFLECTIVE LAYER WITH THROUGH OPENINGS, STORAGE CONTAINER USING SAME, AND RELATED METHODS, naming Roderick A. Hyde; Muriel Y. Ishikawa; Jordin T. Kare; and Lowell L. Wood, Jr. as inventors, filed Jul. 23, 2008, now U.S. Pat. No. 8,603,598, which is currently co-pending, or is an application of which a currently co-pending application is entitled to the benefit of the filing date.

The United States Patent Office (USPTO) has published a notice to the effect that the USPTO's computer programs require that patent applicants reference both a serial number and indicate whether an application is a continuation or continuation-in-part. Stephen G. Kunin, Benefit of Prior-Filed Application, USPTO Official Gazette Mar. 18, 2003, available at http://www.uspto.gov/web/offices/com/sol/og/2003/week11/patbene.htm. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant is designating the present application as a continuation-in-part of its parent applications as set forth above, but expressly points out that such designations are not to be construed in any way as any type of commentary and/or admission as to whether or not the present application contains any new matter in addition to the matter of its parent application(s).

SUMMARY

In an aspect, a system includes, but is not limited to, a substantially thermally sealed storage container, including: an outer assembly, including one or more sections of ultra efficient insulation material substantially defining at least one thermally sealed storage region, wherein the outer assembly and the one or more sections of ultra efficient insulation material substantially define a single access aperture to the at least one thermally sealed storage region; and an inner assembly, including at least one heat sink unit within the at least one thermally sealed storage region, and at least one stored material dispenser unit, wherein the at least one stored material dispenser unit includes one or more interlocks.

In an aspect, a system includes, but is not limited to, a substantially thermally sealed storage container, including: an outer assembly, including an outer wall substantially defining a substantially thermally sealed storage container, the outer wall substantially defining a single outer wall aperture; an inner wall substantially defining a substantially thermally sealed storage region within the storage container, the inner wall substantially defining a single inner wall aperture; a gap between the inner wall and the outer wall; at least one section of ultra efficient insulation material within the gap; a conduit connecting the single outer wall aperture with the single inner wall aperture; a single access aperture to the substantially thermally sealed storage region, wherein the single access aperture is formed by the end of the conduit; and an inner assembly, including one or more heat sink units within the substantially thermally sealed storage region; and at least one stored material dispenser unit. In addition to the foregoing, other system aspects are described in the claims, drawings, and text forming a part of the present disclosure.

In an aspect, a method includes, but is not limited to, a method of assembling contents of a substantially thermally sealed storage container including: inserting, through an access aperture of a substantially thermally sealed storage container, a stored material egress unit; securing the stored material egress unit to a first storage region alignment unit within the storage region; inserting, through the access aperture, a stored material dispenser unit; operably connecting the stored material dispenser unit to the stored material egress unit; inserting, through the access aperture, at least one stored material retention unit; and wherein the storage region, the stored material egress unit, the stored material dispenser unit, the at least one stored material retention unit, and the stored material retention unit stabilizer are maintained within a predetermined temperature range during assembly. In addition to the foregoing, other method aspects are described in the claims, drawings, and text forming a part of the present disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
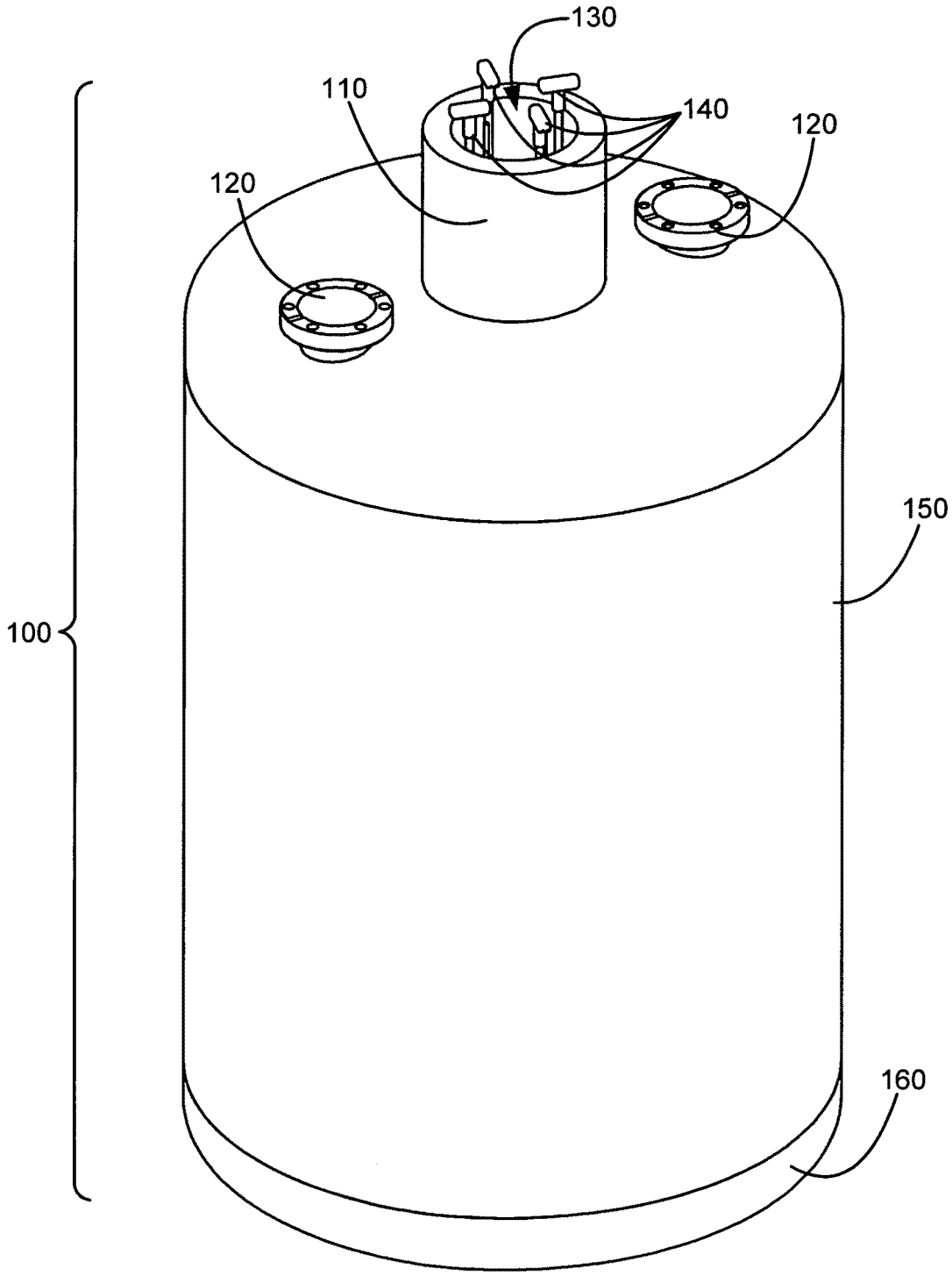
FIG. 1 is a schematic of an external view of a substantially thermally sealed storage container.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

With reference now to FIG. 1, shown is an exterior view of a substantially thermally sealed storage container 100. The substantially thermally sealed storage container 100 may be of a portable size and shape, for example a size and shape within reasonable expected portability estimates for an individual person. The substantially thermally sealed storage container 100 may be configured of a size and shape for carrying or hauling by an individual person. For example, in some embodiments the substantially thermally sealed storage container 100 has a mass that is less than approximately 50 kilograms (kg), or less than approximately 30 kg. For example, in some embodiments the substantially thermally sealed storage container 100 has a length and width that are less than approximately 1 meter (m). The substantially thermally sealed storage container 100 illustrated in FIG. 1 is roughly configured as a cylindrical shape, however multiple shapes are possible depending on the embodiment. For example, a rectangular shape, or an irregular shape, may be desirable in some embodiments, depending on the intended use of the substantially thermally sealed storage container 100. The substantially thermally sealed storage container 100 includes an outer wall 150 substantially defining the substantially thermally sealed storage container 100. The substantially thermally sealed storage container 100 includes a conduit 130 connecting an outer wall 150 single aperture to an inner wall single aperture. The substantially thermally sealed storage container 100 may include an external region 110 of the conduit 130 which extends the conduit 130 externally from the outer surface of the substantially thermally sealed storage container 100 into the region adjacent to the outer surface of the substantially thermally sealed storage container 100. Such an external region 110 of the conduit 130 may be covered with additional material as appropriate to the embodiment, for example to provide stability or insulation to the external region 110 of the conduit 130. The external region 110 of the conduit 130 may be covered with additional material, for example, material such as stainless steel, fiberglass, plastic or a composite material as appropriate to the embodiment to provide stability, durability, and/or thermal insulation to the external region 110 of the conduit 130. The external region 110 of the conduit 130 may be of varying lengths relative to the size and configuration of the substantially thermally sealed storage container 100. For example, the external region 110 of the conduit 130 may project between approximately 4 centimeters (cm) and approximately 10 cm from the surface of the substantially thermally sealed storage container 100. For example, the external region 110 of the conduit 130 may project approximately 6 cm from the surface of the substantially thermally sealed storage container 100. The substantially thermally sealed storage container 100 includes a single access aperture to a substantially thermally sealed storage region. The single access aperture is formed by the end of the conduit 130, at the location where the conduit meets the inner wall.

The substantially thermally sealed storage container 100 may include a base 160, which may be configured to provide stability or balance to the substantially thermally sealed storage container 100. For example, the base 160 may provide mass and therefore ensure stability of the substantially thermally sealed storage container 100 in an upright position, or a position for its intended use. For example, the base 160 may provide mass and form a stable support structure for the substantially thermally sealed storage container 100. In some embodiments, the substantially thermally sealed storage container 100 is configured to be maintained in a position so that the single access aperture to a substantially thermally sealed storage region is commonly maintained substantially at the highest elevated surface of the substantially thermally sealed storage container 100. In embodiments such as that depicted in FIG. 1, such positioning minimizes thermal transfer of heat from the region surrounding the substantially thermally sealed storage container 100 into a storage region within the substantially thermally sealed storage container 100. In order to maintain the thermal stability of a storage region within the substantially thermally sealed storage container 100 over time, thermal transfer of heat from the exterior of the substantially thermally sealed storage container 100 into the substantially thermally sealed storage container 100 is not desirable. A base 160 of sufficient mass may be configured to encourage maintenance of the substantially thermally sealed storage container 100 in an appropriate position for the embodiment during use. A base 160 of sufficient mass may be configured to encourage maintenance of the substantially thermally sealed storage container 100 in an appropriate position for minimal thermal transfer into a storage region within the substantially thermally sealed storage container 100 from a region exterior to the substantially thermally sealed storage container 100. In some embodiments, the external region 110 of the conduit 130 may be elongated and/or nonlinear to create an elongated thermal pathway between the exterior of the container 100 and the exterior of the container.

The substantially thermally sealed storage container 100 can include one or more sealed access ports 120 to the gap between the inner wall and outer wall 150. Such access ports may, for example, be remaining from the fabrication of the substantially thermally sealed storage container 100. Such access ports may, for example, be configured for access during refurbishment of the substantially thermally sealed storage container 100. FIG. 1 also depicts the handle regions of four stored material dispenser unit operators 140 projecting from the external end of the external conduit 110. In varying embodiments, there may be zero, one or a plurality of stored material dispenser unit operators 140 projecting from the external end of the external conduit 110 at a time point during use of the substantially thermally sealed storage container 100. The number and positioning of stored material dispenser unit operators 140 may vary depending on the use of the substantially thermally sealed storage container 100 at a given time point, or the particular substantially thermally sealed storage container 100 embodiment.

The substantially thermally sealed storage container 100 may include, in some embodiments, one or more handles attached to an exterior surface of the container 100, wherein the handles are configured for transport of the container 100. The handles may be fixed on the surface of the container, for example welded, fastened or glued to the surface of the container. The handles may be operably attached but not fixed to the surface of the container, such as with a harness, binding, hoop or chain running along the surface of the container. The handles may be positioned to retain the container 100 with the conduit 130 on the top of the container 100 during transport to minimize thermal transfer from the exterior of the container 100 through the conduit 130.

The substantially thermally sealed storage container 100 may include electronic components. Although it may be desirable, depending on the embodiment, to minimize thermal emissions within the container 100, electronics with thermal emissions may be operably attached to the exterior of the container 100. For example, one or more positioning devices, such as GPS devices, may be attached to the exterior of the container. One or more positioning devices may be configured as part of a system including, for example, monitors, displays, circuitry, power sources, an operator unit, and transmission units. Depending on the embodiment, one or more power sources may be attached to an exterior surface of the container 100, wherein the power source is configured to supply power to circuitry within the container. For example, a solar unit may be attached to the exterior surface of the container 100. For example, a battery unit may be attached to the exterior surface of the container 100. For example, one or more wires may be positioned within the conduit 130 to supply power to circuitry within the container 100. A power source may include wirelessly transmitted power sources, such as described in U.S. patent application Ser. No. 2005/0143787 to Boveja, titled "Method and system for providing electrical pulses for neuromodulation of vagus nerve(s), using rechargeable implanted pulse generator," which is herein incorporated by reference. A power source may include a magnetically transmitted power source. Depending on the embodiment, one or more temperature sensors may be attached to an exterior surface of the container 100. The one or more temperature sensors may be configured, for example, to display the ambient temperature at the surface of the container. The one or more temperature sensors may be configured, for example, to transmit data to one or more system. The one or more temperature sensors may be configured, for example, as part of a temperature monitoring system.

Depending on the embodiment, one or more transmission units may be operably attached to the container 100. For example, one or more transmission units may be operably attached to the exterior surface of the container 100. For example, one or more transmission units may be operably attached to an interior unit within the container 100 (see FIG. 14). Depending on the embodiment, one or more receiving units may be operably attached to the container 100. For example, one or more receiving units may be operably attached to the exterior surface of the container 100. For example, one or more receiving units may be operably attached to an interior unit within the container 100.

Figure 2:
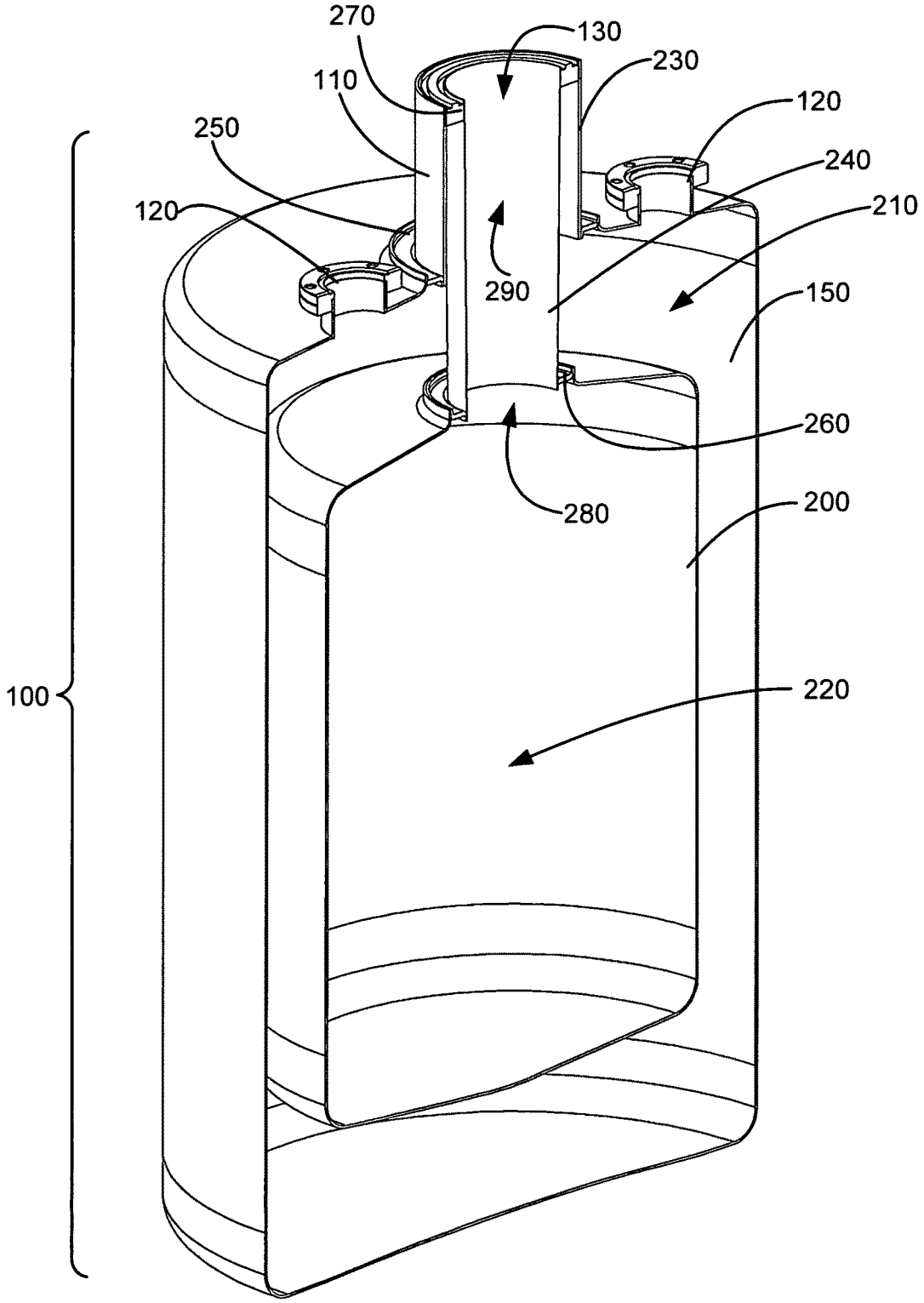
FIG. 2 is a schematic of a vertical cross-section view illustrating some aspects of a substantially thermally sealed storage container.

FIG. 2 depicts a vertical cross section view of the substantially thermally sealed storage container 100 illustrated in FIG. 1. The use of the same symbols in different drawings typically indicates similar or identical items. The substantially thermally sealed storage container 100 includes an outer assembly, which includes an outer wall 150 substantially defining the substantially thermally sealed storage container 100. The outer wall 150 substantially defines an outer wall aperture 290. The outer assembly includes an inner wall 200, which substantially defines a substantially thermally sealed storage region 220 within the storage container 100. In some embodiments, the inner wall 200 substantially defines a substantially thermally sealed storage region 220 with a corresponding shape to the outer wall 150. In some embodiments, the inner wall 200 substantially defines a substantially thermally sealed storage region 220 shaped as an elongated spherical structure. Such a structure may be desirable to maximize access to the substantially thermally sealed storage region 220 while minimizing thermal transfer with the region external to the container 100. In some embodiments, the substantially thermally sealed storage region 220 has a volume of approximately 25 cubic liters. The inner wall substantially defines a single inner wall aperture 280. The outer assembly includes at least one gap 210 between the inner wall 200 and the outer wall 150. The outer assembly includes at least one section of ultra efficient insulation material within the gap 210 between the inner wall 200 and the outer wall 150. The at least one section of ultra efficient insulation material within the gap 210 may include aerogel. The at least one section of ultra efficient insulation material within the gap 210 may include a plurality of layers of ultra efficient insulation material. The at least one section of ultra efficient insulation material within the gap 210 may include at least one superinsulation material. The at least one section of ultra efficient insulation material within the gap 210 may substantially cover to inner wall 200 surface facing the gap 210. The at least one section of ultra efficient insulation material within the gap 210 may substantially cover the outer wall 150 surface facing the gap 210. The gap 210 between the inner wall 200 and the outer wall 150 may include substantially evacuated space, such as substantially evacuated space having a pressure less than or equal to $5\times10^{-4}$ torr.

The outer assembly may include a conduit 130 connecting the single outer wall aperture 290 with the single inner wall aperture 280. The outer assembly and the one or more sections of ultra efficient insulation material may substantially define a single access aperture, and may include a conduit 130 extending from an exterior surface of the storage container to an interior surface of the at least one thermally sealed storage region 220. The outer assembly and the one or more sections of ultra efficient insulation material may substantially define a single access aperture, and may include a conduit 130 surrounding a single access aperture region, wherein the exterior region 110 extends from an exterior surface of the storage container 100 into a region adjacent to the exterior the container 100. In some embodiments, the conduit 130 may extend beyond the outer wall 150 of the container 100, and include an external region 110. The conduit 130 may be configured to substantially define a tubular structure. The conduit 130 may be configured to include an internal surface 240. The conduit 130 may be configured as an elongated thermal pathway within the outer wall 150 of the container 100. The conduit 130 may be fabricated of a variety of materials, depending on the embodiment. For example, the conduit 130 may be fabricated from metal, plastic, fiberglass or a composite relative to the requirements of toughness, durability, stability, or cost associated with a particular embodiment. In some embodiments, the conduit 130 may be fabricated from aluminum. In some embodiments, the conduit 130 may be fabricated from stainless steel. The conduit may include an elongated region 230, which may be fabricated from the same or distinct material as the conduit 130.

In some embodiments, an outer assembly includes one or more sections of ultra efficient insulation material substantially defining at least one thermally sealed storage region 220. For example, the ultra efficient insulation material may be of a size and shape to substantially define at least one thermally sealed storage region 220. For example, the ultra efficient insulation material may be of suitable hardness and toughness to substantially define at least one thermally sealed storage region 220. In some embodiments, the outer assembly and the one or more sections of ultra efficient insulation material substantially define a single access aperture to the at least one thermally sealed storage region 220.

The at least one thermally sealed storage region 220 is configured to be maintained within a predetermined temperature range. Depending on the heat loss from the container, the volume of the at least one thermally sealed storage region 220, the volume and thermal absorption capacity of the heat sink material, the predetermined maintenance temperature range of the at least one thermally sealed storage region 220, and the ambient temperature in the region external to the container, the length of time for the at least one thermally sealed storage region 220 to remain within the predetermined maintenance temperature range may be calculated using standard techniques. See Demko et al., "Design tool for cryogenic thermal insulation systems," Advances in Cryogenic Engineering: Transactions of the Cryogenic Engineering Conference-CEC, 53 (2008), which is incorporated herein by reference. Therefore, various embodiments may be designed and configured to provide at least one thermally sealed storage region 220 remaining within the predetermined maintenance temperature range relative to the volume of the thermally sealed storage region 220, the volume of a particular included heat sink material, the predetermined maintenance temperature range of the at least one thermally sealed storage region 220, and the ambient temperature in the region external to the container. For example, a substantially thermally sealed storage container 100 may be configured to maintain at least one thermally sealed storage region 220 at a temperature substantially between approximately 2 degrees Centigrade and approximately 8 degrees Centigrade for a period of 30 days. For example, for a container with an internal volume of 25 cubic liters including sufficient ultra efficient insulation material, 7 kilograms (kg) of purified water ice may be sufficient to maintain a temperature within the storage region 200 between approximately 2 degrees Centigrade and approximately 4 degrees Centigrade for a period of 30 days in an ambient external temperature of approximately 30 degrees Centigrade.

Some embodiments may include at least one temperature indicator. Temperature indicators may be located at multiple locations relative to the container. Temperature indicators may include temperature indicating labels, which may be reversible or irreversible. Temperature indicators suitable for some embodiments may include, for example, the Environmental Indicators sold by ShockWatch Company, with headquarters in Dallas Tex., the Temperature Indicators sold by Cole-Palmer Company of Vernon Hills Ill. and the Time Temperature Indicators sold by 3M Company, with corporate headquarters in St. Paul Minn., the brochures for which are each hereby incorporated by reference. Temperature indicators suitable for some embodiments may include time-temperature indicators, such as those described in U.S. Pat. Nos. 5,709,472 and 6,042,264 to Prusik et al., titled "Time-temperature indicator device and method of manufacture" and U.S. Pat. No. 4,057,029 to Seiter, titled "Time-temperature indicator," each of which is herein incorporated by reference. Temperature indicators may include, for example, chemically-based indicators, temperature gauges, thermometers, bimetallic strips, or thermocouples.

The inner wall 200 and the outer wall 150 of the substantially thermally sealed storage container 100 may be fabricated from distinct or similar materials. The inner wall 200 and the outer wall 150 may be fabricated from any material of suitable hardness, strength, durability, cost or composition as appropriate to the embodiment. In some embodiments, one or both of the inner wall 200 and the outer wall 150 may be fabricated from stainless steel, or a stainless steel alloy. In some embodiments, one or both of the inner wall 200 and the outer wall 150 may be fabricated from aluminum, or an aluminum alloy. In some embodiments, one or both of the inner wall 200 and the outer wall 150 may be fabricated from fiberglass, or a fiberglass composite. In some embodiments, one or both of the inner wall 200 and the outer wall 150 may be fabricated from suitable plastic, which may include acrylonitrile butadiene styrene (ABS) plastic.

The term "ultra efficient insulation material," as used herein, may include one or more type of insulation material with extremely low heat conductance and extremely low heat radiation transfer between the surfaces of the insulation material. The ultra efficient insulation material may include, for example, one or more layers of thermally reflective film, high vacuum, aerogel, low thermal conductivity bead-like units, disordered layered crystals, low density solids, or low density foam. In some embodiments, the ultra efficient insulation material includes one or more low density solids such as aerogels, such as those described in, for example: Fricke and Emmerling, Aerogels—preparation, properties, applications, Structure and Bonding 77: 37-87 (1992); and Pekala, Organic aerogels from the polycondensation of resorcinol with formaldehyde, Journal of Materials Science 24: 3221-3227 (1989), each of which is incorporated herein by reference. As used herein, "low density" may include materials with density from about 0.01 g/cm$^3$ to about 0.10 g/cm$^3$, and materials with density from about 0.005 g/cm$^3$ to about 0.05 g/cm$^3$. In some embodiments, the ultra efficient insulation material includes one or more layers of disordered layered crystals, such as those described in, for example: Chiritescu et al., Ultralow thermal conductivity in disordered, layered $WSe_2$ crystals, Science 315: 351-353 (2007), which is herein incorporated by reference. In some embodiments, the ultra efficient insulation material includes at least two layers of thermal reflective film separated, for example, by at least one of: high vacuum, low thermal conductivity spacer units, low thermal conductivity bead like units, or low density foam. In some embodiments, the ultra efficient insulation material may include at least two layers of thermal reflective material and at least one spacer unit between the layers of thermal reflective material. For example, the ultra-efficient insulation material may include at least one multiple layer insulating composite such as described in U.S. Pat. No. 6,485,805 to Smith et al., titled "Multilayer insulation composite," which is herein incorporated by reference. See also "Thermal Performance of Multilayer Insulations—Final Report," Prepared for NASA 5 Apr. 1974, which is incorporated herein by reference. See also: Hedayat, et al., "Variable Density Multilayer Insulation for Cryogenic Storage," (2000); "High-Performance Thermal Protection Systems Final Report," Vol II, Lockheed Missiles and Space Company, Dec. 31, 1969; and "Liquid Propellant Losses During Space Flight," NASA report No. 65008-00-04 October 1964, which are herein incorporated by reference. For example, the ultra-efficient insulation material may include at least one metallic sheet insulation system, such as that described in U.S. Pat. No. 5,915,283 to Reed et al., titled "Metallic sheet insulation system," which is incorporated herein by reference. For example, the ultra-efficient insulation material may include at least one thermal insulation system, such as that described in U.S. Pat. No. 6,967,051 to Augustynowicz et al., titled "Thermal insulation systems," which is incorporated herein by reference. For example, the ultra-efficient insulation material may include at least one rigid multilayer material for thermal insulation, such as that described in U.S. Pat. No. 7,001,656 to Maignan et al., titled "Rigid multilayer material for thermal insulation," which is herein incorporated by reference. See also Moshfegh, "A new thermal insulation system for vaccine distribution," Journal of Building Physics 15:226-247 (1992), which is incorporated herein by reference.

In some embodiments, an ultra efficient insulation material includes at least one material described above and at least one superinsulation material. As used herein, a "superinsulation material" may include structures wherein at least two floating thermal radiation shields exist in an evacuated double-wall annulus, closely spaced but thermally separated by at least one poor-conducting fiber-like material.

In some embodiments, one or more sections of the ultra efficient insulation material includes at least two layers of thermal reflective material separated from each other by magnetic suspension. The layers of thermal reflective material may be separated, for example, by magnetic suspension methods including magnetic induction suspension or ferromagnetic suspension. For more information regarding magnetic suspension systems, see Thompson, Eddy current magnetic levitation models and experiments, IEEE Potentials, February/March 2000, 40-44, and Post, Maglev: a new approach, Scientific American, January 2000, 82-87, which are each incorporated herein by reference. Ferromagnetic suspension may include, for example, the use of magnets with a Halbach field distribution. For more information regarding Halbach machine topologies and related applications, see Zhu and Howe, Halbach permanent magnet machines and applications: a review, IEE Proc.-Electr. Power Appl. 148: 299-308 (2001), which is herein incorporated by reference.

In some embodiments, an ultra efficient insulation material may include at least one multilayer insulation material. For example, an ultra efficient insulation material may include multilayer insulation material such as that used in space program launch vehicles, including by NASA. See, e.g., Daryabeigi, Thermal analysis and design optimization of multilayer insulation for reentry aerodynamic heating, Journal of Spacecraft and Rockets 39: 509-514 (2002), which is herein incorporated by reference. Some embodiments may include one or more sections of ultra efficient insulation material comprising at least one layer of thermal reflective material and at least one spacer unit adjacent to the at least one layer of thermal reflective material. In some embodiments, one or more sections of ultra efficient insulation material may include at least one layer of thermal reflective material and at least one spacer unit adjacent to the at least one layer of thermal reflective material. The low thermal conductivity spacer units may include, for example, low thermal conductivity bead-like structures, aerogel particles, folds or inserts of thermal reflective film. There may be one layer of thermal reflective film or more than two layers of thermal reflective film. Similarly, there may be greater or fewer numbers of low thermal conductivity spacer units depending on the embodiment. In some embodiments there may be one or more additional layers within or in addition to the ultra efficient insulation material, such as, for example, an outer structural layer or an inner structural layer. An inner or an outer structural layer may be made of any material appropriate to the embodiment, for example an inner or an outer structural layer may include: plastic, metal, alloy, composite, or glass. In some embodiments, there may be one or more regions of high vacuum between layers of thermal reflective film and/or surrounding layers of thermal reflective film. Such regions of high vacuum may include substantially evacuated space. In some embodiments, the ultra efficient insulation material includes a plurality of layers of multilayer insulation, and substantially evacuated space surrounding the plurality of layers of multilayer insulation. For example, substantially evacuated space may have pressure less than or equal to $5\times10^{-4}$ torr.

The substantially thermally sealed storage container 100 includes an inner assembly, which includes one or more heat sink units within the substantially thermally sealed storage region 220, and at least one stored material dispenser unit. The inner assembly includes at least one stored material dispenser unit, which includes one or more interlocks.

The heat sink units are thermally connected to the substantially thermally sealed storage region 220, such as by having exposed surfaces within the substantially thermally sealed storage region 220. Such exposed surfaces serve as thermal conductors between the substantially thermally sealed storage region 220 and the heat sink units. The one or more heat sink units include one or more heat sink material, such as dry ice, wet ice, liquid nitrogen, or other heat sink material. The term "heat sink unit," as used herein, includes one or more units that absorb thermal energy. See, for example, U.S. Pat. No. 5,390,734 to Voorhes et al., titled "Heat Sink," U.S. Pat. No. 4,057,101 to Ruka et al., titled "Heat Sink," U.S. Pat. No. 4,003,426 to Best et al., titled "Heat or Thermal Energy Storage Structure," and U.S. Pat. No. 4,976,308 to Faghri titled "Thermal Energy Storage Heat Exchanger," which are each incorporated herein by reference. Heat sink units may include, for example: units containing frozen water or other types of ice; units including frozen material that is generally gaseous at ambient temperature and pressure, such as frozen carbon dioxide ($CO_2$); units including liquid material that is generally gaseous at ambient temperature and pressure, such as liquid nitrogen; units including artificial gels or composites with heat sink properties; units including phase change materials; and units including refrigerants. See, for example: U.S. Pat. No. 5,261,241 to Kitahara et al., titled "Refrigerant," U.S. Pat. No. 4,810,403 to Bivens et al., titled "Halocarbon Blends for Refrigerant Use," U.S. Pat. No. 4,428,854 to Enjo et al., titled "Absorption Refrigerant Compositions for Use in Absorption Refrigeration Systems," and U.S. Pat. No. 4,482,465 to Gray, titled "Hydrocarbon-Halocarbon Refrigerant Blends," which are each herein incorporated by reference. In some embodiments, the heat sink units include water ice, or a mixture of water and ice. In some embodiments, the heat sink units may include purified water, such as deionized or degassed water, or ice made from purified water.

FIG. 2 illustrates a seal 270 at the end of the conduit 130. Depending on the embodiment, the seal 270 may be configured to retain material within the gap 210 and/or to retain the gap alignment and position between the outer wall 150 and the inner wall 200 and/or assist in maintaining structural integrity. In some embodiments, the seal 270 may be configured to maintain a pressure in the gap 210, such as a pressure that is higher or lower than the atmospheric pressure surrounding the container 100. In some embodiments, the seal 270 may be configured to maintain a pressure in the gap 210 less than or equal to $5\times10^{-4}$ torr. In some embodiments, there may be an outer junction 250 between the conduit 130 and the outer wall 150. Depending on the embodiment, the outer junction 250 may be configured to retain material within the gap 210 and/or to seal the region between the outer wall 150 and the conduit 130. In some embodiments, there may be an inner junction 260 between the conduit 130 and the inner wall 200.

Figure 3:
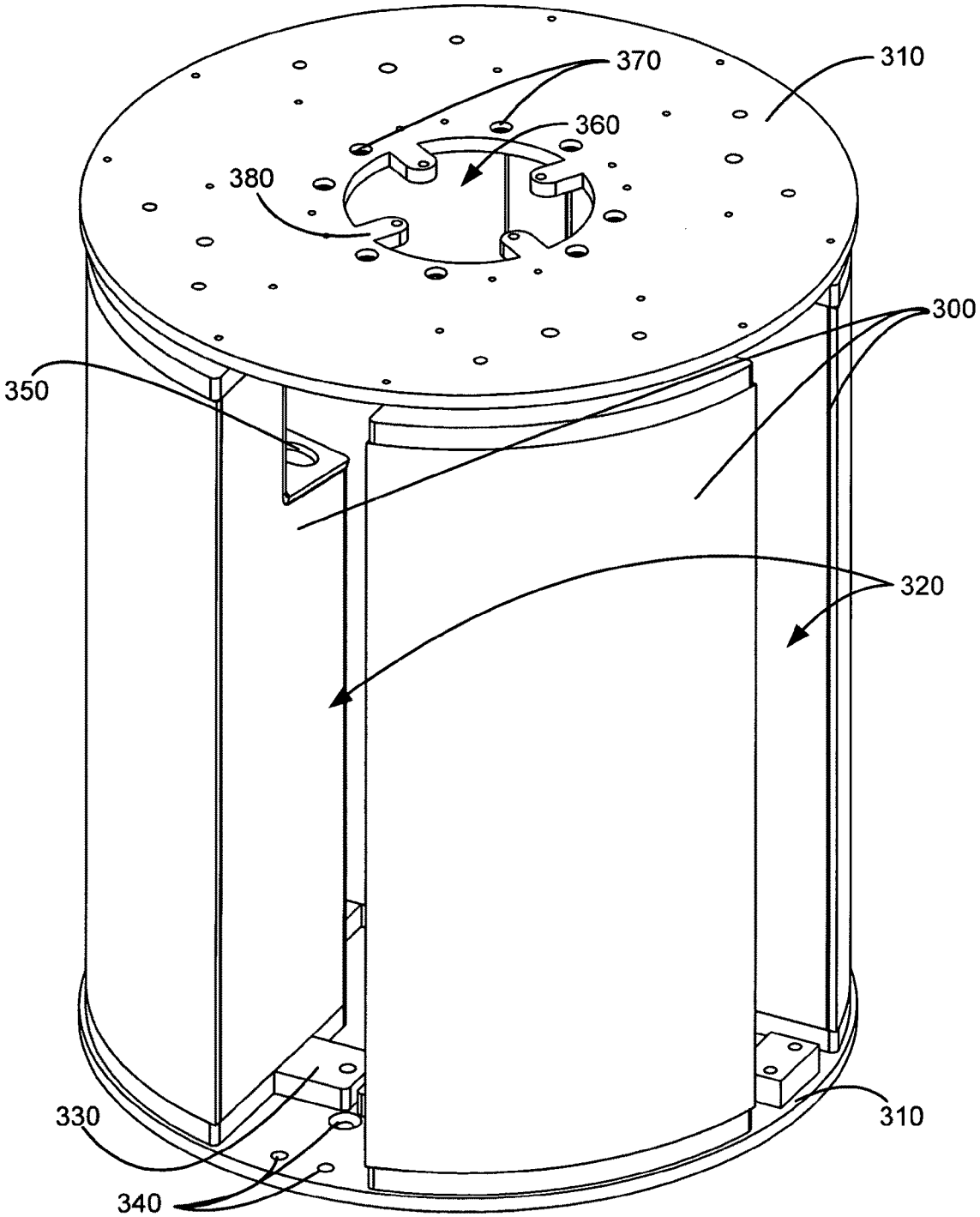
FIG. 3 is a schematic illustrating some aspects of an inner assembly of a substantially thermally sealed storage container.

FIG. 3 illustrates some aspects of some embodiments of a substantially thermally sealed storage region 200. A substantially thermally sealed storage container 100 may include one or more storage region alignment unit 310 within the substantially thermally sealed storage region 200. A substantially thermally sealed storage region 200 may include one or more storage region alignment unit 310. A storage region alignment unit 310, as used herein, is a unit configured to maintain the positioning of items within the storage region 200. For example, two storage region alignment units 310 are depicted in FIG. 3, each configured to be positioned at one end of a cylindrical-shaped storage region 200 such as the one depicted in FIG. 2. For example, a substantially thermally sealed storage container 100 may include at least two storage region alignment units 310 on opposing ends of the storage region 200, the at least two storage region alignment units 310 aligned with the single access aperture 280. The storage region alignment units 310 may be operably attached to the interior surface of the substantially thermally sealed storage region 200 by any means appropriate to the embodiment. The storage region alignment units 310 may be operably attached to the interior surface of the substantially thermally sealed storage region 200 by any means appropriate to the size, shape, mass, composition, or intended use of the container 100. For example, the storage region alignment units 310 may be operably attached to the interior surface of the substantially thermally sealed storage region 200 by fasteners such as pins or screws. For example, the storage region alignment units 310 may be operably attached to the interior surface of the substantially thermally sealed storage region 200 by glue or adhesive. For example, the storage region alignment units 310 may be operably attached to the interior surface of the substantially thermally sealed storage region 200 by magnetic force. The storage region attachment units 310 may be fabricated from a variety of materials appropriate to the size, shape, mass, composition, or intended use of the container 100. One or more storage region attachment units 310 may be fabricated from aluminum. One or more storage region attachment units 310 may be fabricated from stainless steel. In some embodiments, it may be desirable to fabricate one or more storage region attachment units 310 from a thermally conductive material, such as aluminum, to encourage thermal transfer with the substantially thermally sealed storage region 200. In some embodiments, it may be desirable to fabricate one or more storage region attachment units 310 from a thermally conductive material, such as fiberglass, to discourage thermal transfer with the substantially thermally sealed storage region 200. The storage region alignment units 310 may include one or more holes 370, 340 positioned to facilitate attachment of items relative to the storage region alignment units 310 within the substantially thermally sealed storage region 200. The storage region alignment units 310 may include one or more indentations. The storage region alignment units 310 may include one or more indentations in the surface of the storage region alignment units 310, the one or more indentations configured to mate with a surface of a component of the inner assembly. For example, one or more indentations may be configured to mate with a stored material dispenser unit 400, or a stored material egress unit, or a stored material retention unit. The storage region alignment units 310 may include one or more projections from one or more of the at least one storage region alignment units 310. The storage region alignment units 310 may include one or more projections from the surface of the storage region alignment units 310, the one or more projections configured to mate with a surface of a component of the inner assembly. For example, one or more projections may be configured to mate with a stored material dispenser unit 400, or a stored material egress unit, or a stored material retention unit. The storage region alignment units 310 may include one or more projections 330, 380 to facilitate attachment of items relative to the storage region alignment units 310 within the substantially thermally sealed storage region 200. The storage region alignment units 310 may include an aperture 360 configured to align with some part or portion of the container 100. For example, the storage region alignment units 310 include an aperture 360 configured to align with the conduit 130 or the inner wall aperture 280.

In some embodiments, there are a plurality of heat sink units 300 distributed within the substantially thermally sealed storage region 200, wherein the plurality of heat sink units 300 are configured to form material storage regions 320 between the heat sink units 300. For example, FIG. 3 depicts multiple heat sink units 300 distributed to form material storage regions 320 between the heat sink units 300. in some embodiments, the heat sink units 300 may be removable, rechargeable and/or disposable. In some embodiments, there may be at least one structural element configured to define one or more heat sink units 300 within the substantially thermally sealed storage region 200. For example, one or more heat sink units 300 may be fabricated from aluminum. For example, one or more heat sink units 300 may be fabricated from ABS plastic. For example, one or more heat sink units 300 may be fabricated from stainless steel. For example, one or more heat sink units 300 may be fabricated from a material with a thermal conduction value between approximately 120 and approximately 180 Watt per Kelvin-meter (W/mK). In some embodiments, one or more heat sink units 300 may include at least one structural element, wherein the at least one structural element is configured to define at least one heat sink region and there is heat sink material within the at least one heat sink region. In some embodiments, one or more heat sink units 300 may include at least one structural element, wherein the at least one structural element is configured to define at least one watertight region and there is water within the at least one watertight region. In some embodiments, one or more heat sink units 300 may include one or more sealable region 350 configured to allow retention of a heat sink material within the heat sink unit 300.

Figure 4:
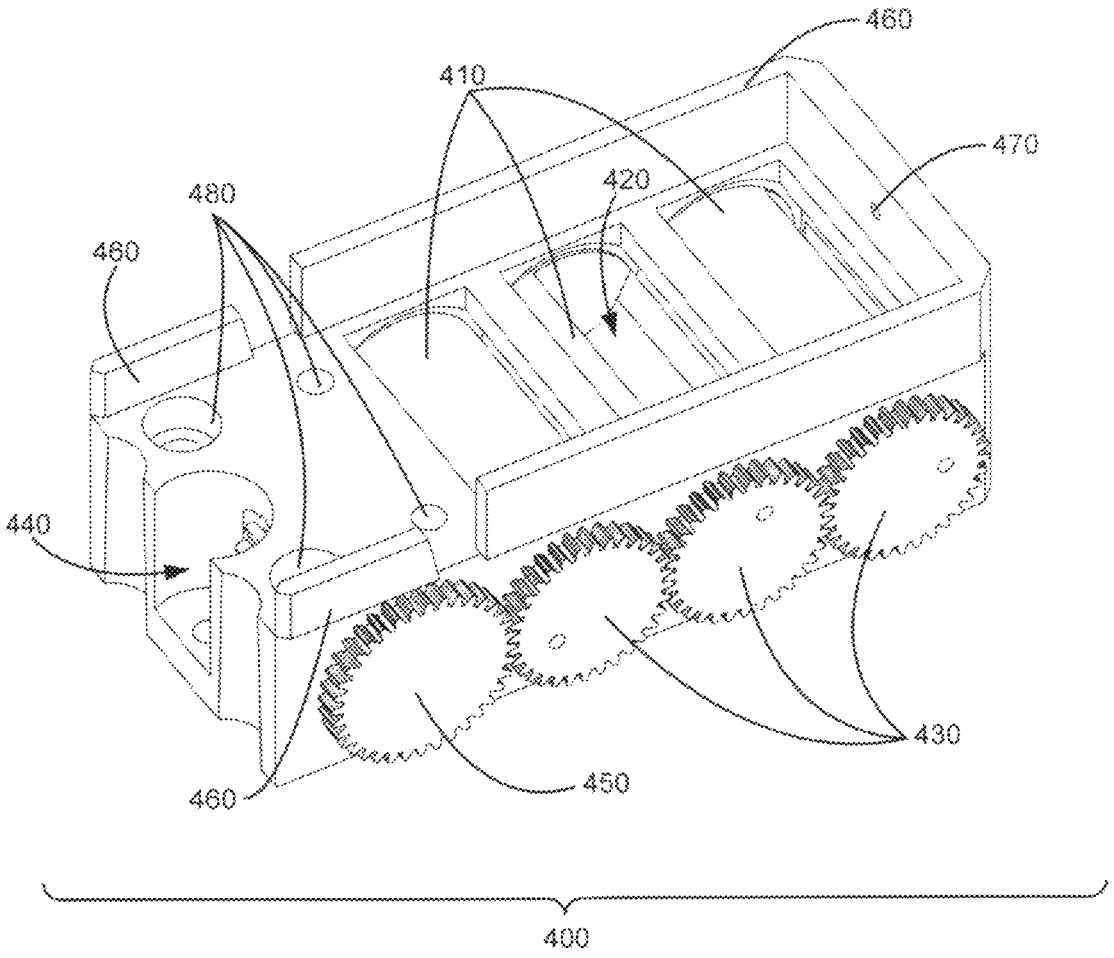
FIG. 4 is a schematic depicting some aspects of a stored material dispenser unit.

FIG. 4 depicts aspects of a stored material dispenser unit 400. In some embodiments, a stored material dispenser unit 400 is configured to provide controllable egress of a stored material. In some embodiments, a stored material dispenser unit 400 includes at least one substantially cylindrical unit defining an opening configured to receive stored material, wherein the at least one substantially cylindrical unit is configured to rotate around its longitudinal axis. In some embodiments, a stored material dispenser unit 400 includes a plurality of substantially cylindrical units defining an opening configured to receive stored material, wherein at least two of the plurality of substantially cylindrical units are configured to rotate around their longitudinal axes at a distinct angle from another substantially cylindrical unit. In some embodiments, a stored material dispenser unit 400 includes at least one substantially cylindrical unit configured to hold stored biological material. For example, the at least one substantially cylindrical unit may be of an appropriate size shape, and material fabrication to hold stored biological material. In many instances, stored biological material requires particular thermal and physical handling to ensure potency of the stored biological material. For example, see Lockman et al., "Stability of Didanosine and Stavudine pediatric oral solutions and Kaletra capsules at temperatures from 4° C. to 55° C.," Conf. Retrovir Opporunistic Infect 2005 Feb. 22-25: 12: Abstract No. 668, which is herein incorporated by reference. Similarly, a substantial number of biological drugs require maintenance within a predetermined temperature range to ensure their activity. See, for example, Ette, "Conscience, the Law, and Donation of Expired Drugs," Ann Pharmacother 38: 1310-1313, (2004), which is herein incorporated by reference. In some embodiments, a stored material dispenser unit 400 includes at least one substantially cylindrical unit configured to hold stored vaccine vials. For example, the at least one substantially cylindrical unit may be of an appropriate size shape, and material fabrication to hold stored vaccine vials. In many instances, vaccine vials require particular thermal and physical handling to ensure potency of the stored vaccines. See "Vaccine Management: Recommendations for Storage and Handling of Selected Biologicals," Department of Health and Human Services and CDC, January 2007, which is incorporated herein by reference. See Pickering et al., "Too hot, too cold: issues with vaccine storage," Pediatrics 118(4): 1738-1739 (2006), which is herein incorporated by reference. See Seto and Marra, "Cold Chain Management of Vaccines," UBC Continuing Pharmacy Professional Development Home Study Program, February 2005, which is herein incorporated by reference. In many instances, vaccine vials are distributed in cylindrical vials. See, for example, the depiction of various vaccine vial types in "Getting Started with Vaccine Vial Monitors," World Health Organization, 2002, which is herein incorporated by reference.

In some embodiments, such as depicted in FIG. 4, stored material dispenser unit 400 includes one or more interlocks, wherein the one or more interlocks are configured to provide controllable egress of a quantity of a stored material. In some embodiments, a stored material dispenser unit 400 includes one or more interlocks, wherein the one or more interlocks are configured to provide controllable egress of a quantity of stored material units. In some embodiments, a stored material dispenser unit 400 includes one or more interlocks, wherein the one or more interlocks include at least one controllable egress opening. In some embodiments, a stored material dispenser unit 400 includes one or more interlocks, wherein the one or more interlocks include at least one substantially cylindrical unit defining an opening configured to receive stored material, wherein the substantially cylindrical unit is configured to rotate around its longitudinal axis. In some embodiments, the one or more interlocks include a plurality of substantially cylindrical units, wherein the substantially cylindrical units are configured to rotate around their longitudinal axes. In some embodiments, the at least one substantially cylindrical unit is configured to hold stored biological material. In some embodiments, the at least one substantially cylindrical unit is configured to hold stored vaccine vials. In some embodiments, a stored material dispenser unit 400 includes one or more interlocks, wherein the one or more interlocks include at least one interlock mechanism and a control interface 440 configured to operate the interlock mechanism. In some embodiments, at least one interlock mechanism includes at least one storage unit exchange unit 410 and at least one control mechanism 430 operably attached to the at least one storage unit exchange unit 410 and to the control interface 440. In some embodiments, at least one interlock mechanism includes at least one storage unit exchange unit 410, wherein the storage unit exchange unit 410 is of a size and shape to contain a single stored material, and a gear mechanism operably attached to the to the storage unit exchange unit 410, wherein the gear mechanism is configured to transmit torque from the control interface 440. In some embodiments, at least one interlock mechanism includes at least one storage unit exchange unit 410, wherein the storage unit exchange unit 410 is of a size and shape to contain a single stored material, and a gear mechanism operably attached to the to the storage unit exchange unit 410, wherein the gear mechanism is configured to transmit torque from a dispenser unit operator unit 140 through a gear mechanism in the control interface 440.

In some embodiments, such as depicted in FIG. 4, a stored material dispenser unit 400 includes an interlock mechanism configured to control egress of a stored material, and a control interface 440 configured to operate the interlock mechanism. In some embodiments, a stored material dispenser unit 400 includes a plurality of interlocks within the dispenser unit 400, wherein the plurality of interlocks are operably connected. In some embodiments, the interlock mechanism includes at least one storage unit exchange unit 410 and at least one control mechanism 430 operably attached to the at least one storage unit exchange unit 410. For example, depending on the embodiment, the interlock mechanism may include gear mechanisms, sprocket mechanisms, and/or belt and pulley mechanisms. The interlock mechanism may include electrically-operated or mechanically-operated mechanism. The interlock mechanism should include a mechanism that transmits a minimally acceptable level of thermal energy for the particular embodiment into the storage region 200. In many embodiments, a minimally acceptable level of thermal energy to be transmitted by the interlock mechanism into the storage region 200 is a minimal level of thermal energy. That is, a mechanism that generates a minimal amount of heat during its operation is embodied. Therefore, in many embodiments, a mechanically-operated mechanism is preferable to one that utilizes an electric motor. In some embodiments, the interlock mechanism includes at least one storage unit exchange unit 410, wherein the storage unit exchange unit is of a size and shape to contain a single stored material unit, and a gear mechanism operably attached to the storage unit exchange unit 410, wherein the gear mechanism is configured to transmit torque from the control mechanism. For example, FIG. 4 depicts storage unit exchange units 410, including an interior niche 420 of a size and shape to contain a single stored material unit. In some embodiments, the interlock mechanism includes at least one storage unit exchange unit 410, wherein the storage unit exchange unit is of a size and shape to contain a single stored material unit, and a gear mechanism operably attached to the storage unit exchange unit 410, wherein the gear mechanism is configured to transmit torque from a dispenser unit operator unit 140 through a gear mechanism in the control mechanism. For example, FIG. 4 depicts a gear within the control interface 440, wherein the gear is configured to mate with and transmit torque from a dispenser unit operator unit 140, and therefore transmit torque through an interacting gear 450 to the control mechanism 430. In some embodiments, the stored material dispenser unit 400 includes at least one storage unit exchange unit 410, wherein the storage unit exchange unit 410 is of a size and shape to contain a single stored material, at least one gear mechanism operably attached to each of the at least one storage unit exchange unit 410, and a control mechanism 430 wherein the control mechanism 430 includes a gear mechanism configured to transmit torque to the at least one gear mechanism operably attached to each of the at least one storage unit exchange unit 410, and at least one gear mechanism configured to transmit toque from a dispenser unit operating unit 140.

In some embodiments, a stored material dispenser unit 400 includes at least one storage unit exchange unit 410, wherein the at least one storage unit exchange unit 410 is of a size and shape to contain a single stored unit, at least one gear mechanism operably attached to the at least one storage unit exchange unit 410, and a control mechanism 430, wherein the control mechanism 430 includes a gear mechanism operably attached to the at least one storage unit exchange unit 410.

In some embodiments, the stored material dispenser unit 400 may include at least one surface configured to reversibly attach to a surface of a stored material egress unit. In some embodiments, the stored material dispenser unit 400 may include at least one surface configured to reversibly attach to a stored material egress unit. In some embodiments, the stored material dispenser unit 400 may include at least one surface configured to reversibly attach to a surface of a stored material holding unit and at least one surface configured to reversibly attach to a surface of a stored material stabilizer unit. In some embodiments, the stored material dispenser unit 400 may include at least one surface configured to reversibly attach to a stored material holding unit and at least one surface configured to reversibly attach to a stored material stabilizer unit. For example, a stored material dispenser unit 400 may include one or more attachment regions 480 configured to engage one or more fasteners between a stored material dispenser unit 400 and another unit. In some embodiments, the stored material dispenser unit 400 may include projections 460 configured to align and maintain the position of the stored material dispenser unit 400 and another unit. In some embodiments, the stored material dispenser unit 400 may include one or more holes or indentations 470 configured to mate with a hooked rod during the positioning of the stored material dispenser unit 400 within the storage region 200.

Figure 5:
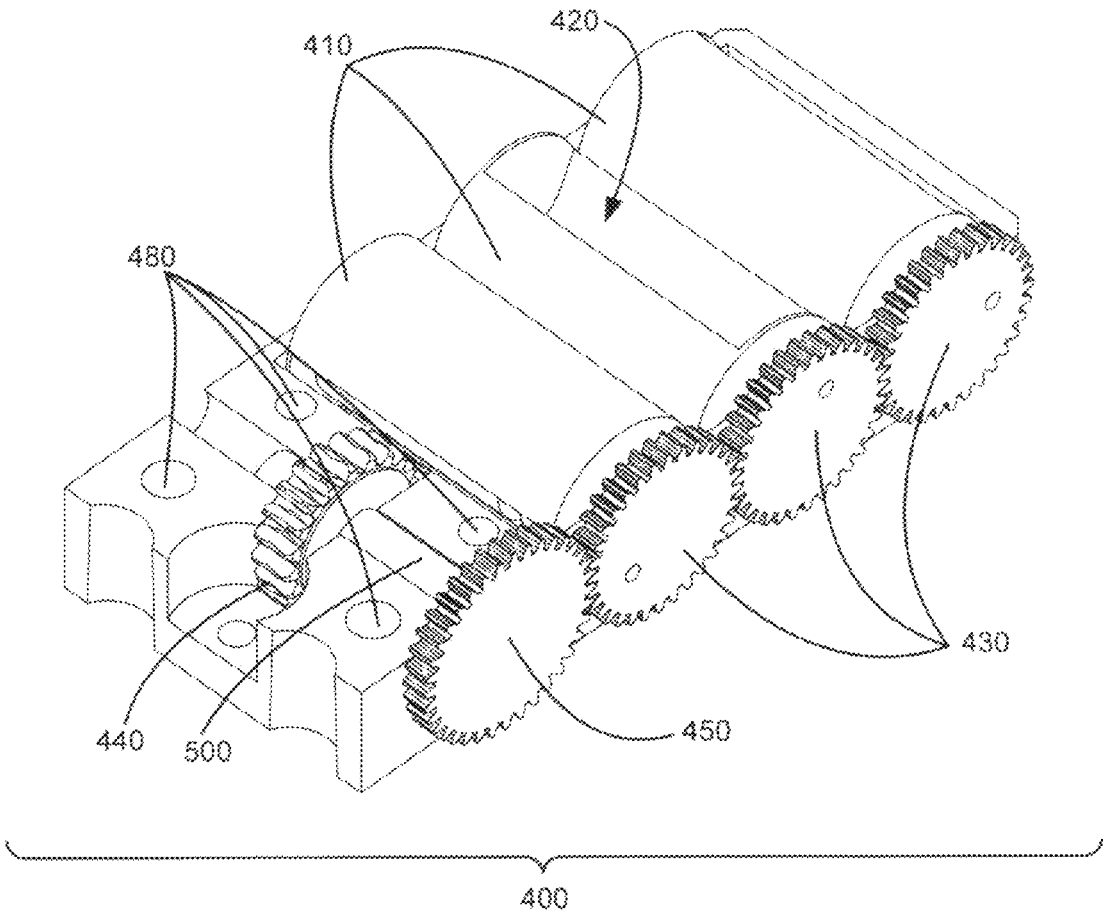
FIG. 5 is a schematic showing some aspects of the interior of a stored material dispenser unit.

FIG. 5 depicts an internal view of a stored material dispenser unit 400. As illustrated in FIG. 5, a stored material dispenser unit 400 may include at least one storage unit exchange unit 410. FIG. 3 depicts a plurality of storage unit exchange units 410 aligned with the longitudinal axis of the stored material dispenser unit 400. The storage unit exchange units 410 include an interior niche 420 of a size and shape to contain a single stored material unit. A control interface 440 is configured to transmit torque from the control interface 440 to the control mechanism 430 through a driveshaft 500 connected to an interacting gear 450. Multiple attachment regions 480 are illustrated. The attachment regions 480 may, for example, be of a size and shape to enable a screw-type fastener to operably attach the stored material dispenser unit 400 with another unit.

Figure 6:
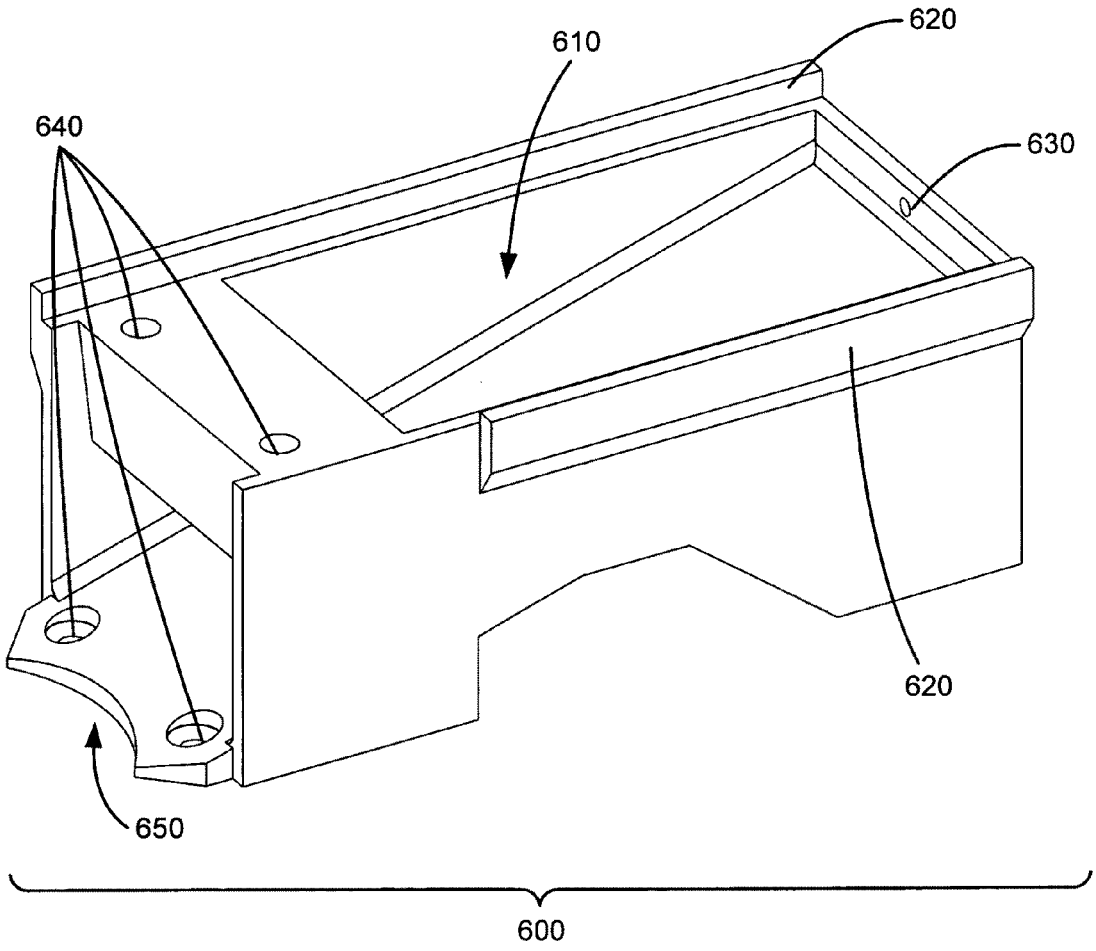
FIG. 6 is a schematic illustrating some aspects of a stored material egress unit.

FIG. 6 shows a top and side level view of an egress unit 600. An egress unit is configured to direct the position of a stored unit after egress from a stored material dispenser unit 400. For example, the egress unit depicted as 600 is designed to be positioned to direct a stored unit from a stored material dispenser unit 400 to a stored material removal unit. An egress unit may be included in the inner assembly of a substantially thermally sealed storage container 100, within the storage region 220. A stored material egress unit 600 may be configured to be reversibly attached to a storage region alignment unit 310. For example, the stored material egress unit 600 may include one or more attachment regions 640. A stored material egress unit 600 may be configured to be reversibly attached to a stored material dispenser unit 400. For example, the stored material egress unit 600 may include projections 620 configured to mate with surfaces of a stored material dispenser unit 400 to align the units for reversible attachment. A stored material egress unit 600 may reversibly attached to a stored material dispenser unit 400. A stored material egress unit 600 and a stored material dispenser unit 400 may be positioned to enable stored material to egress from the stored material dispenser unit 400 through the stored material egress unit 600 for removal from a substantially thermally sealed storage container 100. A stored material egress unit 600 may include at least one surface configured to reversibly attach to a storage region alignment unit, at least one surface configured to reversibly attach to a surface of the at least one material dispenser unit, and an egress pathway configured to allow egress of at least one stored material unit. For example, an egress pathway may include an egress ramp 610. A stored material egress unit 600 may include one or more hole or indentation 630 configured to enable positioning of the stored material egress unit 600 within a storage region 220. For example, a stored material egress unit 600 may include one or more hole or indentation 630 configured to enable positioning of the stored material egress unit 600 within a storage region 220 with a hooked rod. The stored material egress unit 600 may include at least one surface 650 configured to reversibly mate with a storage removal unit. The stored material egress unit 600 may include at least one surface configured to reversibly mate with a storage region alignment unit 310. The stored material egress unit 600 may include at least one surface 650 configured to reversibly mate with a stored material removal unit.

Figure 7:
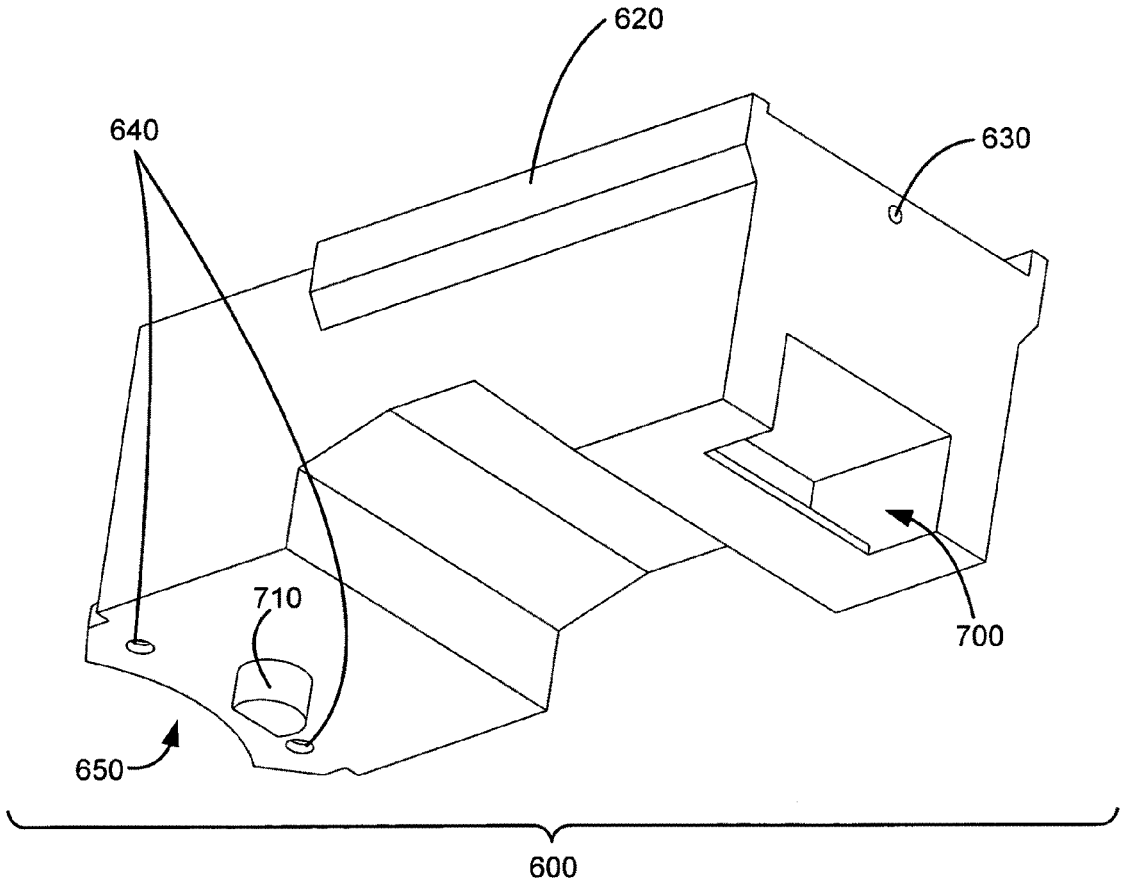
FIG. 7 is a schematic is a schematic depicting some aspects of a stored material egress unit.

FIG. 7 shows a bottom and side level view of an egress unit 600. The egress unit 600 includes projections 620, attachment regions 640, an indentation 630, and a surface 650 configured to reversibly mate with a storage removal unit as depicted in FIG. 6. This view of the egress unit 600 further depicts one or more projections 710 and 700 from the underside of the egress unit 600. Depending on the embodiment, such projections 700, 710 may assist in the reversible attachment of the egress unit 600 with other units, such as a storage region alignment unit 310. Projections 700, 710 may also ensure the alignment of the egress unit 600 with one or more other units within the storage region 220.

Figure 8:
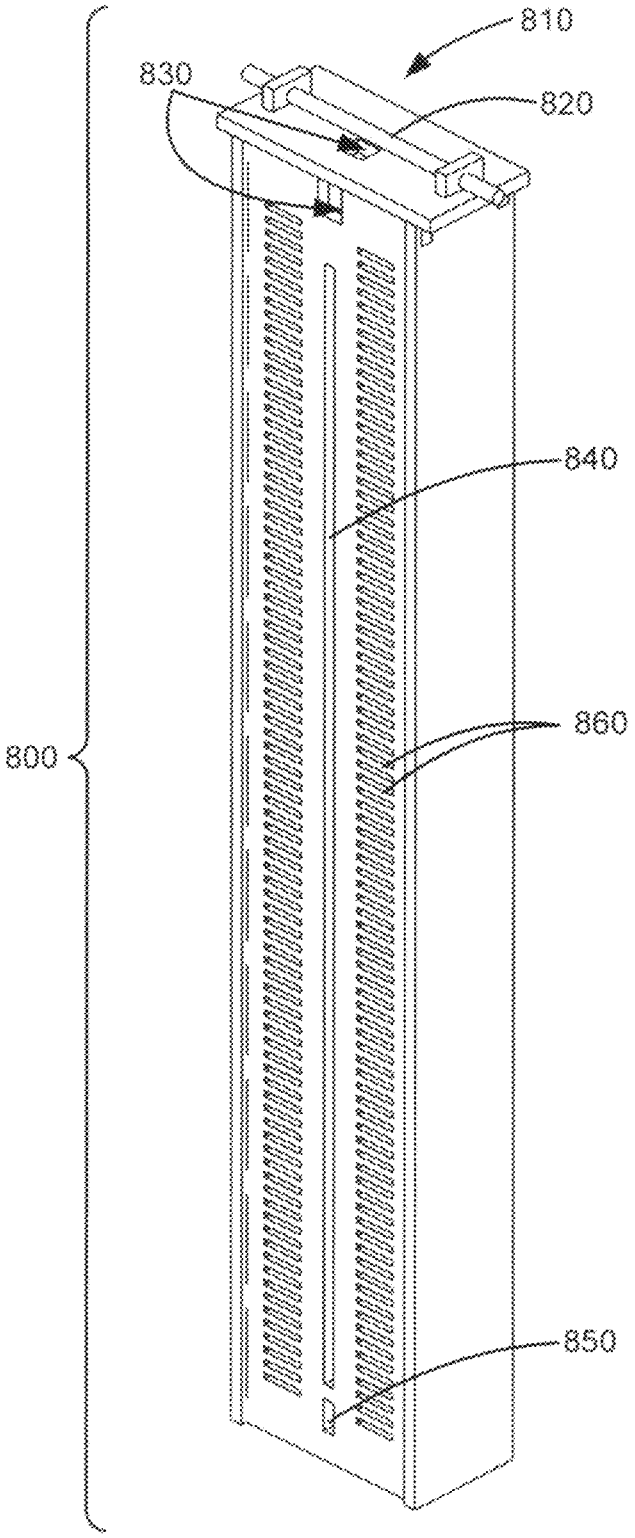
FIG. 8 is a schematic showing some aspects of a stored material retention unit.

FIG. 8 illustrates aspects of a stored material retention unit 800. A stored material retention unit may be positioned within a storage region 220 of a substantially thermally sealed storage container 100. A stored material retention unit may be positioned within a storage region 220 within the inner assembly of a substantially thermally sealed storage container 100. Depending on the embodiment, there may be a single stored material retention unit 800 or a plurality of stored material retention units 800. Depending on the embodiment, a variety of conformations of stored material retention units 800 may be implemented. For example, in some embodiments, a storage region 220 contains twelve stored material retention units 800, arranged in four groups of three stored material retention units 800 each. A stored material retention unit may include stored material. For example, a stored material retention unit may include stored biological material. For example, a stored material retention unit may include stored vaccine vials. A stored material retention unit may include a stored material retention region, a ballast unit, and at least one positioning element configured to retain the ballast unit in alignment with the stored material retention region. FIG. 8 depicts an exterior view of a stored material retention unit 800. FIG. 8 depicts a plurality of apertures 860 in the stored material retention unit 800, the apertures configured for alignment of a ballast unit within the stored material retention region. FIG. 8 depicts a vertical positioning aperture 840 configured for further alignment of a ballast unit within the stored material retention region. FIG. 8 also depicts apertures 830 configured to facilitate positioning of the stored material retention unit 800 within the storage region 220. For example, the apertures 830 may be configured to mate with a hook on the end of a rod, so that the rod is operable for positioning of the stored material retention unit 800 within the storage region 220 followed by removal of the rod. A stored material retention unit 800 may include an aperture 850 configured for the insertion of a tab, rod or pin during positioning of the stored material retention unit 800 within the storage region 220 to ensure stability of stored material within the stored material retention unit 800 during positioning. Such tab, rod or pin may be removable from the aperture 850 to facilitate egress of stored material from the stored material retention unit 800 at a desired time. FIG. 8 depicts a stored material retention unit 800 attachment unit 810 configured to ensure stable positioning of the stored material retention unit 800 within the storage region. For example, a stored material retention unit 800 may be positioned relative to another unit, such as a storage region alignment unit 310. In the embodiment depicted in FIG. 8, the stored material retention unit 800 attachment unit 810 includes a rod 820 configured to reversibly mate with a storage region alignment unit 310. For example, the rod 820 may be configured to mate with projections, hooks, or rails attached to a surface of a storage region alignment unit 310. However, in some embodiments, there may be another conformation of the stored material retention unit 800 attachment unit 810 or no stored material retention unit 800 attachment unit 810.

Figure 9:
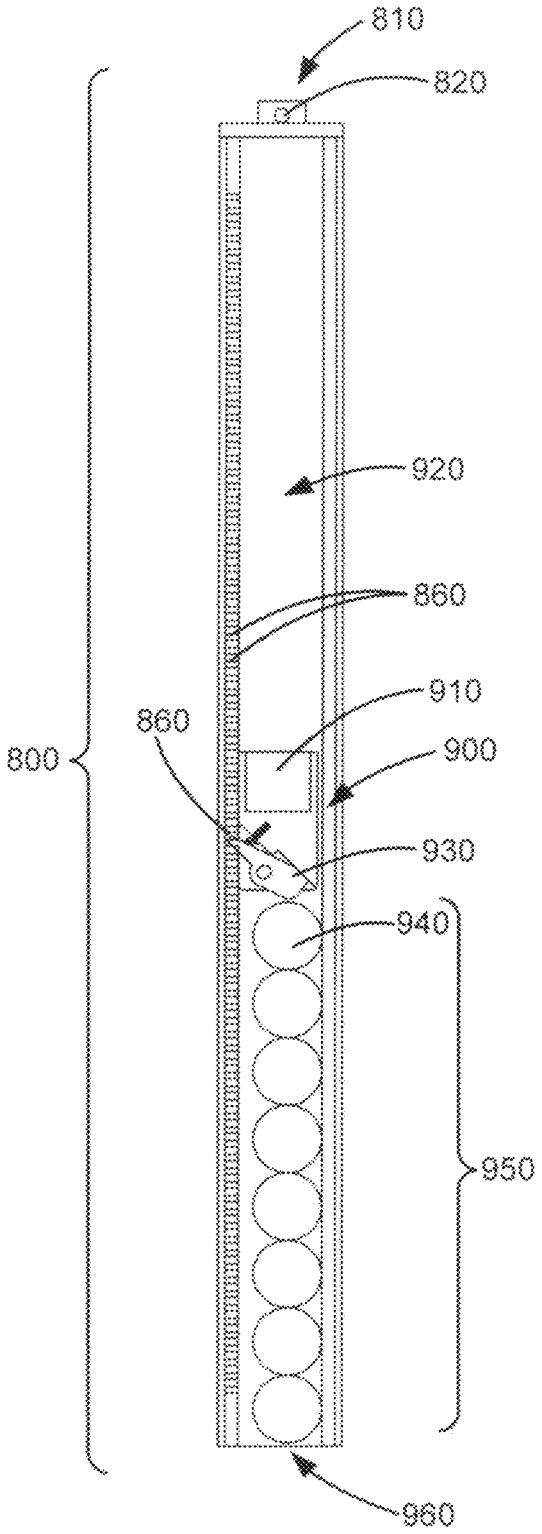
FIG. 9 is a schematic depicting some aspects of the interior of a stored material retention unit.

FIG. 9 illustrates a vertical cross section view of the stored material retention unit 800 depicted in FIG. 8. In the illustrated embodiment, the stored material retention unit 800 includes a stored material retention region 920, wherein the stored material 940 is retained as a vertical column 950. As depicted in FIG. 9, the representative stored material 940 is substantially cylindrically shaped, however other configurations of stored material 940 may be included, depending on the embodiment. FIG. 9 also depicts a ballast unit 900, which is positioned to maintain the stored material 940 as a vertical column with minimal gaps. The ballast unit 900 depicted in FIG. 9 includes a weight 910 and a ratchet mechanism 930, wherein the ratchet mechanism 930 is configured to allow the weight 910 to move unidirectionally along the stored material retention region 920. For example, in the embodiment illustrated in FIG. 9, the ratchet mechanism 930 is configured to allow the weight 910 to move from the upper portion of the stored material retention region 920 to the lower region of the stored material retention region 920 through engagement of the ratchet mechanism 930 with the plurality of apertures 860. Such may ensure movement of stored material 940 along the stored material retention region 920 to an exit region 960. Although not depicted in FIG. 9, in some embodiments there may be one or more positioning elements configured to retain the ballast unit 900 in a vertical alignment with the stored material retention region 920. For example, there may be one or more pins or rods operably attached to the ballast unit 900 and configured to position the ballast unit 900 with the stored material retention region 920, such as along a vertical positioning aperture 840. In some embodiments, one or more positioning elements may include one or more grooves or channels configured to reversibly mate between the surfaces of the stored material retention region 920 and the ballast unit 900. FIG. 9 also illustrates a stored material retention unit 800 attachment unit 810 including a rod 820.

Figure 10:
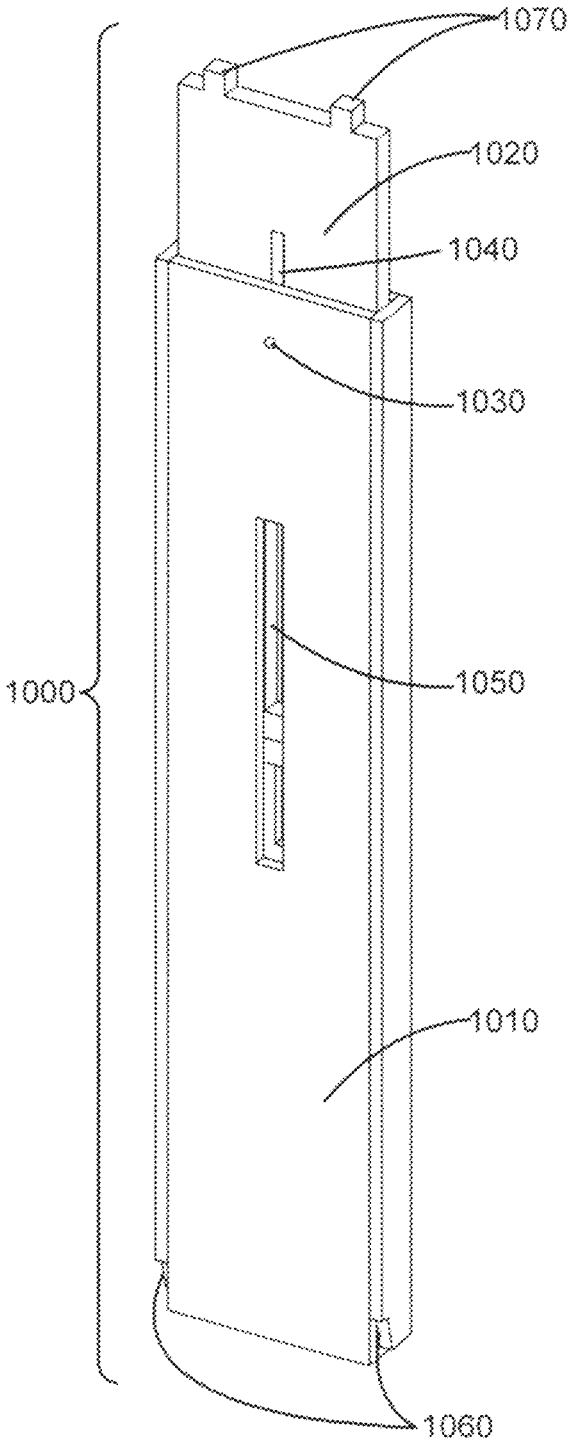
FIG. 10 is a schematic illustrating some aspects of a stored material retention unit stabilizer.

FIG. 10 illustrates aspects of a retention unit stabilizer 1000. In some embodiments, a retention unit stabilizer 1000 may be implemented to provide stability to one or more stored material retention unit 800 within a storage region 220. In some embodiments, a retention unit stabilizer 1000 may be implemented to provide stability to one or more stored material retention unit 800 of an inner assembly within a storage region 220. A retention unit stabilizer 1000, as illustrated in FIG. 10, may include a positioning element 1010. The positioning element 1010 may include one or more surface 1060 configured to reversibly mate with a surface of a stored material dispensing unit 400. As illustrated in FIG. 10, a retention unit stabilizer 1000 may include a holding element 1030 attached to the positioning element 1010. The holding element 1030 may hold the positioning element 1010 in alignment with the securing element 1020. The securing element 1020 may be configured to allow limited movement of the securing element 1020 relative to the holding element 1030. For example, as illustrate in FIG. 10, a retention unit stabilizer 1000 may include a holding element 1030 attached to the positioning element 1010 wherein the holding element 1030 includes a rod configured to slide along a vertical aperture 1040 within the securing element 1020. Such a holding element 1030 maintains the relative horizontal alignment of the positioning element 1010 and the securing element 1020 while allowing vertical mobility between the holding element 1030 and the securing element 1020. The securing element 1020 may include at least one surface configured to reversibly mate with a surface of a storage region alignment unit 310. For example, the securing element 1020 illustrated in FIG. 10 includes projections 1070 configured to reversibly mate with indentations 370 in a storage region alignment unit 310. The positioning element 1010 and/or the securing element 1020 may include at least one additional aperture 1050 as suitable for the embodiment. For example, the addition of apertures may ensure air flow between the elements during relative motion of the elements. The retention unit stabilizer 1000 may include at least one pressure element, wherein the at least one pressure element is configured to reversibly move the securing element relative to the positioning element.

Figure 11:
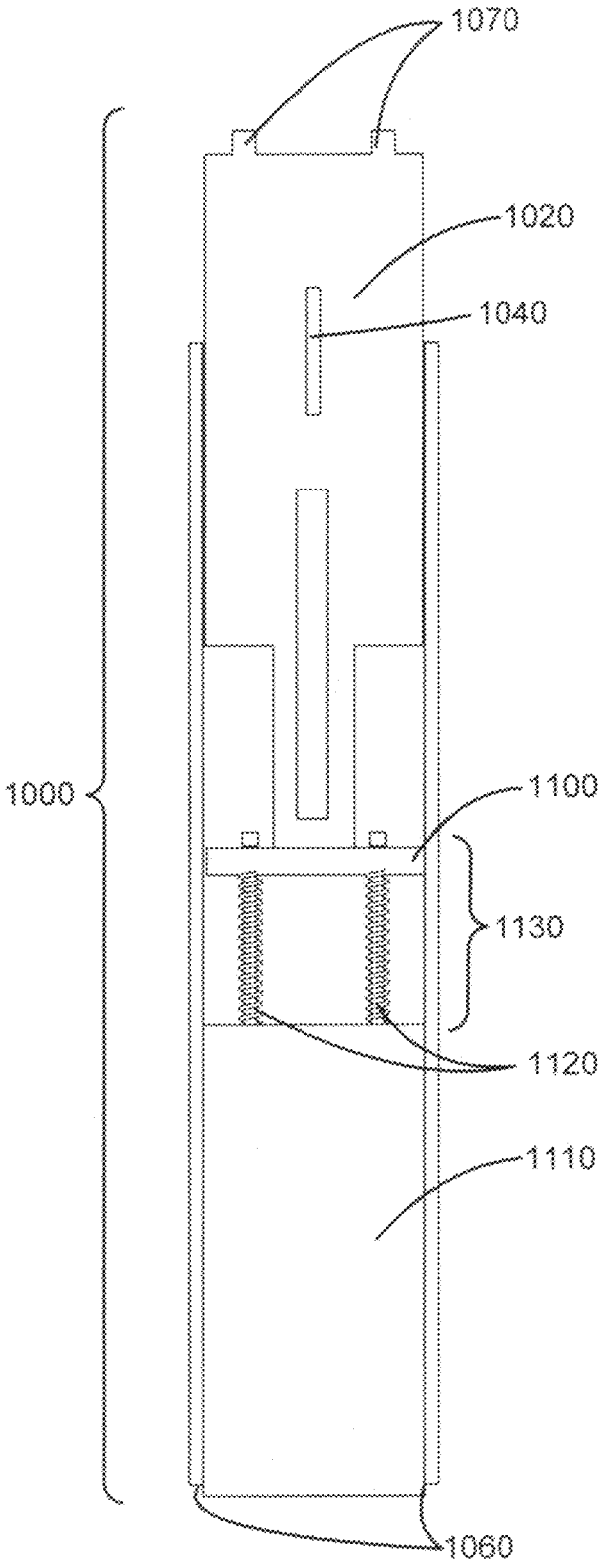
FIG. 11 is a schematic depicting some aspects of the interior of a stored material retention unit stabilizer.

FIG. 11 illustrates a vertical cross-section view of the retention unit stabilizer 1000 as illustrated in FIG. 10. As depicted in FIG. 11, in some embodiments a retention unit stabilizer 1000 includes a securing element 1020, which may include at least one vertical aperture 1040. The retention unit stabilizer 1000 may also include at least one pressure element 1130. A pressure element 1130 may include at least one compression element 1100 operably connected to one or more force elements 1120. For example, as illustrated in FIG. 11, a pressure element 1130 may include a compression element 1100 configured as a horizontal bar, wherein the compression element 1100 is configured to be compressed against the securing element 1020 by a force element 1120 including one or more compression springs. The pressure element 1130 may be operably attached, for example, to a base unit 1110 within the positioning element 1010. FIG. 11 illustrates projections 1070 configured to reversibly mate with indentations 370 in a storage region alignment unit 310. FIG. 11 also illustrates surfaces 1060 configured to reversibly mate with a surface of a stored material egress unit 600.

Figure 12:
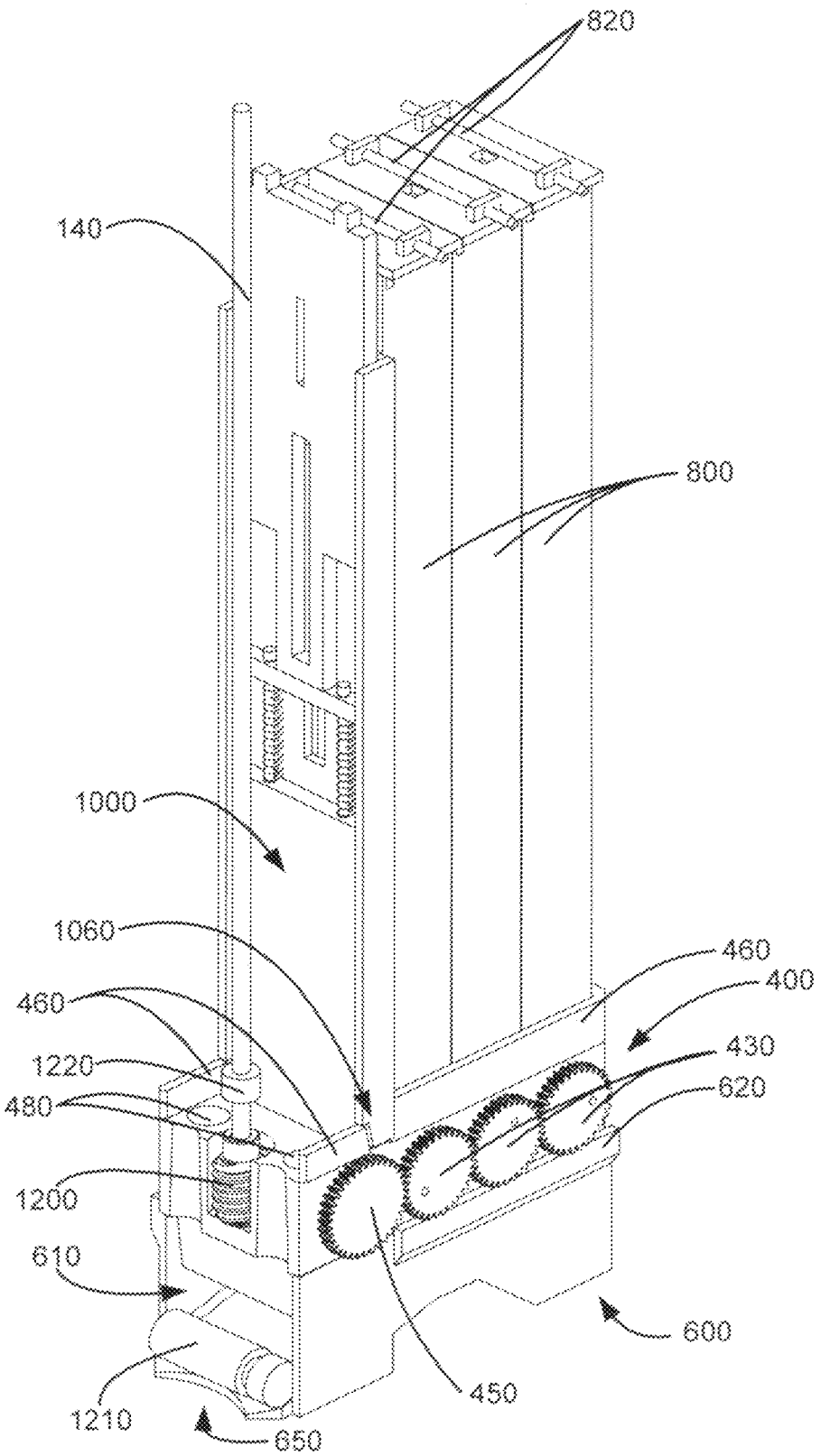
FIG. 12 is a schematic illustrating some aspects of an inner assembly of a substantially thermally sealed storage container.

FIG. 12 illustrates a possible assembly of the units described in FIGS. 1 and 4-11. The entire assembly of units as illustrated in FIG. 12 may be positioned within a storage region in a material storage region 320 such as illustrated in FIG. 3. In the embodiment illustrated in FIG. 12, a plurality of stored material retention units 800 are configured to be arranged in vertical alignment relative to a stored material dispenser unit 400. Each of the of stored material retention units 800 is aligned with the stored material dispenser unit 400 so that the exit region 960 of the stored material retention unit 800 is aligned with the interlock mechanism within the stored material dispenser unit 400. Although the interlock mechanism is not fully displayed in the external view of FIG. 12, the position of the storage unit exchange units 410 may be understood from the position of the control mechanisms 430 relative to FIGS. 4 and 5. Each of the of stored material retention units 800 includes an attachment unit 820, which are similarly aligned. The alignment and relative positioning of the stored material retention units 800 is facilitated by the projections 460 from the stored material dispenser unit 400. The alignment and relative positioning of the stored material retention units 800 is also facilitated by the position of the retention unit stabilizer 1000. The retention unit stabilizer 1000 is illustrated in cross-section in FIG. 12. As illustrated in FIG. 12, the position of the retention unit stabilizer 1000 relative to the stored material dispenser unit 400 is facilitated by the surfaces 1060 of the retention unit stabilizer 1000 configured to reversibly mate with a surface of a stored material dispensing unit 400. As illustrated in FIG. 12, the surfaces 1060 of the retention unit stabilizer 1000 may be configured to reversibly mate with the projections 460 of a stored material dispensing unit 400.

As shown in FIG. 12, a stored material dispenser unit 400 includes an interacting gear 450, configured to transmit torque from a dispenser unit operator unit 140. The dispenser unit operator unit 140 includes an interface element 1200. The interface element 1200 may include a gear configured to reversibly mate with a control interface 440 configured to operate the interlock mechanism. The dispenser unit operator unit 140 may also include one or more projections 1220 configured to reversibly mate with one or more surfaces of another unit. Although not illustrated in FIG. 12, a dispenser unit operator unit 140 may include one or more handles on the end of the dispenser unit operator unit 140 distal to the interface element 1200 (see FIG. 1). A stored material dispenser unit 400 may also include one or more attachment regions 480 configured to engage one or more fasteners between a stored material dispenser unit 400 and another unit, such as an egress unit 600. An egress unit 600 may be operably attached to a stored material dispenser unit 400. The alignment and positioning of a stored material dispenser unit 400 and an egress unit 600 may be facilitated by projections 620 from the egress unit 600. The egress unit illustrated in FIG. 12 is positioned relative to the stored material dispenser unit 400 so that stored material 1210 passing through the interlocks of the stored material dispenser unit 400 will move along the egress ramp 610 through the force of gravity. The egress unit 600 also may include at least one surface 650 configured to reversibly mate with a stored material removal unit.

Figure 13:
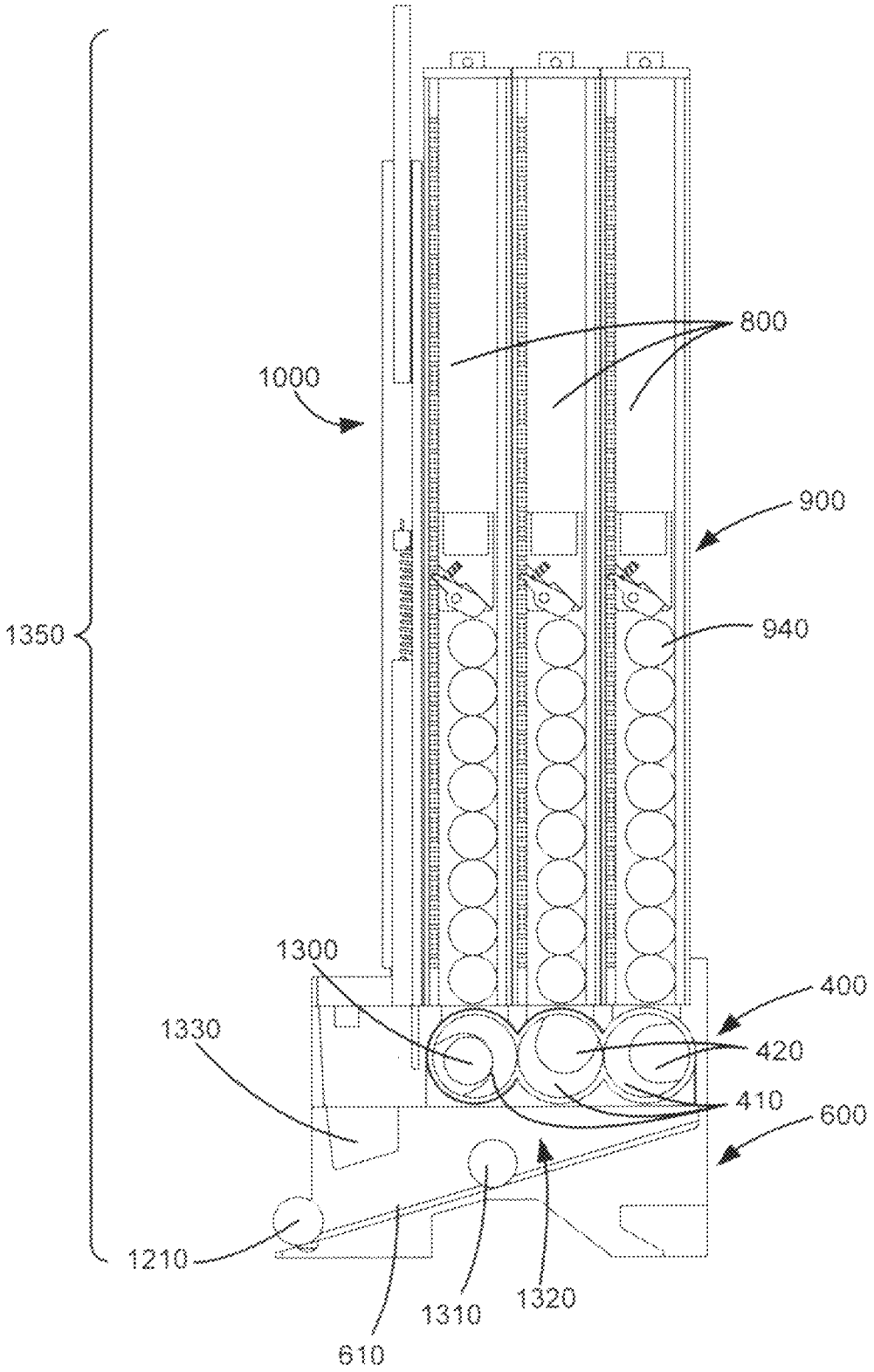
FIG. 13 is a schematic showing some aspects of an inner assembly of a substantially thermally sealed storage container.

FIG. 13 depicts a vertical cross-section view of the assembly of units 1350 illustrated in FIG. 12. Illustrated is a plurality of stored material retention units 800 positioned in horizontal alignment. The stored material retention units 800 include ballast units 900 over the stored material 940. Adjacent to the plurality of stored material retention units 800 is a retention unit stabilizer 1000. Each of the stored material retention units 800 is aligned with one of the storage unit exchange units 410 of the stored material dispenser unit 400. In the illustration of FIG. 13, the right and center of the storage unit exchange units 410 include empty interior niches 420. However, the left storage unit exchange unit 410 is illustrated with a unit of stored material 1300. The egress unit 600 is aligned with the stored material dispenser unit 400 so that the egress ramp 610 of the egress unit 600 is adjacent to the storage unit exchange units 410. The units are positioned to facilitate the movement Of stored material 1310 through the egress region 1320 along the egress ramp 610. For example, in many embodiments the force of gravity may be sufficient to move stored material 1310 through the egress region 1320 along the egress ramp 610. In some embodiments, one or more positioning elements 1330 may be configured to facilitate the relative movement of stored material through the egress region 1320. Such positioning elements 1330 may facilitate the relative position of egress of stored material 1210 from the egress unit 600.

Figure 14:
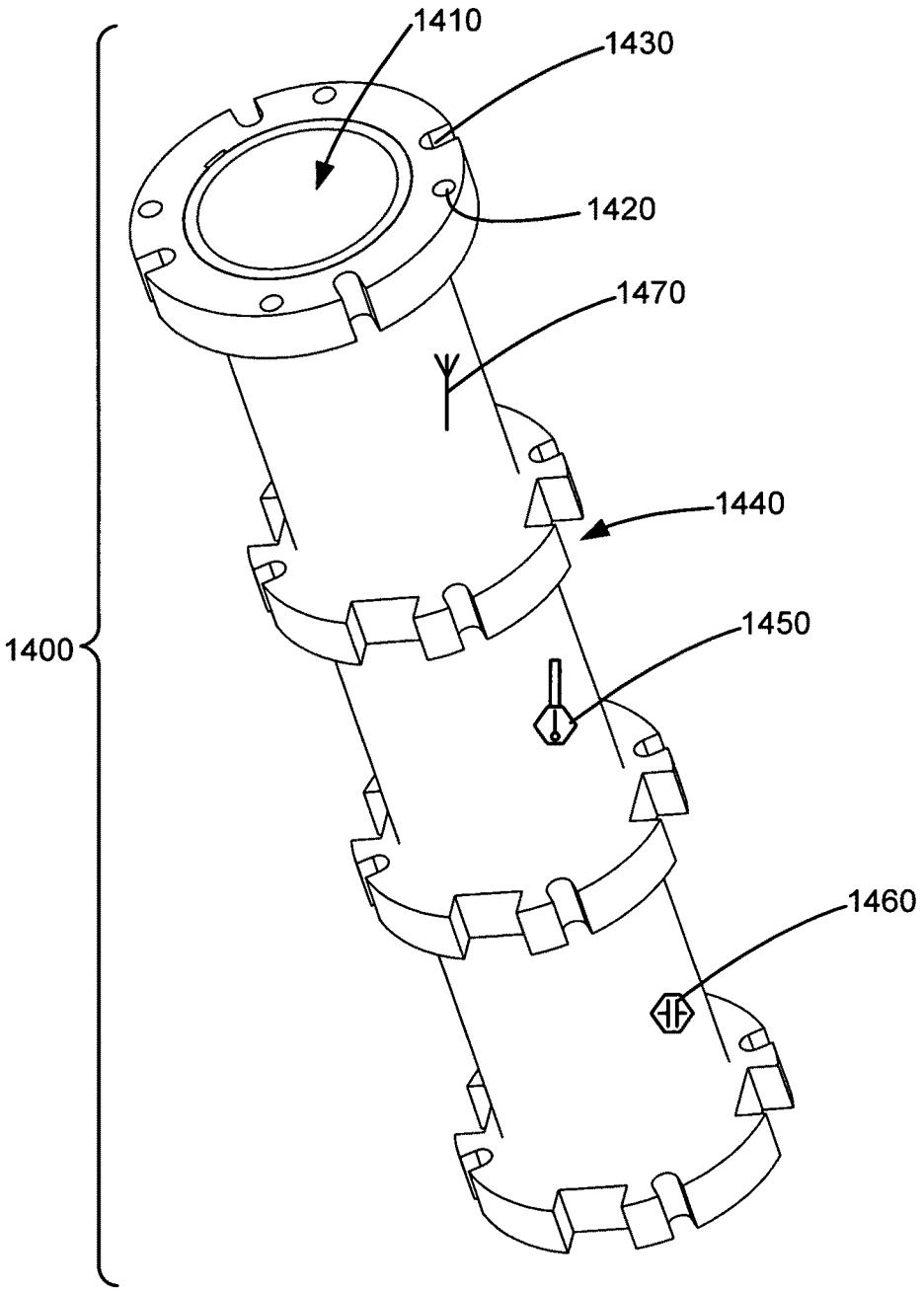
FIG. 14 is a schematic depicting some aspects of a core stabilizer.

Some embodiments include one or more core stabilizer 1400, such as illustrated in FIG. 14. The core stabilizer may include at least one surface configured to be operably attached to a storage region alignment unit 310. For example, the core stabilizer 1400 may include one or more indentations 1420 configured to facilitate the positioning of fasteners to operably attach the core stabilizer 1400 to a storage region alignment unit 310. The core stabilizer 1400 may include at least one central conduit 1410. The core stabilizer 1400 may include at least one central conduit 1410 configured to be in alignment with the conduit 130 connecting the single outer wall aperture 290 with the single inner wall aperture 280. The core stabilizer 1400 may be configured to be in alignment with the access aperture to the storage region 220. The core stabilizer 1400 may include one or more indentations 1430 configured to align with the stored material dispenser unit operator 140 within the storage region 220. The core stabilizer 1400 may include one or more indentations 1440 configured to facilitate insertion of the core stabilizer 1400 through the conduit 130 during assembly of the units within the storage region 220. The core stabilizer 1400 may include one or more transmission elements or receiving elements, for example one or more antennas 1470. The one or more transmission elements may transmit by any means known in the art, for example, but not limited to, via radio frequency (e.g. RFID tags), magnetic field, electromagnetic radiation, electromagnetic waves, sonic waves, or radioactivity. The one or more receiving elements may receive signals by any means known in the art, for example, but not limited to, via detection of sonic waves, electromagnetic waves, radio signals, electrical signals, magnetic pulses, or radioactivity. The core stabilizer 1400 may include one or more temperature sensors 1450, such as, for example, chemical sensors, thermometers, bimetallic strips, or thermocouples. The core stabilizer 1400 may include one or more other sensors 1460. For example, the core stabilizer may include one or more optical sensors.

In some embodiments, one or more electronic elements are arranged along the length of the sore stabilizer 1400 as illustrated in FIG. 14. Depending on the embodiment, the number, variety and configuration of such elements may vary. For example, some embodiments may include a series of electronic temperature sensors positioned at intervals along the length of the core stabilizer 1400. Such temperature sensors may be utilized to confirm the overall internal temperature within the storage region 220 as well as to confirm that any variation in temperature within the storage region 220 is within acceptable limits. Data from the temperature sensors may be transmitted to a region external to the container 100, such as through an antenna 1470. Depending on the embodiment, the inclusion of some electronic elements may be restricted due to their thermal radiation during use. For example, in some embodiments an internal power source may not be desirable to supply power to the more electronic elements arranged along the length of the core stabilizer 1400. In some embodiments may include wires along the length of the core stabilizer 1400 to facilitate coordination of the electronic elements, to transmit information, and/or to supply power to the electronic elements. Such wires may be configured to extend along the conduit 130, potentially with an extended thermal path (such as wrapping the wires in a helical fashion around the conduit 130. In some embodiments, there may be one or more photodiodes configured to optically register the passage of a stored material unit 1210 from an egress unit 600. The photodiodes may be paired with reflector units aligned to reflect light from an LED source across, for example, the surface of an egress ramp 610 or through an egress region 1320.

Depending on the embodiment, a substantially thermally sealed storage container 100 may include one or more sensors. The sensors may be located internally to the container, for example within the conduit 130, within the storage region 220 such as operably attached to a surface of the core stabilizer 1400. For example, a substantially thermally sealed storage container 100 may include one or more sensors of radio frequency identification ("RFID") tags to identify material within the at least one substantially thermally sealed storage region. RFID tags are well known in the art, for example in U.S. Pat. No. 5,444,223 to Blama, titled "Radio frequency identification tag and method," which is herein incorporated by reference. For example, a substantially thermally sealed storage container 100 may include one or more sensors such as a physical sensor component such as described in U.S. Pat. No. 6,453,749 to Petrovic et al., titled "Physical sensor component," which is herein incorporated by reference. For example, a substantially thermally sealed storage container 100 may include one or more sensors such as a pressure sensor such as described in U.S. Pat. No. 5,900,554 to Baba et al., titled "Pressure sensor," which is herein incorporated by reference. For example, a substantially thermally sealed storage container 100 may include one or more sensors such as a vertically integrated sensor structure such as described in U.S. Pat. No. 5,600,071 to Sooriakumar et al., titled "Vertically integrated sensor structure and method," which is herein incorporated by reference. For example, a substantially thermally sealed storage container 100 may include one or more sensors such as a system for determining a quantity of liquid or fluid within a container, such as described in U.S. Pat. No. 5,138,559 to Kuehl et al., titled "System and method for measuring liquid mass quantity," U.S. Pat. No. 6,050,598 to Upton, titled "Apparatus for and method of monitoring the mass quantity and density of a fluid in a closed container, and a vehicular air bag system incorporating such apparatus," and U.S. Pat. No. 5,245,869 to Clarke et al., titled "High accuracy mass sensor for monitoring fluid quantity in storage tanks," each of which is herein incorporated by reference.

Figure 15:
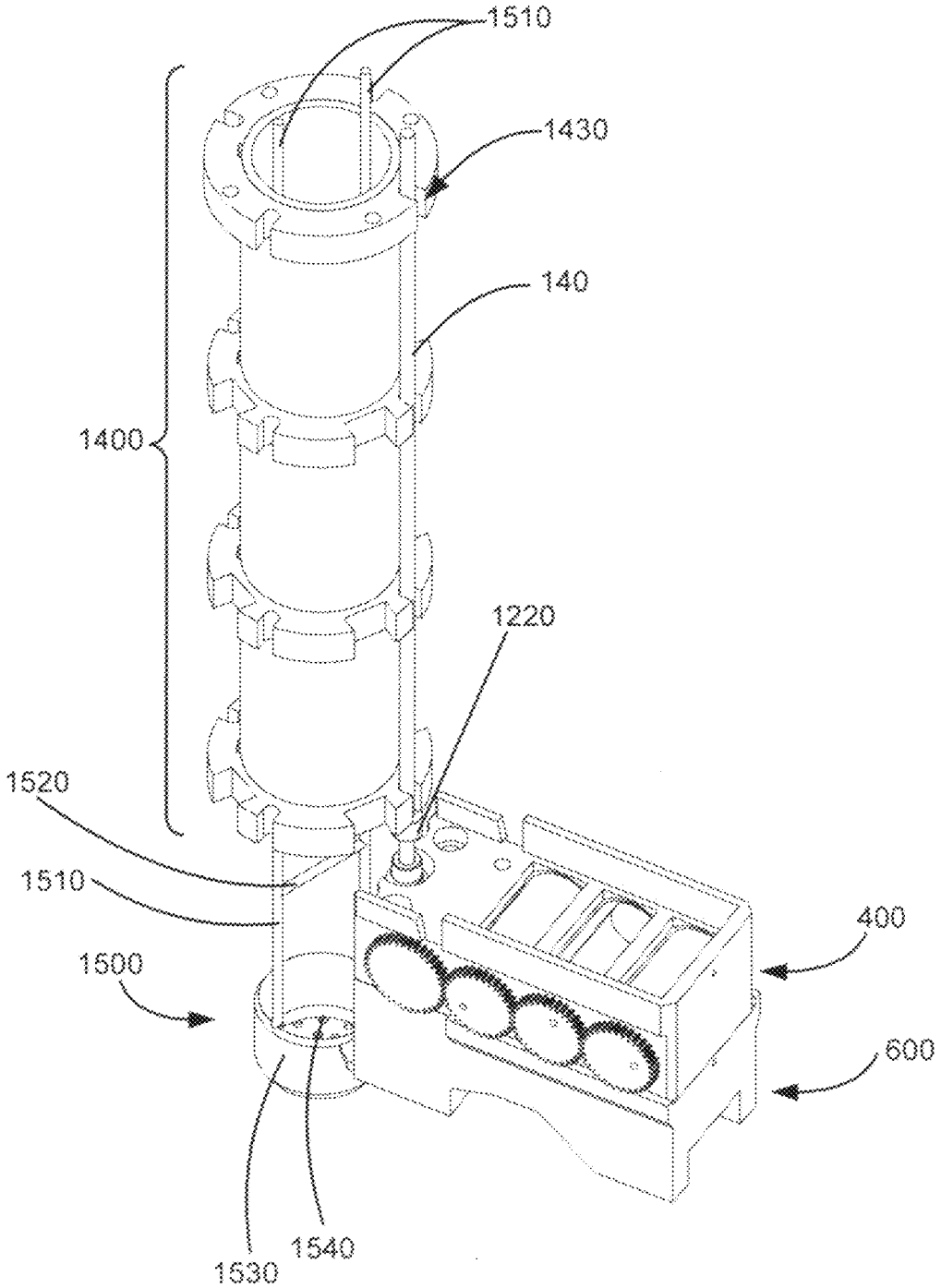
FIG. 15 is a schematic illustrating some aspects of an inner assembly of a substantially thermally sealed storage container.

FIG. 15 illustrates a potential assembly of the units described in FIGS. 1, 4, 6, 12 and 14. Although the configuration, orientation and alignment of the units may differ depending on the embodiment, FIG. 15 shows a potential configuration in some embodiments. A stored material dispenser unit 400 is positioned adjacent to a stored material egress unit 600. A core stabilizer 1400 is positioned relative to the stored material dispenser unit 400 and the stored material egress unit 600 such as by operably attachment of the core stabilizer 1400 to a storage region alignment unit 310 (not shown). One or more indentations 1430 in the core stabilizer 1400 are configured to mate with the surface of a stored material dispenser unit operator 140. The stored material dispenser unit operator 140 may also include one or more projections 1220 configured to reversibly mate with the surface of the core stabilizer 1400. FIG. 15 also illustrates a stored material removal unit 1500. Although the stored material removal unit 1500 is shown as a basket 1530 and rods 1510, other configurations are possible, depending on the embodiment and the intended stored material. The stored material removal unit 1500 illustrated in FIG. 15 includes a basket 1530 and rods 1510, wherein the rods are of a suitable length to pass through the conduit and the length of the storage region 220. The basket 1530 of the stored material removal unit 1500 includes a plurality of holes 1540 to allow air flow through the basket 1530 during passage of the basket 1530 through the storage region 220. In some embodiments, part of or the entire basket 1530 may be fabricated from mesh to facilitate air flow. The stored material removal unit 1500 includes rods 1510 and stabilizing elements 1520 positioned horizontally across the roads 1510.

Figure 16:
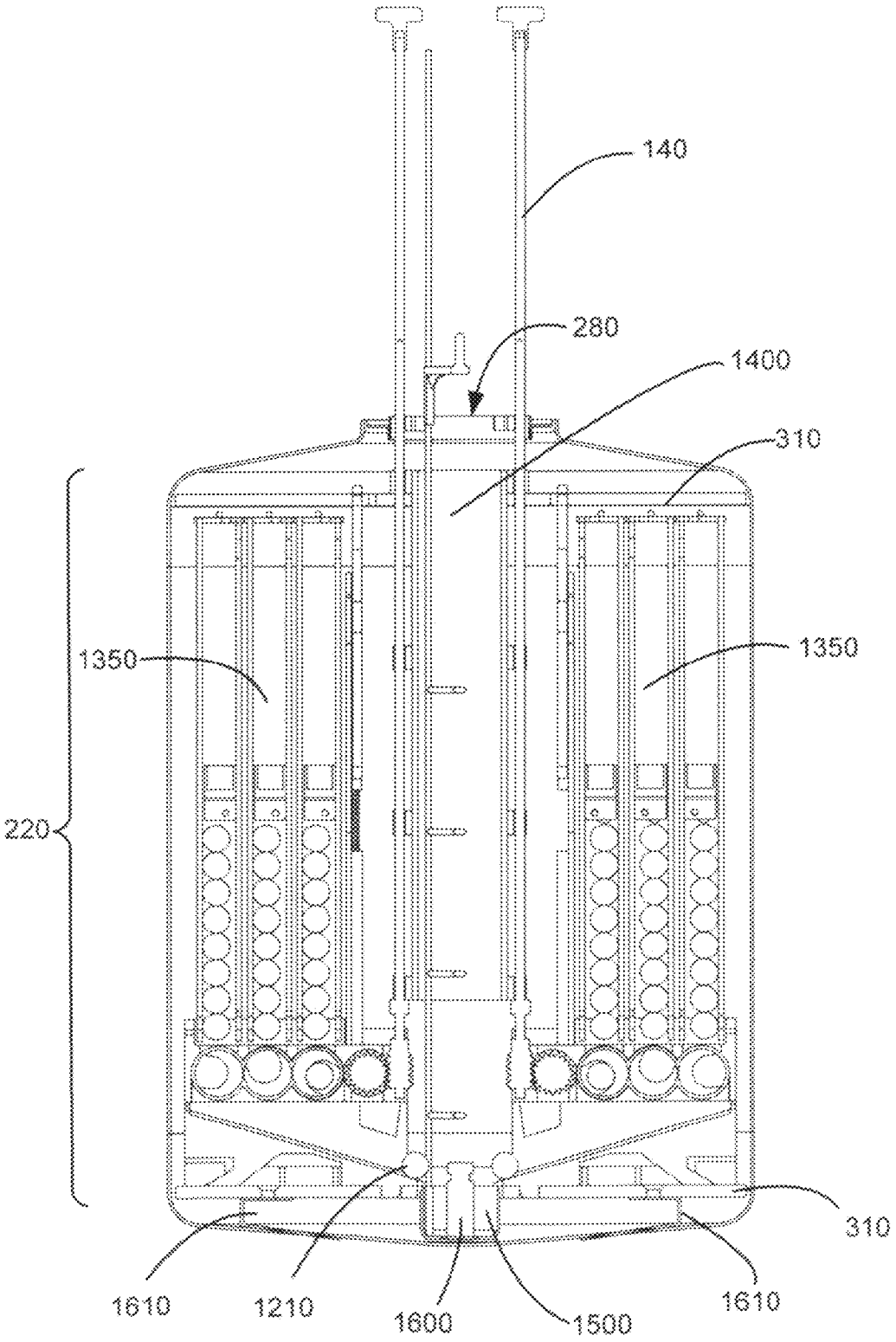
FIG. 16 is a schematic showing some aspects of an inner assembly of a substantially thermally sealed storage container.

FIG. 16 illustrates a potential configuration of assembled units, such as those shown in FIGS. 1-15, within a storage region 220 of a substantially thermally sealed storage container 100. FIG. 16 illustrates a substantially thermally sealed storage container 100 and its internal assembly in a vertical cross-section view. Although the configuration, orientation and alignment of the units may differ depending on the embodiment, FIG. 16 shows a potential configuration in some embodiments. Two groups of the assembly of units 1350 as illustrated in FIG. 13 are shown within the storage region 220. A core stabilizer 1400 is aligned with the single access aperture 280 to the storage region 220. The core stabilizer is operably attached with a top storage region alignment unit 310. The storage region 220 also includes a lower storage region alignment unit 310 which is operably attached to the interior surface of the storage region 220 with fasteners 1610. The assembly 1600 shown in FIG. 16 is configured to facilitate the movement of stored material 1210 into a stored material removal unit 1500. The stored material may be released from the storage unit dispenser units through rotation of one or more dispenser unit operator units 140 by person acting external to the container 100.

Figure 17:
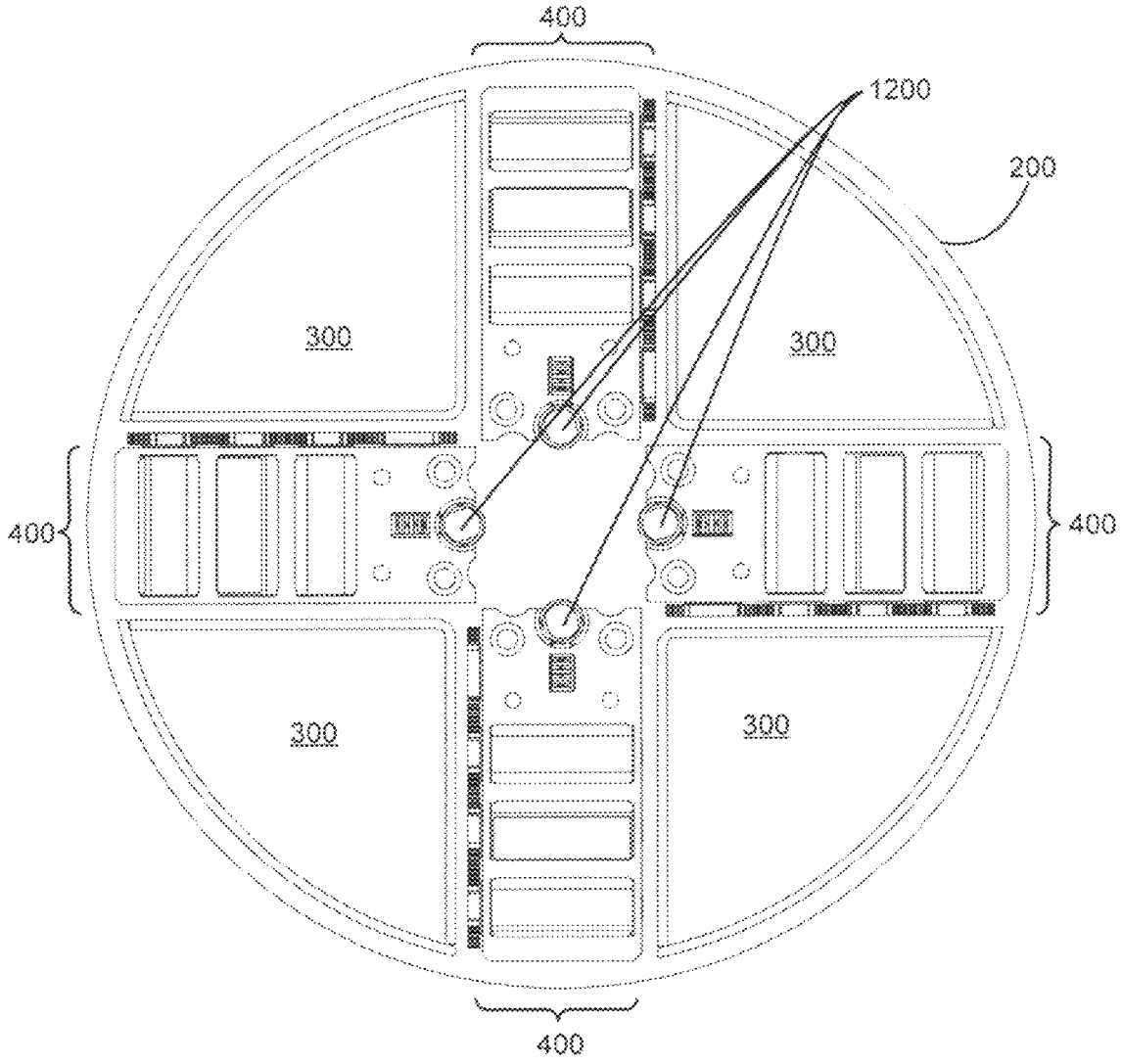
FIG. 17 is a schematic depicting some aspects of an inner assembly of a substantially thermally sealed storage container.

FIG. 17 illustrates the potential configuration of assembled units, as depicted in FIG. 16, in horizontal cross-section view. Although the configuration, orientation and alignment of the units may differ depending on the embodiment, FIGS. 16 and 17 shows a potential configuration in some embodiments. Illustrated is the inner wall 200, which substantially defines a substantially thermally sealed storage region 220 within the storage container 100 (see FIG. 2). The interior of the storage region includes a plurality of heat sink units 300 dispersed to allow the inclusion of stored material dispenser units 400 between the heat sink units 300. Although FIG. 17 illustrates four heat sink units 300 and four stored material dispenser units 400, various numbers and combinations of units are possible depending on the embodiment. Also illustrated are four dispenser unit operator units 140 operably attached to the four stored material dispenser units 400.

Figure 18:
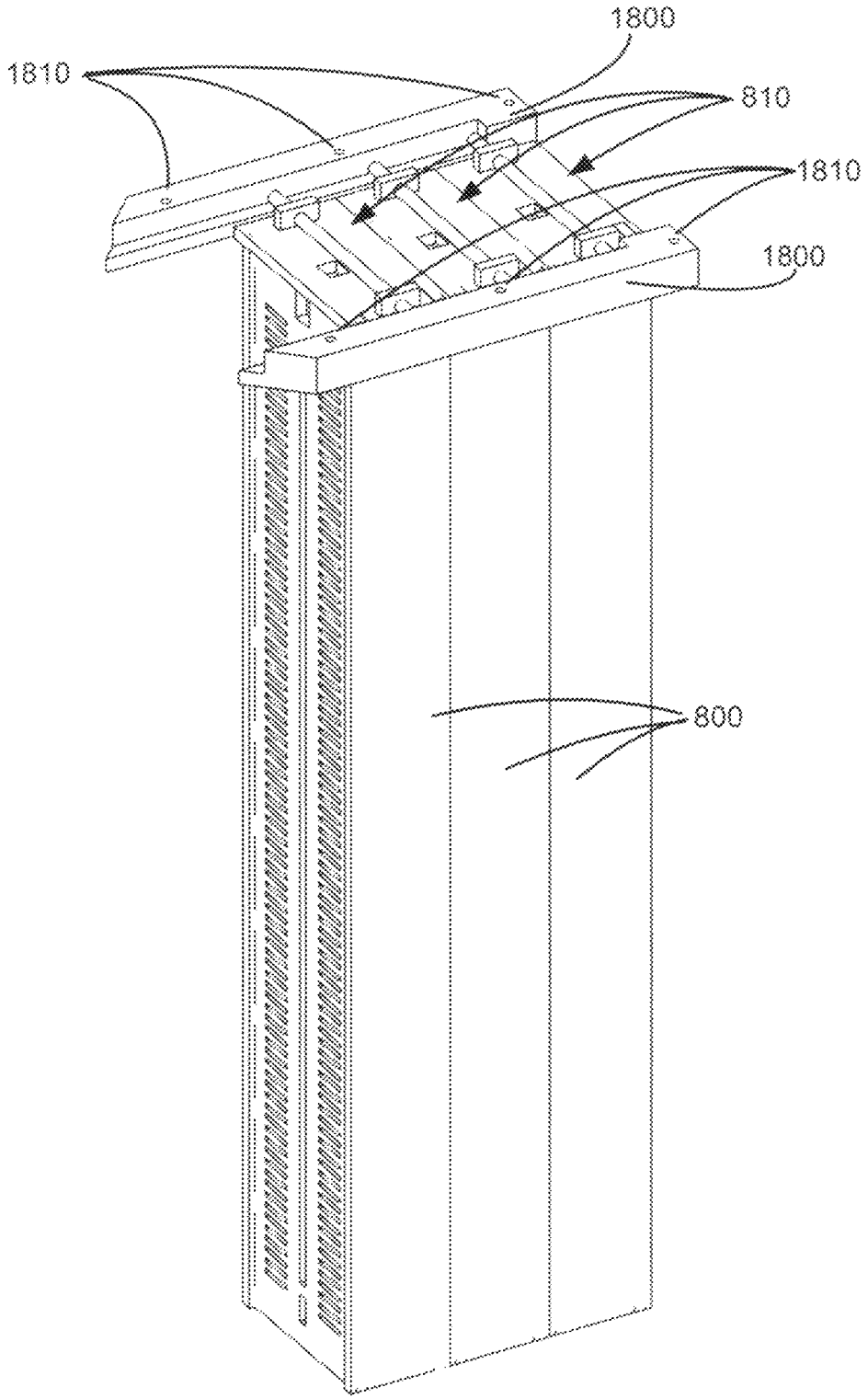
FIG. 18 is a schematic illustrating some aspects of an inner assembly of a substantially thermally sealed storage container.

FIG. 18 illustrates aspects of the attachment units 810 of stored material retention units 800 as they may be operably attached to a storage region alignment unit 310 in some embodiments. FIG. 18 depicts three stored material retention units 800 with their respective attachment units 810 operably attached to a pair of brackets 1800 which are configured to attach to a surface of a storage region alignment unit 310. The pair of brackets 1800 may be attached to a surface of a storage region alignment unit 310 through, for example, fastening elements attached to the brackets 1800 and a storage region alignment unit 310 through positioning holes 1810.

Figure 19:
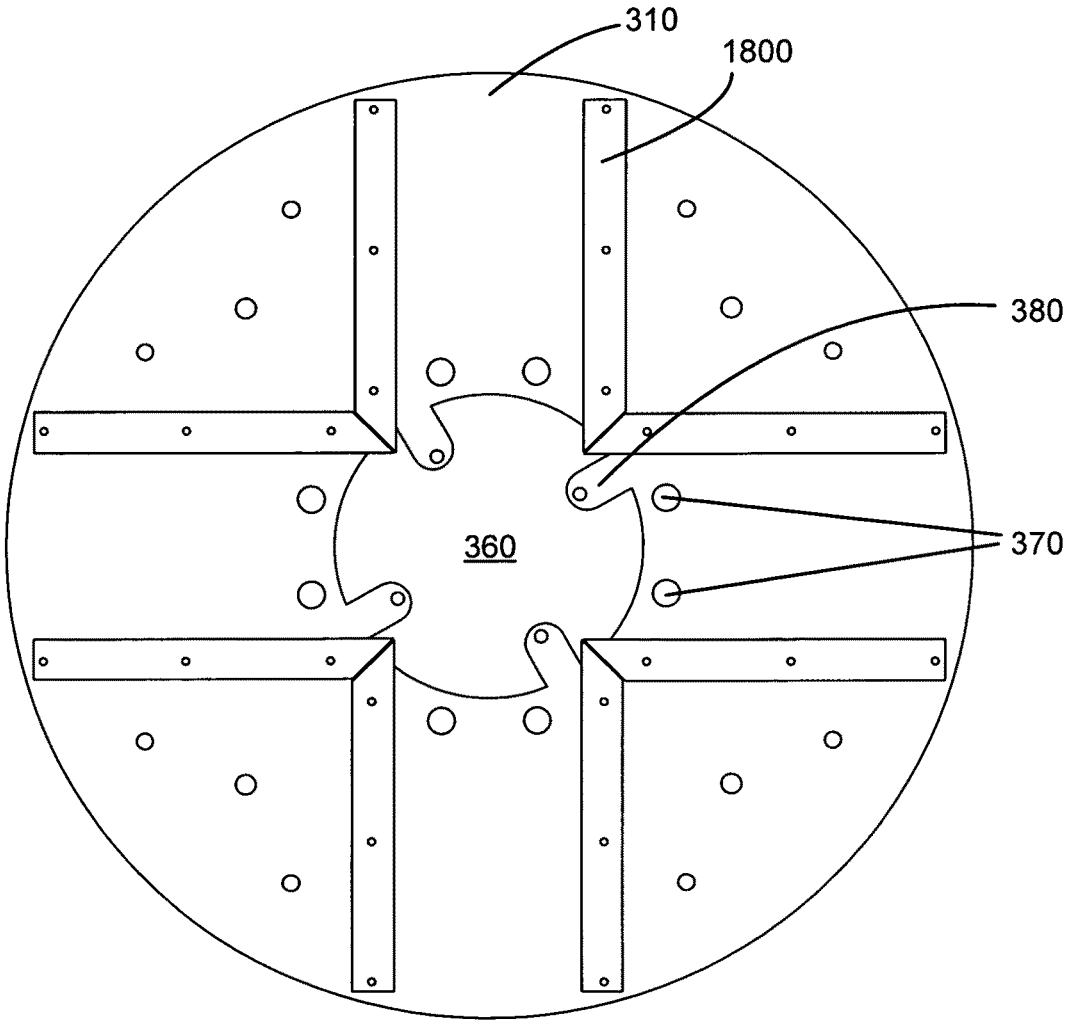
FIG. 19 is a schematic showing some aspects of an inner assembly of a substantially thermally sealed storage container.

FIG. 19 illustrates a potential configuration of a storage region alignment unit 310 with brackets 1800 attached. Shown is a view of the surface of a storage region alignment unit 310 such as illustrated in FIGS. 3 and 16. Brackets 1800 are configured to align the attachment units 810 of stored material retention units 800 as illustrated in FIGS. 12, 16 and 18. The storage region alignment unit 310 also includes holes 370 positioned to facilitate attachment of a core stabilizer 1400 relative to the storage region alignment unit 310 within a substantially thermally sealed storage region 200. An aperture 360 is shown, which may be configured to align with the conduit 130 or the inner wall aperture 280.

Figure 20:
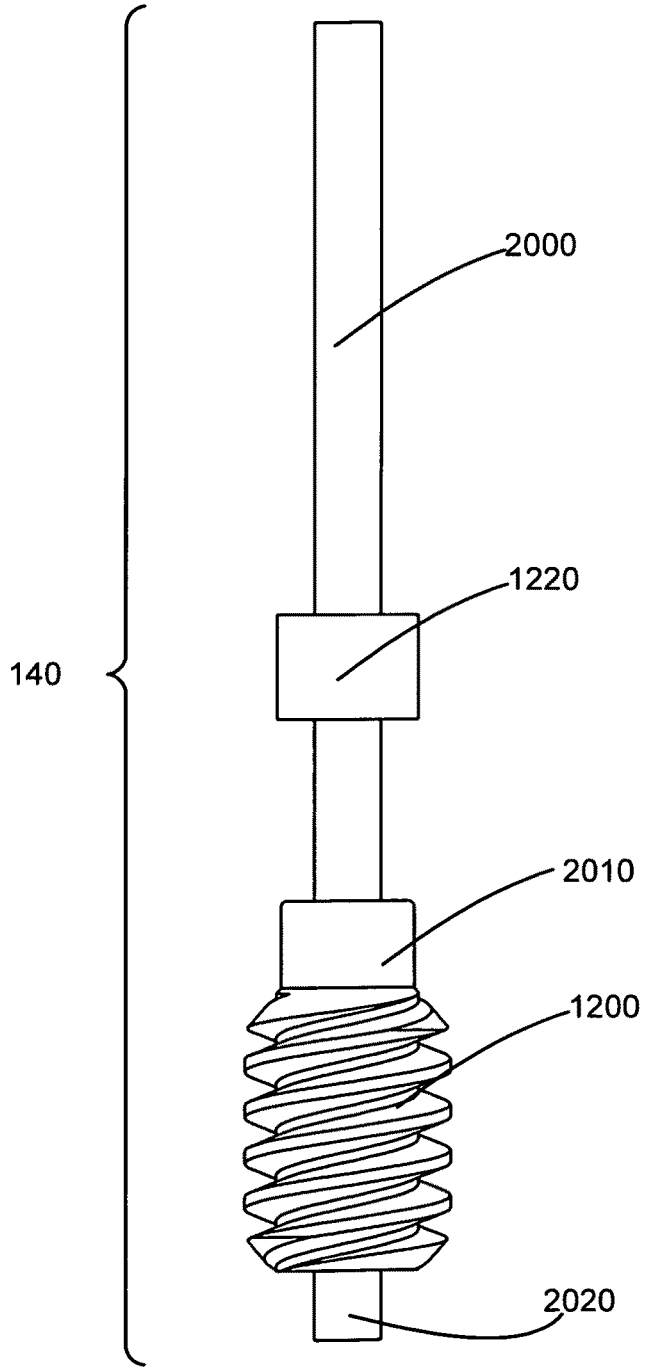
FIG. 20 is a schematic depicting some aspects of a stored material dispenser unit operator.

FIG. 20 illustrates aspects of some embodiments of a dispenser unit operator unit 140. A dispenser unit operator unit 140 may include a rod 2000 of suitable length, strength and durability for the embodiment. For example, a rod 2000 should be of suitable length to allow an individual person to manipulate the rod 2000 from a region external to the container 100. The dispenser unit operator unit 140 may include one or more projections 1220, 2010 configured to reversibly mate with one or more surfaces of another unit, such as with a surface of a core stabilizer 1400 as illustrated in FIG. 15. The dispenser unit operator unit 140 may include an interface element 1200, such as the gear illustrated in FIG. 20. In some embodiments, the interface element 1200 may include, for example, a magnetic interface or a physical force transmitting interface. The dispenser unit operator unit 140 may include an end element 2020 configured to reversibly mate, for example, with a surface of a stored material dispenser unit 400. An end element 2020 may be configured to facilitate positioning of the dispenser unit operator unit 140 relative to another unit, such as a stored material dispenser unit 400, a core stabilizer 1400 or a storage region alignment unit 310.

Figure 21:
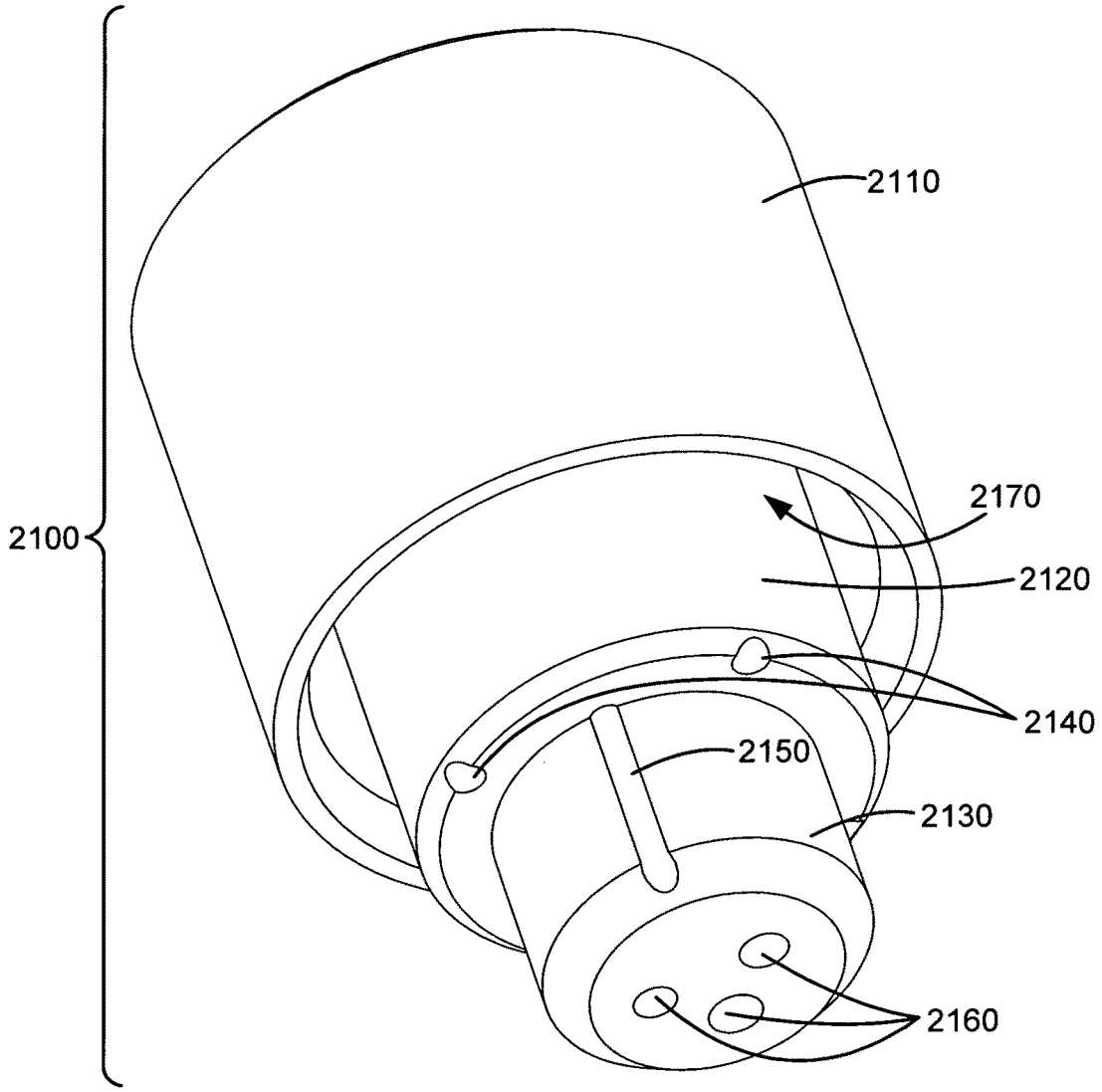
FIG. 21 is a schematic illustrating some aspects of an external cap for an exterior access conduit.

FIG. 21 illustrates aspects of an external cap 2100. An external cap may be included in some embodiments. An external cap 2100 may be configured to reversibly mate with the surface of an external region 110, for example during shipment or storage of the container 100. The external cap 2100 illustrated in FIG. 21 includes an outer shell 2110 configured to encircle the outer surface of an external conduit 110. A gap region 2170 of the external cap 2100 is configured to reversibly mate with the surface of an external region 110. An inner core 2120 of the external cap 2100 is configured to fit within the external region 110 along the interior surface of the external region 110. The inner core 2120 may, depending on the embodiment, be hollow, or contain an insulation material such as, for example, a polystyrene foam material. The external cap 2100 may also include an extension region 2130 configured to fit within the external region 110 at a distance from the interior surface. The extension region 2130 may, depending on the embodiment, be hollow, or contain an insulation material such as, for example, a polystyrene foam material. One or more indentations 2140, 2150, 2160 may be positioned on the surface of the inner core 2120 and/or the extension region 2130 in alignments and locations suitable for air flow around the surface of the external cap 2100 during placement and removal of the external cap 2100 on the external region 110. Some embodiments include an external cap for the single aperture 290 in the outer wall 100, wherein the external cap is configured to entirely cover the single aperture 290. Some embodiments include an external cap for the single aperture 290 in the outer wall 100, wherein the external cap is configured to entirely cover the single aperture 290 and wherein the external cap is configured to be reversibly attachable to an exterior surface of the exterior wall of the container 100. The container 100 may include an exterior access conduit, wherein the exterior access conduit is configured to extend the conduit extending the single outer wall aperture 280 with the single inner wall aperture 290 to the external region surrounding the container 100. Some embodiments include an external cap for the exterior access conduit, wherein the external cap is configured to entirely cover the exterior end of the exterior access conduit.

A substantially thermally sealed container 100 may include one or more light sources positioned to illuminate the substantially thermally sealed storage region 220. Although thermal transfer of energy is a consideration for a light source positioned to illuminate the substantially thermally sealed storage region 220, multiple types and configurations are possible depending on the embodiment. For example, in some embodiments, an LED light source may be positioned within the substantially thermally sealed storage region 220. For example, a light source may be operably connected to the conduit 130 and positioned to illuminate the substantially thermally sealed storage region 220. For example, a light source may be operably connected to a storage region alignment unit 310 within the substantially thermally sealed storage region 220. For example, a light source may be operably connected to a core stabilizer 1400. For example, a light source may be operably connected to an egress unit 600. For example, a light source may be operably connected to a stored material removal unit 1500.

A substantially thermally sealed container 100 may include one or more optical sensors within the storage region 220, the one or more optical sensors oriented to detect stored material. A substantially thermally sealed container 100 may include one or more optical sensors within the storage region 220, the one or more optical sensors oriented to detect stored material within one or more of the at least one stored material dispenser unit 400. For example, one or more optical sensors may be operably connected to a storage region alignment unit 310 within the substantially thermally sealed storage region 220. For example, one or more optical sensors may be operably connected to a core stabilizer 1400. For example, one or more optical sensors may be operably connected to an egress unit 600. For example, one or more optical sensors may be operably connected to a stored material removal unit 1500.

A method of assembling the contents of a substantially thermally sealed container, such as the assemblies illustrated in FIGS. 16 and 17, includes: inserting, through an access aperture of a substantially thermally sealed storage container, a stored material egress unit; securing the stored material egress unit to a first storage region alignment unit within the storage region; inserting, through the access aperture, a stored material dispenser unit; operably connecting the stored material dispenser unit to the stored material egress unit; inserting, through the access aperture, at least one stored material retention unit; and wherein the storage region, the stored material egress unit, the stored material dispenser unit, the at least one stored material retention unit, and the stored material retention unit stabilizer are maintained within a predetermined temperature range during assembly.

Figure 22:
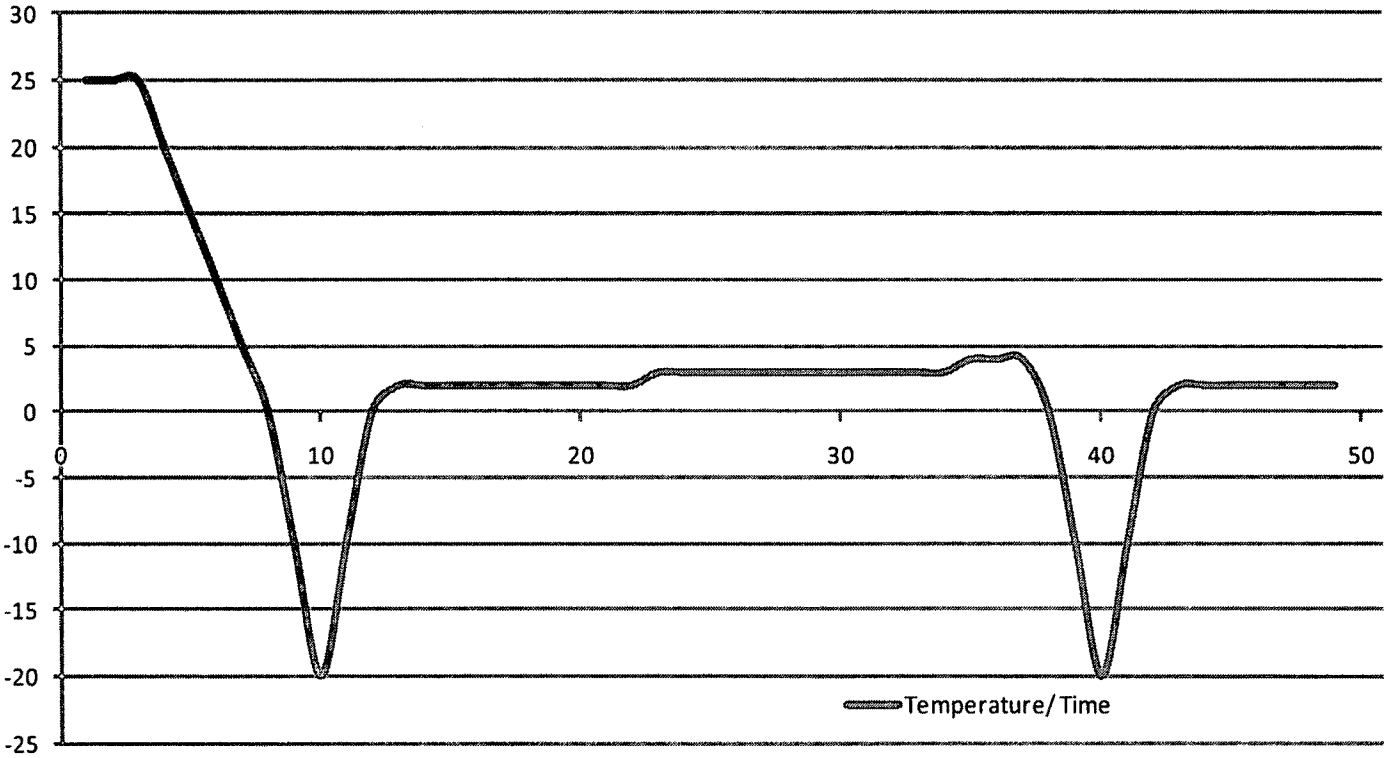
FIG. 22 is a graph depicting interior temperature of a substantially thermally sealed storage container relative to time.

FIG. 22 illustrates an example of the internal temperature of a substantially thermally sealed storage region within a substantially thermally sealed container over time. As illustrated to the left side of FIG. 22, the internal temperature of the substantially thermally sealed storage region begins at an ambient temperature of approximately 25 degrees Centigrade. The interior of the substantially thermally sealed storage region, and potentially one or more heat sink units within the substantially thermally sealed storage region, are then cooled to a temperature of approximately −20 degrees Centigrade. In embodiments wherein the heat sink material within the heat sink units includes water, this reduced temperature serves to fully convert the water within the heat sink units to ice. The internal temperature of a substantially thermally sealed storage region is then warmed to approximately 2 degrees Centigrade, for example through blowing warmer air within the substantially thermally sealed storage region through the conduit, or inverting the container to allow thermal transfer of heat energy for the area surrounding the container. Other units are then added to the interior of the substantially thermally sealed storage region as appropriate to the embodiment. Over time, stored material is removed from the storage region, however the internal temperature of the substantially thermally sealed storage region is maintained at a temperature below 5 degrees Centigrade. In some embodiments, the method includes wherein the storage region of the substantially thermally sealed storage container is maintained at a temperature substantially between approximately 2 degrees Centigrade and 8 degrees Centigrade during assembly. For example, the storage region of the substantially thermally sealed storage container may be maintained at a temperature substantially between approximately 2 degrees Centigrade and 4 degrees Centigrade during assembly. In some embodiments, the method includes maintaining the storage region of the substantially thermally sealed storage container and all inserted components at a temperature substantially between approximately 2 degrees Centigrade and approximately 8 degrees Centigrade during assembly. For example, the storage region of the substantially thermally sealed storage container and all inserted components may be maintained at a temperature substantially between approximately 2 degrees Centigrade and 4 degrees Centigrade during assembly. Once all stored material has been removed or the internal temperature of the substantially thermally sealed storage region rises to an unacceptably high temperature, the method is repeated to recharge the container for reuse.

For example, some embodiments include: reducing the temperature of the storage region within the substantially thermally sealed storage container to below 0 degrees Centigrade; elevating the temperature of the storage region within the substantially thermally sealed storage container to substantially between approximately 2 degrees Centigrade and approximately 8 degrees Centigrade; inserting, through the access aperture, a stored material retention unit containing stored material, the stored material retention unit containing stored material having a temperature substantially between approximately 2 degrees Centigrade and approximately 8 degrees Centigrade; and securing the stored material retention unit containing stored material to the stored material dispenser unit.

In some embodiments, the method includes inserting, through an access aperture of a substantially thermally sealed storage container, a stored material egress unit which includes inserting the stored material egress unit with a hooked rod. In some embodiments, the method includes inserting, through an access aperture of a substantially thermally sealed storage container, a stored material egress unit wherein the stored material egress unit is maintained at a temperature substantially between 2 degrees Centigrade and 8 degrees Centigrade. For example, the stored material egress unit may be maintained at a temperature substantially between 2 degrees Centigrade and 4 degrees Centigrade.

In some embodiments, the securing the stored material egress unit to a first storage region alignment unit within the storage region includes engaging the stored material egress unit with a surface of the first storage region alignment unit, and reversibly securing the stored material egress unit to the surface of the first storage region alignment unit. In some embodiments, the securing the stored material egress unit to a first storage region alignment unit within the storage region includes engaging the stored material egress unit with a first storage region alignment unit at a location where a surface of the second storage region alignment unit is configured for attachment. In some embodiments, the securing the stored material egress unit to a first storage region alignment unit within the storage region includes securing the stored material egress unit to an internal surface of the first alignment unit, wherein the first alignment unit is positioned opposite to the access aperture.

In some embodiments, the inserting, through the access aperture, a stored material dispenser unit includes inserting, through the access aperture, a stored material dispenser unit with a hooked rod. In some embodiments, the method includes inserting, through an access aperture of a substantially thermally sealed storage container, a stored material dispenser unit wherein the stored material dispenser unit is maintained at a temperature substantially between 2 degrees Centigrade and 8 degrees Centigrade. For example, the stored material dispenser unit may be maintained at a temperature substantially between 2 degrees Centigrade and 4 degrees Centigrade.

In some embodiments, the operably connecting the stored material dispenser unit to the stored material egress unit includes positioning the stored material dispenser unit in alignment with the stored material egress unit. In some embodiments, the operably connecting the stored material dispenser unit to the stored material egress unit includes connecting the stored material dispenser unit with the stored material egress unit with fasteners. For example, the operably connecting the stored material dispenser unit to the stored material egress unit may include connecting the stored material dispenser unit with the stored material egress unit with screw-type fasteners. For example, the operably connecting the stored material dispenser unit to the stored material egress unit may include connecting the stored material dispenser unit with the stored material egress unit with magnetic fasteners. For example, the operably connecting the stored material dispenser unit to the stored material egress unit may include connecting the stored material dispenser unit with the stored material egress unit with nail-type fasteners.

In some embodiments, the inserting, through the access aperture, at least one stored material retention unit includes inserting, through the access aperture, at least one stored material retention unit wherein the stored material retention unit is maintained at a temperature substantially between 2 degrees Centigrade and 8 degrees Centigrade. For example, the stored material retention unit may be maintained at a temperature substantially between 2 degrees Centigrade and 4 degrees Centigrade. In some embodiments, the inserting, through the access aperture, at least one stored material retention unit includes inserting, through the access aperture, more than one stored material retention unit. In some embodiments, the inserting, through the access aperture, at least one stored material retention unit includes inserting, through the access aperture, at least one stored material retention unit including stored material. In some embodiments, the inserting, through the access aperture, at least one stored material retention unit includes inserting, through the access aperture, at least one stored material retention unit including vaccine vials. In some embodiments, the inserting, through the access aperture, at least one stored material retention unit includes inserting, through the access aperture, at least one stored material retention unit including biological material. In some embodiments, the inserting, through the access aperture, at least one stored material retention unit includes inserting, through the access aperture, at least one stored material retention unit with a hooked rod. In some embodiments, the inserting, through the access aperture, at least one stored material retention unit includes aligning the at least one stored material retention unit with brackets attached to the first storage region alignment unit, and allowing gravity to move the at least one stored material retention unit along a pathway defined by the brackets. (See, e.g. FIG. 19.) In some embodiments, the inserting, through the access aperture, at least one stored material retention unit includes: inserting, through the access aperture, at least one stored material retention unit including a stored material retention device; engaging a surface of the at least one stored material retention unit with the stored material dispenser unit, and removing the at least one stored material retention device from the stored material retention unit.

Some embodiments of the method further include operably connecting the at least one stored material retention unit to the stored material dispenser unit. In some embodiments, the operably connecting the at least one stored material retention unit to the stored material dispenser unit may include securing the at least one stored material retention unit to a surface of the second storage region alignment unit. In some embodiments, the operably connecting at least one stored material retention unit to the stored material dispenser unit includes connecting the stored material dispenser unit with the stored material egress unit with fasteners. In some embodiments, the operably connecting at least one stored material retention unit to the stored material dispenser unit includes reversibly securing the at least one stored material retention unit to the stored material dispenser unit. For example, the operably connecting at least one stored material retention unit to the stored material dispenser unit may include connecting the at least one stored material retention unit to the stored material dispenser unit with screw-type fasteners. For example, the operably connecting the at least one stored material retention unit to the stored material dispenser unit may include connecting the at least one stored material retention unit to the stored material dispenser unit with magnetic fasteners. For example, the operably connecting the at least one stored material retention unit to the stored material dispenser unit may include connecting the at least one stored material retention unit to the stored material dispenser unit with nail-type fasteners. In some embodiments, the operably connecting at least one stored material retention unit to the stored material dispenser unit includes connecting the stored material dispenser unit with the stored material egress unit by mating one or more surfaces of the at least one stored material retention unit to one or more surfaces of the stored material dispenser unit. In some embodiments, the operably connecting the at least one stored material retention unit to the stored material dispenser unit may include engaging at least one surface of the at least one stored material retention unit with at least one surface of the stored material dispenser unit, and reversibly securing the at least one stored material retention unit to the stored material dispenser unit. In some embodiments, the operably connecting the at least one stored material retention unit to the stored material dispenser unit may include engaging at least one surface of the at least one stored material retention unit with at least one surface of the stored material dispenser unit, wherein the engaging aligns the at least one stored material retention unit with an interlock of the stored material dispenser unit so as to orient a unit of stored material within the at least one stored material dispenser unit with an interlock region of the interlock, and engaging at least one surface of the at least one stored material retention unit with a surface of the second storage region alignment unit. In some embodiments, the operably connecting the at least one stored material retention unit to the stored material dispenser unit may include securing the at least one stored material retention unit in vertical alignment with at least one additional stored material retention unit. In some embodiments, the operably connecting the at least one stored material retention unit to the stored material dispenser unit may include securing the at least one stored material retention unit in an orientation to allow progression of stored material into the stored material dispenser unit.

In some embodiments, the method includes: inserting, through the access aperture, a stored material retention unit stabilizer; and placing the stored material retention unit stabilizer adjacent to one of the at least one stored material retention unit, the stored material dispenser unit and a second storage region alignment unit within the storage region. Embodiments of the method may include inserting, through the access aperture, a stored material retention unit stabilizer with a hooked rod. Embodiments of the method may include placing the stored material retention unit stabilizer adjacent to one of the at least one stored material retention unit, the stored material dispenser unit and a second storage region alignment unit within the storage region wherein the placing includes: aligning the at least one surface of the stored material retention unit stabilizer with at least one surface of the stored material dispenser unit, wherein the at least one surface of the stored material retention unit stabilizer and the at least one surface of the stored material dispenser unit are configured to mate; compressing the stored material retention unit stabilizer; aligning the stored material retention unit stabilizer with a predetermined location of a surface of the second storage region alignment unit; and releasing the compression on the stored material retention unit stabilizer.

In some embodiments, the method includes placing a cover over an exterior of the access aperture, wherein the cover is configured to reversibly mate with a surface of the access aperture. For example, placing a cover over an exterior of the access aperture may be desirable prior to storage or transport of the container.

In some embodiments, the method includes: inserting a stored material dispenser unit operator into the storage region; and engaging at least one surface of the stored material dispenser unit operator with a stored material dispenser unit, wherein the engaging surfaces of the stored material dispenser unit operator and the stored material dispenser unit are configured to reversibly mate.

In some embodiments, the method includes: inserting, through the access aperture, a core stabilizer; and securing the core stabilizer to a surface of the second storage region alignment unit, so that the core stabilizer functionally extends the access aperture into the storage region.

In some embodiments, the method includes: inserting, through the access aperture of the substantially thermally sealed storage container, a stored material removal unit; and aligning the stored material removal unit with the first storage region alignment unit.

The method may also, depending on the embodiment, include removing stored material from the storage region through the access aperture with a stored material removal unit.

In some embodiments, the method includes: disengaging the stored material retention unit stabilizer from the stored material dispenser unit; disengaging at least one stored material retention unit from the stored material dispenser unit; and removing the at least one stored material retention unit from the interior of the container through the access aperture. The method may also include: inserting, through the access aperture, at least one additional stored material retention unit; securing the at least one additional stored material retention unit to the stored material dispenser unit; and placing the stored material retention unit stabilizer adjacent to one of the at least one additional stored material retention unit, the stored material dispenser unit and a surface of the second storage region alignment unit; wherein the storage region, the stored material egress unit, the stored material dispenser unit, the additional at least one stored material retention unit, and the stored material retention unit stabilizer are maintained within a predetermined temperature range during assembly.

In some embodiments, the method includes: adding water to at least one heat sink unit within the storage region, wherein the water is at a temperature substantially between approximately 85 degrees Centigrade and approximately 100 degrees Centigrade; sealing the at least one heat sink unit; cooling the storage region and the at least one heat sink unit to below 0 degrees Centigrade; and warming the storage region to a temperature within a predetermined temperature range above 0 degrees Centigrade. The method may include sealing the heat sink unit while the water is at a temperature substantially between approximately 85 degrees Centigrade and approximately 100 degrees Centigrade and cooling the storage region and the at least one heat sink unit to approximately degrees Centigrade. The water may be purified water. The water may be degassed water. The water may be purified and degassed. Depending on the embodiment, these aspects of the method may minimize physical deformation of the heat sink unit during freezing.

In some implementations described herein, logic and similar implementations may include software or other control structures. Electronic circuitry, for example, may have one or more paths of electrical current constructed and arranged to implement various functions as described herein. In some implementations, one or more media may be configured to bear a device-detectable implementation when such media hold or transmit a device detectable instructions operable to perform as described herein. In some variants, for example, implementations may include an update or modification of existing software or firmware, or of gate arrays or programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components. Specifications or other implementations may be transmitted by one or more instances of tangible transmission media as described herein, optionally by packet transmission or otherwise by passing through distributed media at various times.

Alternatively or additionally, implementations may include executing a special-purpose instruction sequence or invoking circuitry for enabling, triggering, coordinating, requesting, or otherwise causing one or more occurrences of virtually any functional operations described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled//implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit). The reader will recognize how to obtain, configure, and optimize suitable transmission or computational elements, material supplies, actuators, or other structures in light of these teachings.

In a general sense, the various embodiments described herein can be implemented, individually and/or collectively, by various types of electro-mechanical systems having a wide range of electrical components such as hardware, software, firmware, and/or virtually any combination thereof; and a wide range of components that may impart mechanical force or motion such as rigid bodies, spring or torsional bodies, hydraulics, electro-magnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs. Examples of electro-mechanical systems include but are not limited to a variety of consumer electronics systems, medical devices, as well as other systems such as motorized transport systems, factory automation systems, security systems, and/or communication/computing systems. Electro-mechanical as used herein is not necessarily limited to a system that has both electrical and mechanical actuation except as context may dictate otherwise.

In a general sense, the various aspects described herein which can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). The subject matter described herein may be implemented in an analog or digital fashion or some combination thereof.

At least a portion of the devices and/or processes described herein can be integrated into an image processing system. A typical image processing system generally includes one or more of a system unit housing, a video display device, memory such as volatile or non-volatile memory, processors such as microprocessors or digital signal processors, computational entities such as operating systems, drivers, applications programs, one or more interaction devices (e.g., a touch pad, a touch screen, an antenna, etc.), control systems including feedback loops and control motors (e.g., feedback for sensing lens position and/or velocity; control motors for moving/distorting lenses to give desired focuses). An image processing system may be implemented utilizing suitable commercially available components, such as those typically found in digital still systems and/or digital motion systems.

At least a portion of the devices and/or processes described herein can be integrated into a data processing system. A data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

It is common within the art to implement devices and/or processes and/or systems, and thereafter use engineering and/or other practices to integrate such implemented devices and/or processes and/or systems into more comprehensive devices and/or processes and/or systems. That is, at least a portion of the devices and/or processes and/or systems described herein can be integrated into other devices and/or processes and/or systems via a reasonable amount of experimentation. Examples of such other devices and/or processes and/or systems might include—as appropriate to context and application—all or part of devices and/or processes and/or systems of (a) an air conveyance (e.g., an airplane, rocket, helicopter, etc.), (b) a ground conveyance (e.g., a car, truck, locomotive, tank, armored personnel carrier, etc.), (c) a building (e.g., a home, warehouse, office, etc.), (d) an appliance (e.g., a refrigerator, a washing machine, a dryer, etc.), (e) a communications system (e.g., a networked system, a telephone system, a Voice over IP system, etc.), (f) a business entity (e.g., an Internet Service Provider (ISP) entity such as Comcast Cable, Qwest, Southwestern Bell, etc.), or (g) a wired/wireless services entity (e.g., Sprint, Cingular, Nextel, etc.), etc.

In certain cases, use of a system or method may occur in a territory even if components are located outside the territory. For example, in a distributed computing context, use of a distributed computing system may occur in a territory even though parts of the system may be located outside of the territory (e.g., relay, server, processor, signal-bearing medium, transmitting computer, receiving computer, etc. located outside the territory).

The herein described components (e.g., operations), devices, objects, and the discussion accompanying them are used as examples for the sake of conceptual clarity and that various configuration modifications are contemplated. Consequently, as used herein, the specific examples set forth and the accompanying discussion are intended to be representative of their more general classes. In general, use of any specific example is intended to be representative of its class, and the non-inclusion of specific components (e.g., operations), devices, and objects should not be taken limiting.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. The terms (e.g. "configured to") can generally encompass active-state components and/or inactive-state components and/or standby-state components, unless context requires otherwise.

While particular aspects of the present subject matter described herein have been shown and described, changes and modifications may be made without departing from the subject matter described herein and its broader aspects and, therefore, the appended claims are to encompass within their scope all such changes and modifications as are within the true spirit and scope of the subject matter described herein. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). If a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, some reference is made herein to a range of values, e.g., from "approximately X to Y" means that the range is approximately from X to approximately Y. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, the recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art after reading the description herein. The various aspects and embodiments disclosed herein are for purposes of illustration and are not intended to be limiting, with the true scope and spirit being indicated by the following claims.

What is claimed is:

1. A substantially thermally sealed storage container, comprising:

an outer assembly, including one or more sections of ultra efficient insulation material substantially defining at least one thermally sealed storage region, wherein the outer assembly and the one or more sections of ultra efficient insulation material substantially define a single access aperture to the at least one thermally sealed storage region, the one or more sections of ultra efficient insulation material including a plurality of layers of multilayer insulation and substantially evacuated space having a pressure less than or equal to $5\times10^{-4}$ torr surrounding the plurality of layers of multilayer insulation, wherein the single access aperture is configured to allow access from a lower portion of the at least one thermally sealed storage region to an upper portion of the at least one thermally sealed storage region in a removal direction along which a stored vaccine vial can be removed through the single access aperture; and an inner assembly, including at least one heat sink unit within the at least one thermally sealed storage region, and at least one stored material dispenser unit, wherein the at least one stored material dispenser unit includes one or more interlocks, each of the one or more interlocks including at least one storage unit exchange unit rotatably affixed to the at least one stored material dispenser unit and having a longitudinal axis extending substantially perpendicular to the removal direction, wherein the at least one storage unit exchange unit is configured to rotate around the longitudinal axis and wherein the at least one storage unit exchange unit is of a size and shape to hold the stored vaccine vial and move the vaccine vial therethrough upon rotation of the at least one storage unit exchange unit.

2. The substantially thermally sealed storage container of claim 1, wherein the at least one stored material dispenser unit comprises:

at least one gear mechanism operably attached to the at least one storage unit exchange unit; and a control mechanism, wherein the control mechanism includes a gear mechanism configured to transmit torque to the at least one gear mechanism operably attached to the at least one storage unit exchange unit.

3. The substantially thermally sealed storage container of claim 1, wherein the inner assembly further comprises:

at least one stored material egress unit within the at least one thermally sealed storage region.

4. The substantially thermally sealed storage container of claim 1, wherein the inner assembly further comprises:

at least one storage region alignment unit within the at least one thermally sealed storage region.

5. The substantially thermally sealed storage container of claim 4, comprising:

at least two storage region alignment units on opposing ends of the at least one thermally sealed storage region, the at least two storage region alignment units aligned with the single access aperture.

6. The substantially thermally sealed storage container of claim 1, wherein the inner assembly further comprises:

at least one stored material retention unit within the at least one thermally sealed storage region.

7. The substantially thermally sealed storage container of claim 6, wherein the at least one stored material retention unit comprises:

a stored material retention region, wherein stored material is retained as a vertical column;

a ballast unit, positioned to maintain the stored material as a vertical column with minimal gaps; and at least one positioning element configured to retain the ballast unit in a vertical alignment with the stored material retention region.

8. The substantially thermally sealed storage container of claim 1, wherein the inner assembly further comprises:

at least one retention unit stabilizer within the at least one thermally sealed storage region.

9. The substantially thermally sealed storage container of claim 1, comprising:

a core stabilizer, wherein a surface of the core stabilizer is attached to a surface of a storage region alignment unit and wherein the core stabilizer is configured to be in alignment with the single access aperture.

10. The substantially thermally sealed storage container of claim 9, comprising:

at least one temperature sensor operably attached to the core stabilizer.

11. The substantially thermally sealed storage container of claim 9, comprising:

at least one optical sensor operably attached to the core stabilizer.

12. The substantially thermally sealed storage container of claim 1, wherein the inner assembly comprises:

a plurality of heat sink units, wherein the heat sink units are dispersed within the at least one thermally sealed storage region; and a plurality of stored material dispenser units, each of which is positioned between two heat sink units.

13. The substantially thermally sealed storage container of claim 1, further comprising:

a GPS device attached to the exterior surface of the substantially thermally sealed storage container.

14. The substantially thermally sealed storage container of claim 1, further comprising:

at least one transmission unit.

15. The substantially thermally sealed storage container of claim 1, further comprising:

a light source positioned to illuminate the at least one thermally sealed storage region.

16. The substantially thermally sealed storage container of claim 1, further comprising:

at least one temperature sensor within the at least one thermally sealed storage region.

17. The substantially thermally sealed storage container of claim 1, further comprising:

one or more optical sensors within the at least one thermally sealed storage region, the one or more optical sensors oriented to detect stored material.

18. A substantially thermally sealed storage container, comprising:

an outer assembly, including an outer wall substantially defining a substantially thermally sealed storage container, the outer wall substantially defining a single outer wall aperture;

an inner wall substantially defining a substantially thermally sealed storage region within the substantially thermally sealed storage container, the inner wall substantially defining a single inner wall aperture;

a gap between the inner wall and the outer wall, the gap including substantially evacuated space having a pressure less than or equal to $5\times10^{-4}$ torr;

at least one section of ultra efficient insulation material within the gap;

a conduit connecting the single outer wall aperture with the single inner wall aperture, the conduit having a longitudinal axis defining a removal direction;

a single access aperture to the substantially thermally sealed storage region, wherein the single access aperture is formed by an end of the conduit; and an inner assembly, including one or more heat sink units within the substantially thermally sealed storage region; and at least one stored material dispenser unit including one or more interlocks, each of the one or more interlocks including at least one substantially cylindrical storage unit exchange unit having a longitudinal axis extending substantially perpendicular to the longitudinal axis of the conduit, wherein the at least one substantially cylindrical storage unit exchange unit is configured to rotate around its longitudinal axis and wherein the at least one substantially cylindrical storage unit exchange unit is of a size and shape to hold a stored vaccine vial and move the vaccine vial therethrough upon rotation of the at least one substantially cylindrical storage unit exchange unit.

19. The substantially thermally sealed storage container of claim 18, wherein the one or more heat sink units comprise:

at least one structural element configured to define at least one watertight region; and water within the at least one watertight region.

20. The substantially thermally sealed storage container of claim 18, including a plurality of heat sink units distributed within the substantially thermally sealed storage region, wherein the plurality of heat sink units are configured to form material storage regions between the heat sink units.

21. The substantially thermally sealed storage container of claim 18, wherein the at least one stored material dispenser unit comprises:

an interlock mechanism configured to control egress of a stored material; and a control interface configured to operate the interlock mechanism.

22. The substantially thermally sealed storage container of claim 18, wherein the at least one stored material dispenser unit comprises:

at least one gear mechanism operably attached to each of the at least one substantially cylindrical storage unit exchange unit; and a control mechanism, wherein the control mechanism includes a gear mechanism configured to transmit torque to the at least one gear mechanism operably attached to each of the at least one substantially cylindrical storage unit exchange unit, and at least one gear mechanism configured to transmit torque from a dispenser unit operating unit.

23. The substantially thermally sealed storage container of claim 18, wherein the inner assembly comprises:

one or more storage region alignment units.

24. The substantially thermally sealed storage container of claim 18, wherein the inner assembly comprises:

at least one stored material egress unit.

25. The substantially thermally sealed storage container of claim 18, wherein the inner assembly comprises:

at least one stored material retention unit.

26. The substantially thermally sealed storage container of claim 25, wherein the at least one stored material retention unit comprises:

a stored material retention region, wherein stored material is retained as a vertical column;

a ballast unit, positioned to maintain the stored material as a vertical column with minimal gaps; and at least one positioning element configured to retain the ballast unit in a vertical alignment with the stored material retention region.

27. The substantially thermally sealed storage container of claim 18, comprising:

a core stabilizer.

28. The substantially thermally sealed storage container of claim 27, wherein the core stabilizer is configured to be in alignment with the single access aperture.

29. The substantially thermally sealed storage container of claim 27, wherein the core stabilizer comprises:

at least one temperature sensor operably attached to the core stabilizer.

30. The substantially thermally sealed storage container of claim 27, wherein the core stabilizer comprises:

at least one optical sensor operably attached to the core stabilizer.

31. The substantially thermally sealed storage container of claim 18, further comprising:

a GPS device attached to an exterior surface of the substantially thermally sealed storage container.

32. The substantially thermally sealed storage container of claim 18, further comprising:

at least one power source attached to an exterior surface of the substantially thermally sealed storage container, wherein the at least one power source is configured to supply power to circuitry within the substantially thermally sealed storage container.

33. The substantially thermally sealed storage container of claim 18, further comprising:

at least one transmission unit attached to an exterior surface of the substantially thermally sealed storage container.

34. A substantially thermally sealed storage container, comprising:

an outer assembly, including an outer wall substantially defining a substantially thermally sealed storage container, the outer wall substantially defining a single outer wall aperture;

an inner wall substantially defining a substantially thermally sealed storage region within the substantially thermally sealed storage container, the inner wall substantially defining a single inner wall aperture;

a gap between the inner wall and the outer wall;

at least one section of ultra efficient insulation material within the gap;

a conduit connecting the single outer wall aperture with the single inner wall aperture;

a single access aperture to the substantially thermally sealed storage region, wherein the single access aperture is formed by an end of the conduit; and an inner assembly, including one or more heat sink units within the substantially thermally sealed storage region;

one or more storage region alignment units;

at least one core stabilizer having a longitudinal axis;

at least one stored material egress unit;

at least one stored material dispenser unit including one or more interlocks, each of the one or more interlocks including at least one substantially cylindrical storage unit exchange unit having a longitudinal axis extending substantially perpendicular to the longitudinal axis of the core stabilizer, wherein the at least one substantially cylindrical storage unit exchange unit is configured to rotate around its longitudinal axis and wherein the at least one substantially cylindrical storage unit exchange unit is of a size and shape to hold a stored vaccine vial and move the vaccine vial therethrough upon rotation of the at least one substantially cylindrical storage unit exchange unit; and at least one stored material retention unit.

* * * * *